US007849793B2

(12) United States Patent
Takahashi

(10) Patent No.: US 7,849,793 B2
(45) Date of Patent: Dec. 14, 2010

(54) DOUBLE-SIDED STENCIL PRINTING APPARATUS

(75) Inventor: Takayuki Takahashi, Miyagi (JP)

(73) Assignee: Tohoku Ricoh Co., Ltd., Shibata-gun (JP)

( * ) Notice: Subject to any disclaimer, the term of this patent is extended or adjusted under 35 U.S.C. 154(b) by 482 days.

(21) Appl. No.: 11/848,852

(22) Filed: Aug. 31, 2007

(65) Prior Publication Data

US 2008/0148968 A1 Jun. 26, 2008

(30) Foreign Application Priority Data

Dec. 25, 2006 (JP) ..... 2006-347074

(51) Int. Cl.
*B41L 13/00* (2006.01)

(52) U.S. Cl. ..... 101/118; 101/116

(58) Field of Classification Search ..... 101/116, 101/118, 129, 229, 230, 231, 484
See application file for complete search history.

(56) References Cited

U.S. PATENT DOCUMENTS

| | | | | |
|---|---|---|---|---|
| 6,718,872 | B2 * | 4/2004 | Kanno | 101/118 |
| 7,188,564 | B2 * | 3/2007 | Ashikagaya | 101/118 |
| 7,284,479 | B2 * | 10/2007 | Sato | 101/118 |
| 7,331,284 | B2 * | 2/2008 | Takahashi | 101/118 |
| 7,617,770 | B2 * | 11/2009 | Ohdaira et al. | 101/118 |
| 2005/0076798 | A1 * | 4/2005 | Sato et al. | 101/116 |

FOREIGN PATENT DOCUMENTS

| | | | |
|---|---|---|---|
| JP | 6-48014 | | 2/1994 |
| JP | 6-71996 | | 3/1994 |
| JP | 7-81202 | | 3/1995 |
| JP | 8-118774 | | 5/1996 |
| JP | 9-95033 | | 4/1997 |
| JP | 10-129100 | | 5/1998 |
| JP | 2003-200645 | | 7/2003 |
| JP | 2003-266906 | | 9/2003 |
| JP | 2004-224479 | | 8/2004 |
| JP | 2005153179 | A * | 6/2005 |

* cited by examiner

*Primary Examiner*—Ren Yan
(74) *Attorney, Agent, or Firm*—Oblon, Spivak, McClelland, Maier & Neustadt, L.L.P.

(57) ABSTRACT

A double-sided printing apparatus using a double sided printing with one plate cylinder and one pressing means system, that is capable of carrying out double-sided printing simply and at low cost, with little deviation in the position of the printed image and with satisfactory resist. Printed matter with little deviation of the image position with respect to the sheet position and with good resist can be obtained, by eliminating delay in feeding sheets due to slippage between roller and press roller by operating the transport belt on the upstream side, and so on, and by eliminating resistance during sheet transportation due to contact with the guide member provided along the circumferential surface of the press roller, when pressing sheets against the press roller with a roller or the like, and transporting the sheets along the guide member or the like provided along the peripheral surface of the press roller. After the resist roller has eliminated the contact between the sheet and the stopper, the transport belt starts to be driven. If the printing speed is low, this timing is taken as the timing that the resist roller contacts the press roller. For both low speeds and high speeds, this may be after passage of a predetermined period of time from the operation command signal for the resist roller.

7 Claims, 16 Drawing Sheets

DOUBLE-SIDED STENCIL PRINTING APPARATUS

BACKGROUND OF THE INVENTION

1. Field of the Invention

The present invention relates to a double-sided printing apparatus, and more particularly to a double-sided printing apparatus including double-sided stencil printing apparatus.

2. Description of the Related Art

Technologies relating to the present invention are disclosed in the following:

[Prior Art 1] JP Laid-open Patent Publication No. H6-48014

[Prior Art 2] JP Laid-open Patent Publication No. H6-71996

[Prior Art 3] JP Laid-open Patent Publication No. H7-81202

[Prior Art 4] JP Laid-open Patent Publication No. H8-118774

[Prior Art 5] JP Laid-open Patent Publication No. H9-95033

[Prior Art 6] JP Laid-open Patent Publication No. H10-129100

[Prior Art 7] JP Laid-open Patent Publication No. 2003-200645

[Prior Art 8] JP Laid-open Patent Publication No. 2003-266906

[Prior Art 9] JP Laid-open Patent Publication No. 2004-224479

A commonly known example of a printer is a thermal digital double-sided stencil printing apparatus (hereafter simply referred to as a stencil printing apparatus). This printing method uses a stencil plate master (hereafter simply referred to as a "master"), which has a laminated structure formed from a thermoplastic resin film applied to a porous support member. The thickness of the thermoplastic resin film is normally between 1 to 2 μm. The porous support member is made from Japanese paper fibers, or synthetic fibers, or a mixture of Japanese paper fibers and synthetic fibers. The thermoplastic film surface of the master is thermally stenciled to form the master by contacting heating elements of a thermal head operated in the main scanning direction of the thermal head. The master that has been stenciled (hereafter sometimes referred to as a stenciled master) is transported in the sub scanning direction, which is normal to the main scanning direction, by master transport means such as platen rollers or the like, and wound around a porous cylindrical shaped rotatable plate cylinder. The plate cylinder is formed by winding a plurality of layers of resin or metal mesh screens. Ink is supplied to the stenciled master on the plate cylinder from an ink supply member within the plate cylinder. Using pressure means such as a press roller, pressure cylinder, or intermediate pressure roller (hereafter generically referred to as "press roller") the stenciled master on the plate cylinder is directly and continuously pressed against a sheet shaped recording medium such as for example print sheets (hereafter referred to simply as "sheets"). Printing is carried out by forcing ink through the perforations on the plate cylinder and the master, and transferring the ink to the sheets. Also, a stencil transfer printing apparatus is commonly known, in which ink forced from the perforations of the plate cylinder is temporarily transferred to a transfer cylinder having a rubber sheet, and then indirectly printed onto sheets (for example, see Prior Art 1).

Note that "plate cylinder" sometimes refers to a printing drum, or sometimes to the outer periphery of a printing drum. However, in this patent specification "plate cylinder" refers to the entire printing drum.

In recent years most stencil printing apparatus carry out double-sided printing on both the front and reverse sides of a sheet to reduce the consumption of sheets and storage space for documents, in addition to single-sided printing on one side of a sheet only. Conventionally the double-sided printing method and format uses the normal stencil printer apparatus that carries out single-sided printing as described above. Sheets stacked in the sheet supply unit are supplied to the printing unit, where printing is carried out on one side (the front side). The printed sheets are then discharged and stacked in the discharge tray. The sheets are then reversed, and again supplied to the printing unit, where printing is carried out on the remaining side (the reverse side), to obtain double-sided printing. In this double-sided printing method, the total printing time is very long because printing is carried out twice, and waiting time is necessary after completion of single-sided printing until the ink has dried on the front side, or, as it is referred to, until the front side has set. In addition the work of re-arranging the single-sided printed matter or re-setting the single-sided printed matter in the sheet supply unit was very labor intensive.

In order to improve this manual operation associated with the conventional double-sided printing method, there has been vigorous development of double-side printing apparatus that can automatically carry out double-sided printing, and several methods have been proposed for the format of the double-sided printing apparatus.

For example, in Japanese Patent Application Laid-open No. 2003-266906 (Prior Art 8 shown above), conventional double-sided printing apparatus is generally classified into six methods. In (1) the two drum in opposition one pass simultaneous double-sided printing method, two plate cylinders are provided in mutual opposition, and a sheet can be printed on both sides in one pass. In this method, the apparatus is large, and there is the restriction that when carrying out single-sided printing it is necessary to fit an unstenciled master to one plate cylinder to prevent transfer of ink from that cylinder. This results in wasteful consumption of masters, the work is troublesome, and other problem points (see for example, Prior Art 2).

The other remaining five types of double-sided printing method are: (2) the two pass double-sided printing method with stock re-supply after single-sided printing (see for example, Prior Art 3), (3) the single pass double-sided printing method with two drums in opposition and a transfer cylinder in between (see for example, Prior Art 4), (4) the double-sided printing method with a single drum sub-divided and simultaneous reversal (see for example, Prior Art 5), (5) the double-sided printing method with a single drum sub-divided printing and transfer drum (see for example, Prior Art 6).

Finally, although there are restrictions on sheet size and sheet type, (6) is a revolutionary single process double-sided printing apparatus that generally solves the problem points of (1) through (5) above, that is capable of single-sided printing without using masters unnecessarily, and is capable of providing high quality printed matter when double-sided printing. Further, the increase in installation space can be reduced. This adopts the double-sided format of (4) as the basic method (hereafter referred to as the "one drum one pressing means double-sided printing method" or the "one plate cylinder one pressing means double-sided printing method"). This is a new low cost double-sided printing apparatus that has been proposed to solve and provide measures against problem points such as soundness and reliability of sheet transport, and lack of adaptability to high speed printing (see for example, Prior Art 7 through 9).

This is a method of carrying out double-sided printing in which a single stenciled master wound around a single plate cylinder is divided into the master for printing the front side and for printing the reverse side, as shown in Prior Art 8. This format carries out double-sided printing by continuously pressing the unprinted side of sheets that have been printed on the front side (sheets that have been printed on one side) using one of the sub-divisions of the sub-divided master on the plate cylinder. This is accomplished by re-supplying sheets by clever use of sheet reversal and transport by the rotation of the single pressing means (in particular, a press roller having a diameter smaller than the external diameter of the plate cylinder).

In the double-sided printing apparatus disclosed in Prior Art 7 and elsewhere, for resist of reversed sheets that have been printed on one side and to correct skew, and so on, the front edge of a sheet is temporarily stopped by predetermined sheet re-supply stopping means (equivalent to the sheet re-supply position determination member in the prior art documents). Then the sheet is slightly moved and stopped by a sheet re-supply transport device (equivalent to the sheet re-supply transport member in the prior art documents) as sheet re-supply transport means. Then at a predetermined timing a sheet re-supply resist roller (equivalent to the sheet re-supply resist member in the prior art documents) as sheet re-supply resist means, provided in a stopper member positioning unit as sheet re-supply stopping means, operates and rotates. Then the sheet that is printed on the front side contacts the press roller, and is transported reversed to the printing unit by the rotation transport operation of the press roller, where double-sided printing is carried out.

The reversed sheet is temporarily stopped by the predetermined stopping means in order to carry out resist, correction of skew, and so on. Thereafter at a predetermined timing transport means transports the sheet to the printing unit again, where printing is carried out. However, after stopping the sheet is again suddenly transported at the linear speed of the drum, so there is variation in the position of the leading edge of the sheet when it arrives at the nip between the plate cylinder and the pressing means. This has the problem that there is variation in the resist after printing.

SUMMARY OF THE INVENTION

Therefore, it is an object of the present invention to provide a double-sided printing apparatus using the 1 plate cylinder 1 pressing means double sided printing format, that is capable of cheaply and simply carrying out double-sided printing, with little deviation in the position of the printed image and with good resist.

In an aspect of the present invention, a double-sided stencil printing apparatus has a plate making device that makes masters divided into front and rear surfaces along the direction of transport of a stencil blank sheet. The double-sided stencil printing apparatus comprises a transport device which transports the sheet, and which has a stopper that receives, comes into contact with, and holds the sheet printed on a first side, when printing on both sides by interchanging the front and rear sides of the sheet that is to be printed; and a stopper release mechanism for releasing the contact between the sheet and the stopper when printing a second side. The contact between the sheet and the stopper is released, and the sheet is re-supplied to the printing position with the front and rear of the sheet being reversed. The transport device is operated after the contact between the stopper and the sheet is released.

In another aspect of the present invention, a double-sided stencil printing apparatus has a plate making device that makes masters divided into front and rear surfaces along the direction of transport of a stencil blank sheet. The double-sided stencil printing apparatus comprises a press roller that is pressed against the interchanged front and rear sides of the sheet that is to be printed; a transport device that receives the sheet that has been printed on a first side and re-supplies the sheet to a printing position with the front and rear sides of the sheet being reversed, when printing on a second side; and a resist roller that brings the sheet into contact with the press roller when printing the second side. Start of feeding by the transport device is commenced in use of an operation command signal of the resist roller as a reference.

In another aspect of the present invention, a double-sided stencil printing apparatus has a plate making device that makes masters divided into front and rear surfaces along the direction of transport of a stencil blank sheet. The double-sided stencil printing apparatus comprises a press roller that is pressed against the interchanged front and rear sides of the sheet that is to be printed; a transport device that receives the sheet that has been printed on a first side and re-supplies the sheet to the printing position with the front and rear sides of the sheet being reversed, when printing on a second side; a resist roller that brings the sheet into contact with the press roller when printing the second side; and a detection device for detecting contact between the resist roller and the press roller. When a printing speed for which delay time in starting to drive the transport device can be ignored, start of feeding by the transport device is commenced after the detection of contact between the resist roller and the press roller by the detection device.

BRIEF DESCRIPTION OF THE DRAWINGS

The above and other objects, features, and advantages of the present invention will become more apparent from the following detailed description taken with the accompanying drawings in which.

DESCRIPTION OF THE PREFERRED EMBODIMENTS

Figure 1:
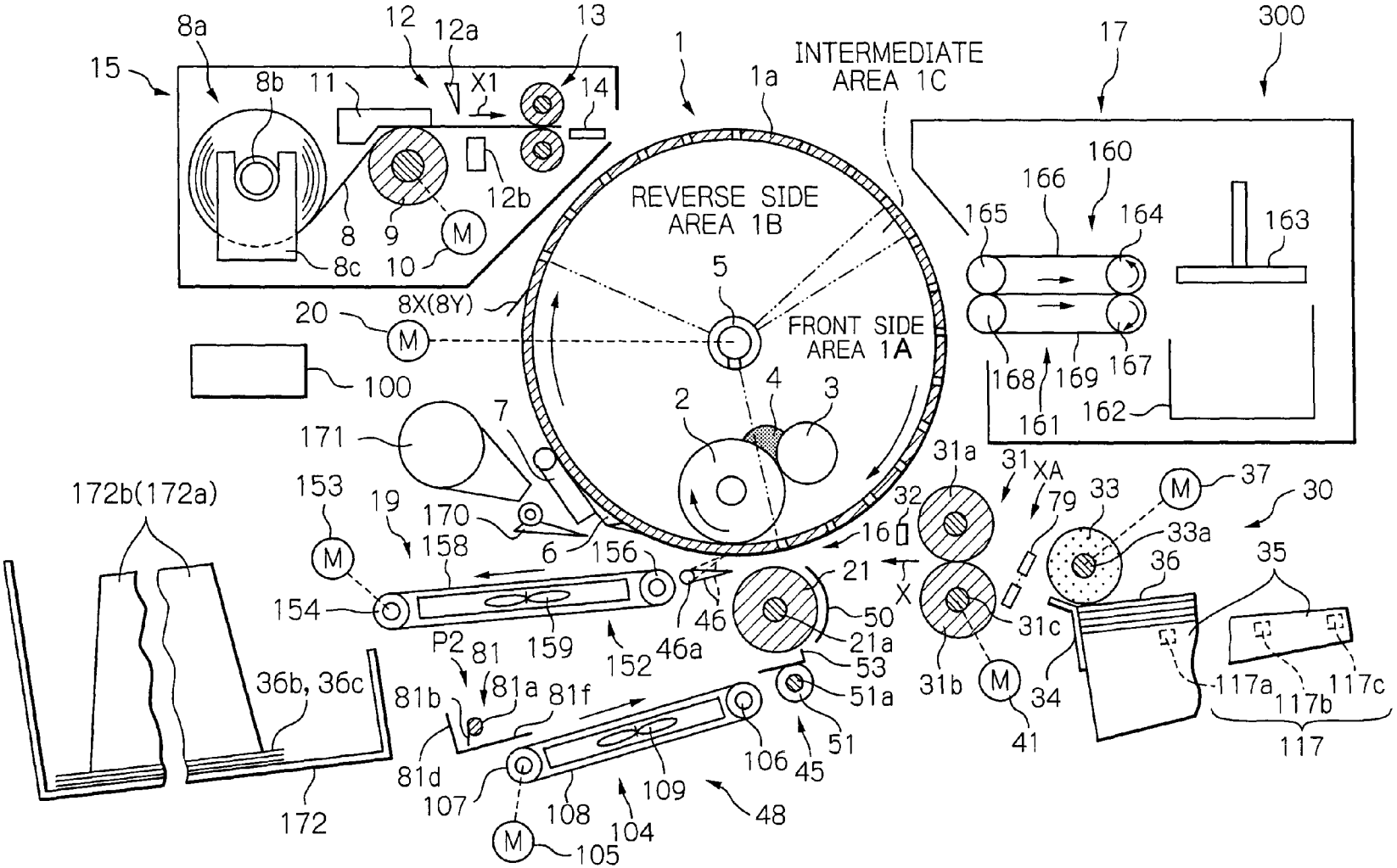
FIG. 1 is a partially sectioned front elevation of the main parts of a double-sided stencil printing apparatus showing a first embodiment according to the present invention.

The following is an explanation of the best mode for carrying out the present invention (hereafter referred to as the "embodiments"), with reference to the drawings. Throughout the embodiments and modifications, members and other constituent elements having the same function and shape, and so on, are given the same reference numeral. After explaining the member or element once, further repeated explanation is omitted. To simplify drawings and explanations, constituent elements that should be represented in drawings may be omitted as appropriate if there is no particular necessity to explain them. When constituent elements of a laid-open patent application are referenced and explained as they are, their reference numerals are put within parentheses, in order to distinguish them from those of each embodiment.

First Embodiment

First, the overall constitution of a double-sided stencil printing apparatus 300 as an example of a double-sided printing apparatus that applies a first embodiment of the present invention is explained, with reference to FIG. 1 and others.

Figure 12:
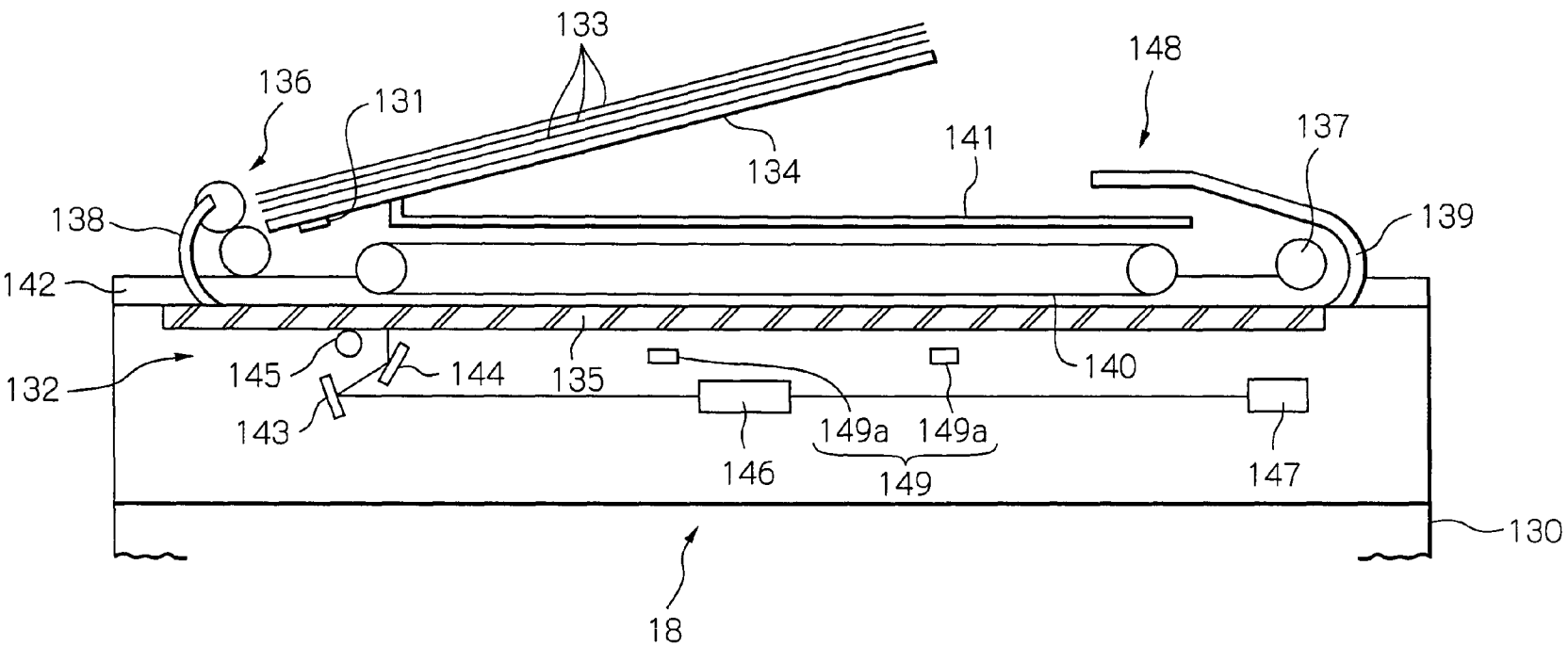
FIG. 12 is a front view of the main parts of the image reading unit of the double-sided stencil printing apparatus of FIG. 1.

Referring to FIG. 1 of the drawings, the double-sided stencil printing apparatus 300 includes a plate making unit 15, a printing unit 16, a plate discharge unit 17, a sheet supply unit 30, a sheet discharge unit 19, a main body frame 130, and an image reading unit 18. The plate making unit 15 makes plates from a master 8 (sometimes referred to as stencil blank sheets before stenciling. However, in this document it is referred to as a master both before and after plate making) wound in a roll shape, as shown in the top left of FIG. 1. The printing unit 16 includes a plate cylinder 1 around the outer periphery of which the stenciled master is wound, ink supply means, which is described later, which supplies ink to the stenciled master on the plate cylinder 1, a press roller 21 as pressing means that presses sheets 36 against the stenciled master on the plate cylinder 1 and which can freely contact and separate from the outer periphery of the plate cylinder 1, and other elements, as shown in the center of FIG. 1. The plate discharge unit 17 is disposed in opposition to the plate making unit 15 with the plate cylinder 1 sandwiched between the plate making unit 15 and the plate discharge unit 17. The plate discharge unit 17 separates and discharges used masters from the plate cylinder 1. The sheet supply unit 30 is disposed below the plate discharge unit 17, and supplies sheets 36 in a sheet supply tray 35 as sheet supply platform to the printing unit 16. The sheet discharge unit 19 is disposed in opposition to the sheet supply unit 30 and below the plate making unit 15. The sheet discharge unit 19 separates printed sheets 36 from the plate cylinder 1 and discharges the printed sheets 36 to a sheet discharge tray 172, which is a sheet discharge platform. The main body frame 130 is the body of the apparatus, within which the plate cylinder 1, the plate making unit 15, and the plate discharge unit 17 are disposed, as shown in FIG. 12. The image reading unit 18 is disposed on the top of the main body frame 130. The image reading unit 18 reads images of documents 133 transported from a document receiving platform 134, or reads images of documents, which are not shown on the drawings, loaded on a contact glass 135 as a reading unit.

Also, the double-sided stencil printing apparatus 300 includes a sheet re-supply unit 48, a switching guide 46, and so on. As described later regarding the printing unit 16, the sheet re-supply unit 48 temporarily holds sheets that have been printed on the front side. Then the sheet re-supply unit 48 transmits the sheets that have been printed on the front side towards the press roller 21 where the sheets are reversed and transmitted to the printing unit 16. The switching guide 46 guides sheets that have passed through the printing unit 16 (either sheets printed on the front side or sheets printed on both sides) to either the sheet re-supply unit 48 or the sheet discharge unit 19.

Figure 7:
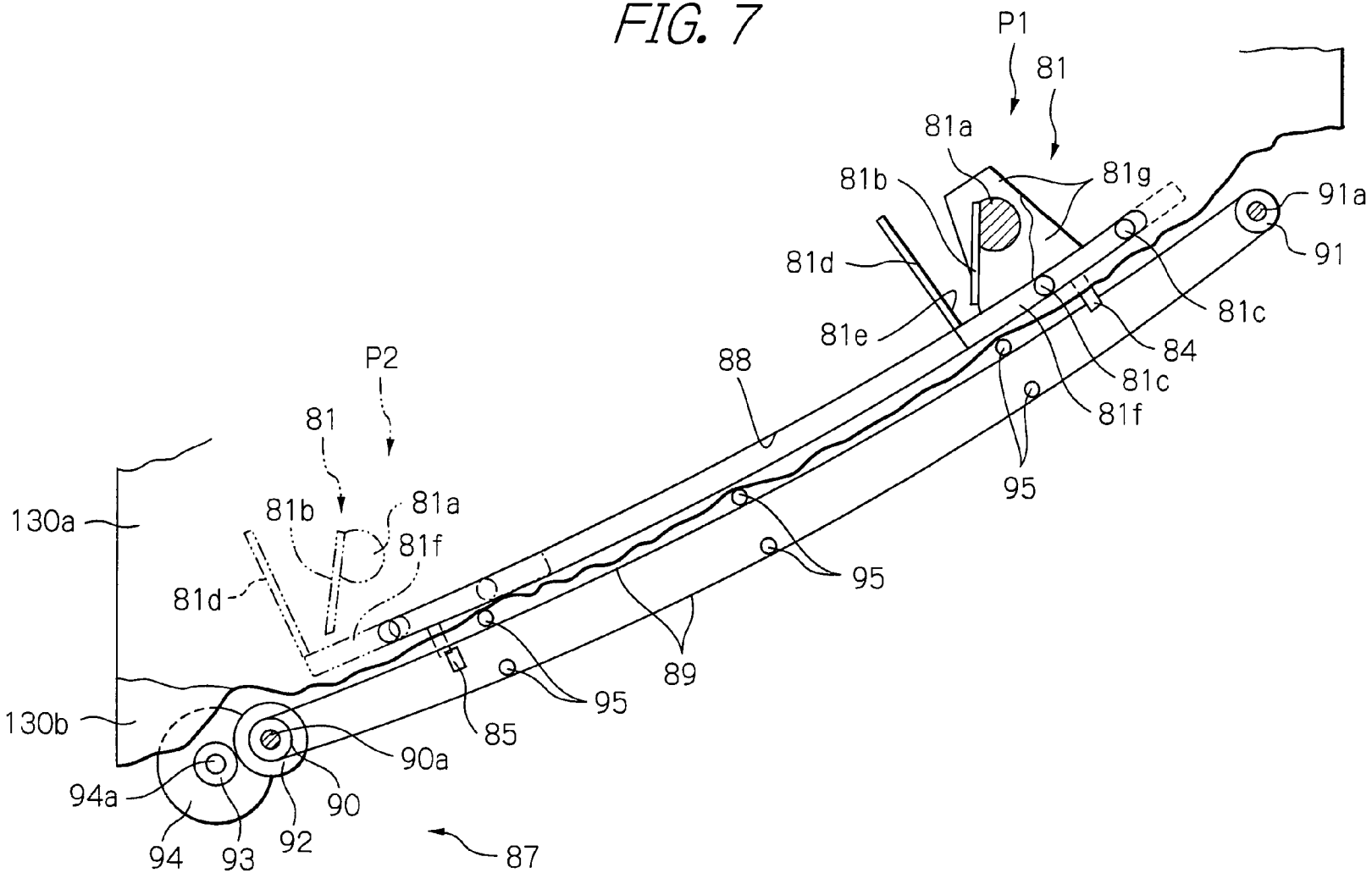
FIG. 7 is a partially sectioned front elevation around the movable guide and moving means in the double-sided stencil printing apparatus of FIG. 1.
Figure 8:
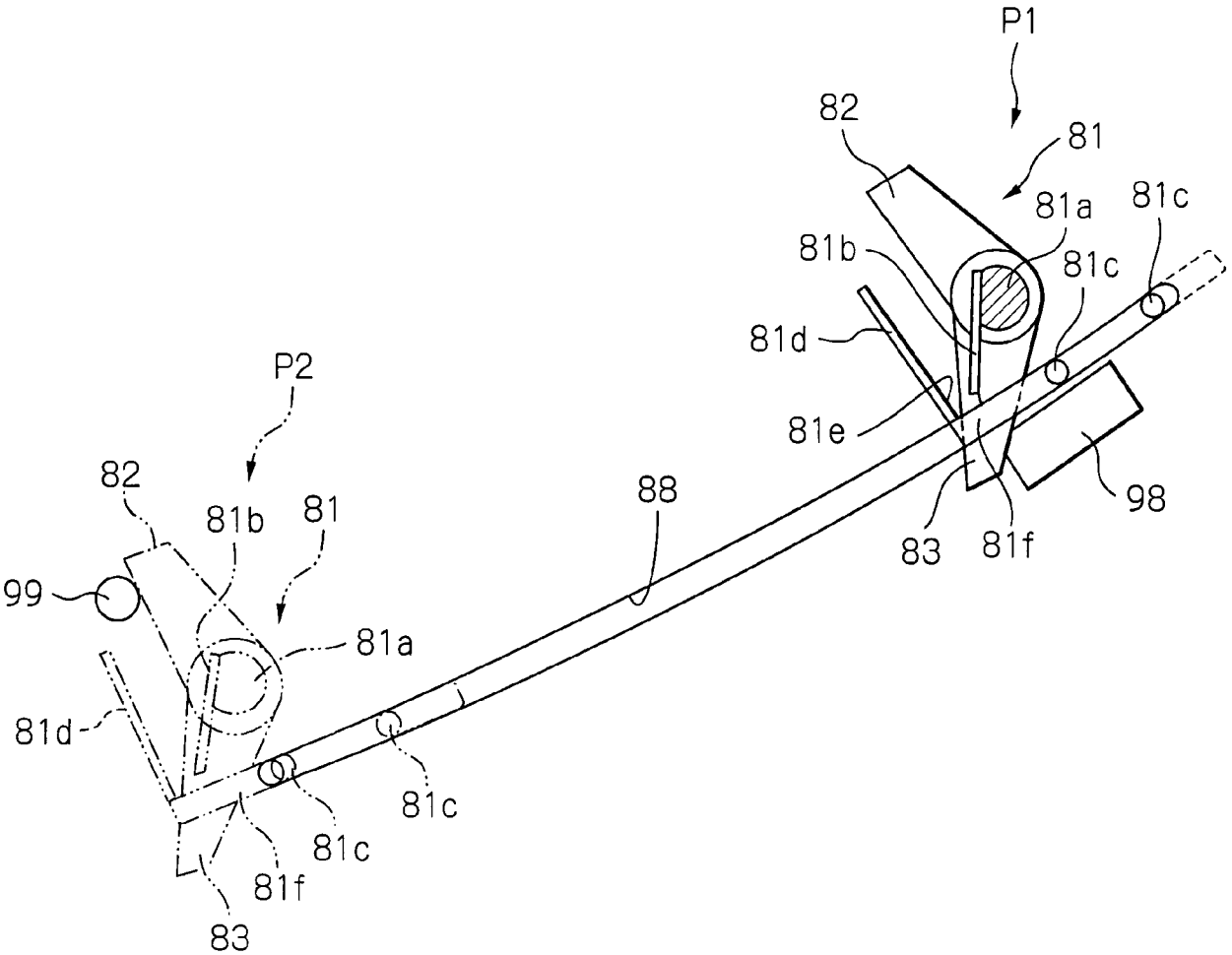
FIG. 8 is a partially sectioned front elevation around the movable guide, release cam, and release pin in the double-sided stencil printing apparatus of FIG. 1.

The sheet re-supply unit 48 includes a movable guide 81, moving means 87, a release cam 98 and a release pin 99, sheet re-supply means 45, and so on, as shown in FIGS. 1 through 8. The movable guide 81 as sheet holding means holds the leading edge portion which includes the leading edge (hereafter sometimes referred to as the "leading edge") of a sheet 36*a* that has been printed on the front side near the moving position P1 as the first position near the printing unit 16. At an initial position P2 (or standby position P2) as the second position near the upstream side of the sheet re-supply means 45 which is lower than the moving position P1, the movable guide 81 releases the leading edge of sheets 36*a* that have been printed on the front side. The moving means 87 reciprocates the movable guide 81 between the moving position P1 and the initial position P2, as shown in FIG. 7. As shown in FIG. 8, the release cam 98 and the release pin 99 constitute operation time control means. The release cam 98 and the release pin 99 operate the movable guide 81 to hold the leading edge of the sheets 36*a* that have been printed on the front side after temporarily releasing the movable guide 81 when the movable guide 81 is in the moving position P1. Also, the release cam 98 and the release pin 99 operate the movable guide 81 to release the leading edge of sheets that have been printed on the front side when the movable guide 81 is in the initial position P2. As shown in FIGS. 1 through 6, the sheet re-supply means 45 temporarily holds sheets that have been printed on the front side that have been received from the movable guide 81, then transmits the sheets that have been printed on the front side to the press roller 21, the sheets are reversed at the press roller 21 and transmitted to the printing unit 16.

The double-sided stencil printing apparatus 300 includes a single ink supply means, the single plate cylinder 1, and the single press roller 21. As stated later, the single plate cylinder single pressing means double-sided printing method is adopted, that is capable of printing on both sides of a sheet by a single rotation of the plate cylinder 1. The double-sided stencil printing apparatus 300 includes the plate making unit 15, the printing unit 16, the plate discharge unit 17, the sheet supply unit 30, the sheet discharge unit 19, the image reading unit 18, the sheet re-supply means 45 in the sheet re-supply unit 48, the movable guide 81, the moving means 87, the operation time control means, and the switching guide 46 as devices that are described later.

Figure 9:
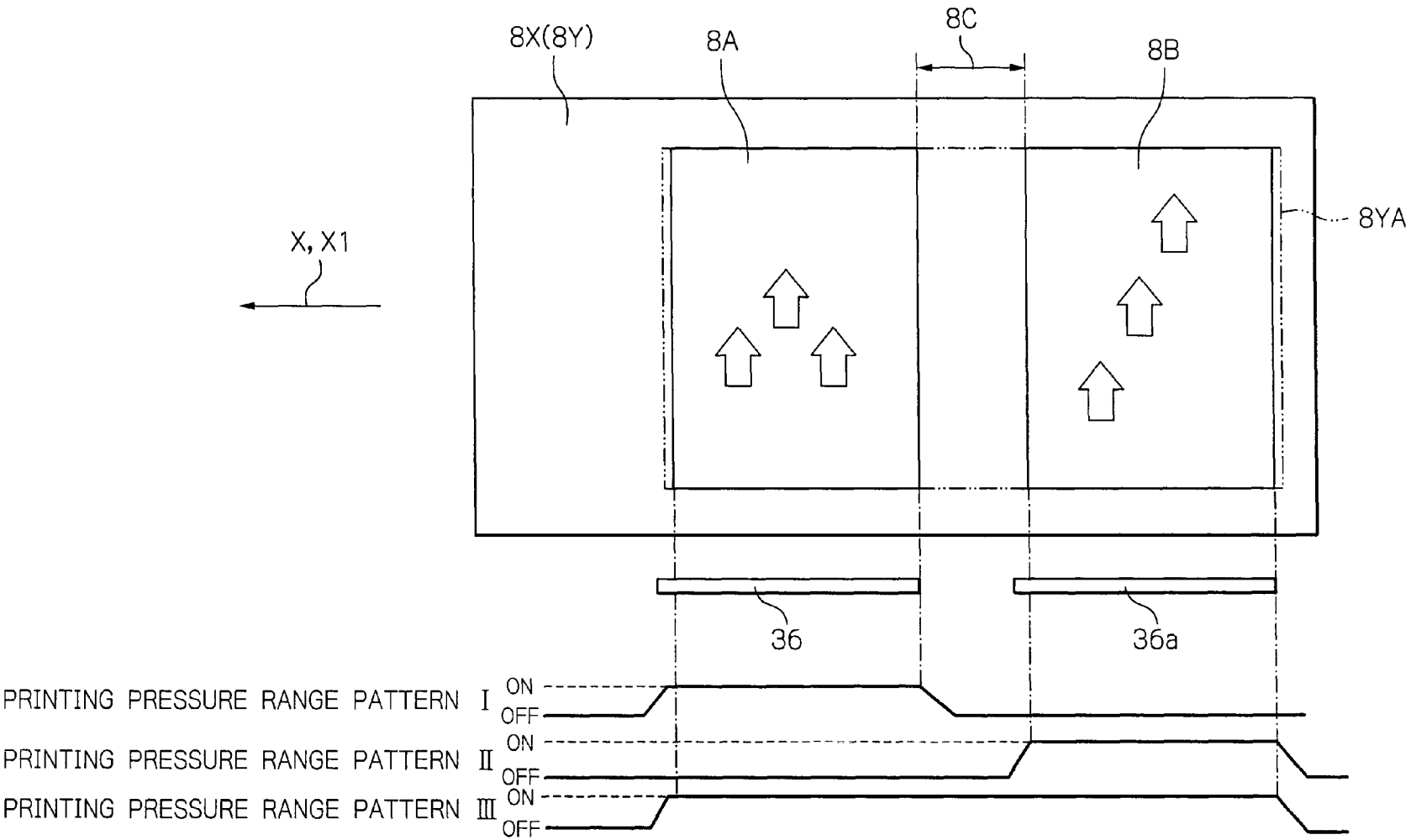
FIG. 9 is a diagram to explain the expansion of the three printing pressure range patterns applied corresponding to a dub-divided stenciled master on the plate cylinder used in the double-sided stencil printing apparatus of FIG. 1.

The plate making unit 15 has the function and constitution to make masters 8. As shown in FIG. 9, the plate making unit 15 can make stenciled masters 8X for double-sided printing (hereafter also referred to as "sub-divided stenciled master 8X") and stenciled masters 8Y for single-sided printing. The stenciled masters 8X for double-sided printing include a first stenciled image 8A (hereafter also referred to as "front side stenciled image 8A") for printing on the front side, and a second stenciled image 8B (hereafter also referred to as "reverse side stenciled image 8B") for printing on the reverse side, along the rotation direction of the plate cylinder 1 (which is the same as the sheet transport direction X, or the master transport direction X1). The stenciled master 8Y for single-sided printing has a third stenciled image 8YA (hereafter also referred to as the "single-sided stenciled image 8YA") having the image area of the front side stenciled image 8A and the reverse side stenciled image 8B along the rotation direction of the plate cylinder 1, as shown in FIG. 9. When the sub-divided stenciled master 8X is wound around the external surface of the plate cylinder 1, the front side stenciled image 8A forms the position corresponding to the front side area 1A shown in FIG. 1. Also, the reverse side stenciled image 8B forms the position corresponding to the reverse side area 1B shown in FIG. 1.

In FIGS. 1 and 9, the stenciled master 8Y is shown within parentheses, to distinguish it from the sub-divided stenciled master 8X. In FIG. 9, the extent of the area of the single-sided stenciled image 8YA formed on the stenciled masters 8Y is indicated with a dotted line. The boundary line of this area in the direction of transport of the master X1 overlaps with those of the front side stenciled image 8A and the reverse side stenciled image 8B. Therefore, in FIG. 9 the area of the single-sided stenciled image 8YA has been shown slightly larger. However, the extent of the area of the single-sided stenciled image 8YA is the total of the front side stenciled image 8A, the reverse side stenciled image 8B, and an intermediate unstenciled area 8C that is the unstenciled blank area located between the front side stenciled image 8A and reverse side stenciled image 8B.

The plate making unit 15 includes a master support member 8*c* that can support the master 8 so that it can be fed out in the master transport direction X1; a thermal head 11 that thermally stencils the fed out master 8 in accordance with image information; a platen roller 9 that presses the master 8 against the thermal head 11 while rotating to transport the master 8 towards the downstream side in the master transport direction X1; a pair of transport rollers 13 that further transports the master 8 transported by the platen roller 9 towards the downstream side in the master transport direction X1 while applying a suitable tension force to the master 8; a cutter 12 disposed between the platen roller 9 and the pair of transport rollers 13, that cuts the stenciled master 8 or unstenciled master 8 to a predetermined length; a master guide plate 14 that guides the leading edge of the master 8 transported by the platen roller 9 and the pair of transport rollers 13 to an open clamper 7 on the plate cylinder 1, and so on.

The master 8 is formed from a master roll 8*a* wound around a roll core 8*b*. The master roll 8*a* is supported at both ends of the roll core 8*b* by the master support member 8*c*, so that the master roll 8*a* can freely rotate in the counterclockwise direction, and the master roll 8*a* can be freely inserted into and removed from the master support member 8*c*. The master support member 8*c* at both sides is installed in and fixed to a pair of plate making side plates, that are not shown in the drawings, that are disposed to the left and right along the direction of transport of the master in the plate making unit 15. Therefore, the master 8 is supported by the master support member 8*c* so that it can be fed from the master roll 8*a* in the direction of transport of the master X1.

The master 8 has a laminated structure in which thermoplastic resin film of thickness 1 to 5 μm, for example, is applied to a porous support layer made from synthetic fibers or the like. The master is not limited to this, but may be made from thermoplastic resin film applied to a porous support layer made from Japanese paper fibers, or a mixture of Japanese paper fibers and synthetic fibers, or the like, or a master made substantially from thermoplastic resin film only may be used.

The thermal head 11 is provided extending parallel to the axis of the platen roller 9 from the near side to the far side relative to the plane of the paper in FIG. 1 (this direction is referred to as the main scanning direction). The thermal head 11 can contact or separate from the platen roller 9 via the master 8, using a contact and separation mechanism provided with a cam and spring member, which is not shown in the drawings. The thermal head 11 is pressed towards the platen roller 9 by the spring member. A plurality of heating elements (not shown in the drawings) is disposed in the main scanning direction of the thermal head 11 in the part that contacts the platen roller 9 via the master 8. The thermal head 11 has the commonly known function as plate making means of selectively thermally stenciling the master 8 by selectively heating the heating elements based on digital image signals transmitted from an A/D conversion unit and image signal processing unit, neither of which is shown on the drawings, and processed in a plate making control device and thermal head drive circuit (neither of which is shown in the drawings).

The platen roller 9 is formed integrally with the platen roller shaft. The platen roller 9 is rotatably supported at the two ends of the platen roller shaft by the pair of plate making side plates. The platen roller 9 is connected to a master transport motor 10 via a rotation transmission member (which is not shown in the drawings) such as a timing belt or gear or the like. The platen roller 9 is driven to rotate in the clockwise direction by the master transport motor 10. The master transport motor 10 is for example a stepping motor. With this configuration, the master 8 is drawn out from the master roll 8*a* by the platen roller 9 being driven by the master transport motor 10 to rotate in the clockwise direction.

The pair of transport rollers 13 is provided mutually pressing towards each other with a suitable pressing force by impelling means such as a spring or the like. Each roller shaft is rotatably supported at both ends by the pair of plate making side plates, so that the pair of transport rollers 13 freely rotate in mutually opposite directions. The pair of transport rollers 13 is set to rotate with a circumferential speed (transport speed) that is slightly faster than the circumferential speed (transport speed) of the platen roller 9 by a rotation transmission member that includes the master transport motor 10. In this way, with slippage between the pair of transport rollers 13 and the master 8, a suitable front tension is applied to the master 8.

The cutter 12 is a commonly known guillotine type having a fixed blade 12*b* and a movable blade 12*a*. The cutter 12 is not limited to the guillotine type, and a rotating blade moving type in which a movable blade moves while rotating across the width direction of the master at right angles to the master transport direction X1 may be used.

The plate making unit 15 includes constituent elements that are included in plate supply means that is capable of delivering the stenciled master 8 to and wrapping it around the plate cylinder 1. The plate supply means includes the platen roller 9, the pair of transport rollers 13, and the master guide plate 14 of the plate making unit 15, and the clamper 7 of a plate cylinder, which is described later, an opening and closing device as opening and closing means that is not shown on the drawings and that opens and closes the clamper 7, a main motor 20 that drives the rotation of the plate cylinder 1, and so on, on the plate cylinder 1 which is described later.

Figure 14:
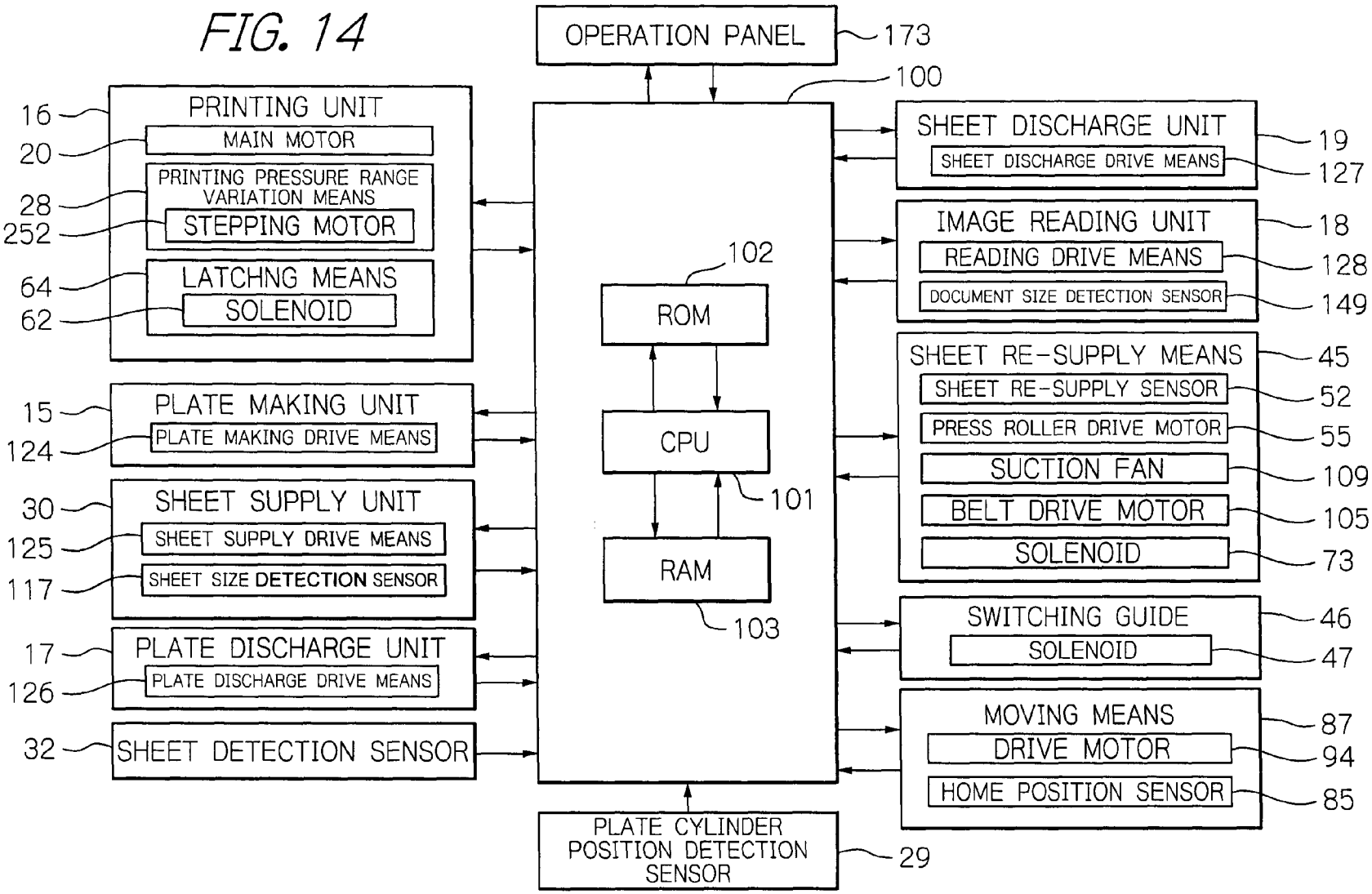
FIG. 14 is a block diagram showing the main parts of the control configuration of the double-sided stencil printing apparatus of FIG. 1.

In the plate making unit 15 shown in FIG. 14, drive means subject to control of the plate making unit 15, including the thermal head 11 that is driven by a thermal head drive circuit (not shown in the drawings) and the master transport motor 10, are collectively included as a plate making drive means 124.

The plate cylinder 1 has a two layer structure made from a porous cylindrical shaped support cylinder, and several layers of resin or metal mesh screen (not shown in the drawings) wound around and covering the outer periphery of the support cylinder. The plate cylinder 1 includes a porous portion 1*a* with many holes through which ink can pass where printing is possible (hereafter also referred to as the "image forming area"), and a non-porous area where the clamper 7 and so on are provided and where printing is not possible (hereafter also referred to as the "non-image forming area") formed along the direction of rotation of the plate cylinder 1 indicated by the arrow in FIG. 1. The image forming area includes at least a first image area 1A (hereafter referred to as the front side area 1A) in the plate cylinder in FIG. 1, an intermediate area 1C, and a second image area (hereafter referred to as the reverse side area 1B).

The plate cylinder 1 is wound around and fixed to end plate flanges, which are not shown in the drawings, and is rotatably supported around an ink pipe that combines with a support shaft 5, which is described later. The size of the plate cylinder 1 is sufficient to obtain an A3 size printed document, for example, in an implementation example if when printing single-sided a maximum A3 size sheet 36 is printed. In other words, the size is such that a single A3 size master 8 can be wound, so the outer diameter is set to 180 mm (giving a perimeter of the plate cylinder 1 of about 565 mm), and the dimension in the width direction (the direction of the axis of the center of rotation) is set to 350 mm.

The plate cylinder 1 is connected to the main motor 20 by a gear or belt or another drive transmission means as plate cylinder drive means. For example, the plate cylinder 1 is driven to rotate in the direction of the arrow in FIG. 1 (the clockwise direction) by the main motor 20 that can be for example a control DC motor. An optical rotary encoder (which is not shown on the drawings) and a plate cylinder sensor (not shown on the drawings) clamped to the optical rotary encoder that generates a pulse by cooperative action with the rotary encoder are provided on the output shaft of the main motor 20. The plate cylinder sensor is a transmission type optical sensor that includes a light emitting unit and a light receiving unit (hereafter simply referred to as "transmission type optical sensor"). The plate cylinder sensor is used for controlling the rotation speed (printing speed) and for determining the rotational position of the plate cylinder 1.

An ink roller 2, a doctor roller 3, and the ink pipe 5 are disposed within the plate cylinder 1. The ink roller 2 is rotatably supported by the side plates that are not shown in the drawings. The ink roller 2 is driven to rotate in the direction of the arrow in FIG. 1 (the clockwise direction) in synchronization with the rotation of the plate cylinder 1 by rotational drive power transmitted from the main motor 20 by drive transmission means such as a gear or the like, which is not shown in the drawings. The doctor roller 3 is disposed parallel to the ink roller 2 with a small gap between the doctor roller 3 and the ink roller 2. An ink pool 4 forms in the wedge-shaped cross-section between the doctor roller 3 and the ink roller 2. The ink pipe 5 supplies ink to the ink pool 4. The ink roller 2, the doctor roller 3, and the ink pipe 5 constitute the single ink supply means that supplies ink to sub-divided stenciled masters 8X or stenciled masters 8Y on the plate cylinder 1.

The ink in the ink pool 4 is supplied from an ink pack or the like, which is not shown in the drawings, provided outside the plate cylinder 1. The ink is drawn in by an ink pump, which is not shown on the drawings, and supplied and mixed from a supply hole in the ink pipe 5. The ink in the ink pool 4 is supplied as a thin film on the outer peripheral surface of the ink roller 2, and measured by the doctor roller 2. Further, the ink is supplied to the porous portion 1*a* of the plate cylinder 1 by contact of the outer peripheral surface of the ink roller 2 with the inner peripheral surface of the support cylinder of the plate cylinder 1.

A stage 6 and the clamper 7 are provided in part of the non-porous outer peripheral surface of the plate cylinder. The stage 6 is made from strong magnetic material and is provided along one generating line of the plate cylinder 1. The clamper 7 has a rubber magnet that can open and close with respect to a plane portion of the stage 6, and is rotatably installed on a clamper shaft provided at both ends of the stage 6. The clamper 7 is opened and closed at a predetermined location by an opening and closing device (not shown on the drawings) provided on the main body frame. The plate cylinder 1 stops with the clamper 7 in virtually the topmost position shown in FIG. 1, in other words, in the plate supply standby position. The plate cylinder 1 together with an ink pack installation stand (not shown on the drawings) on which the ink pack can be freely inserted and removed, the ink pump, and other elements constitute an integral plate cylinder unit. The plate cylinder unit can be inserted into and removed from the main body frame of the double-sided stencil printing apparatus 300 in the direction of the axis of the ink pipe 5.

Figure 10:
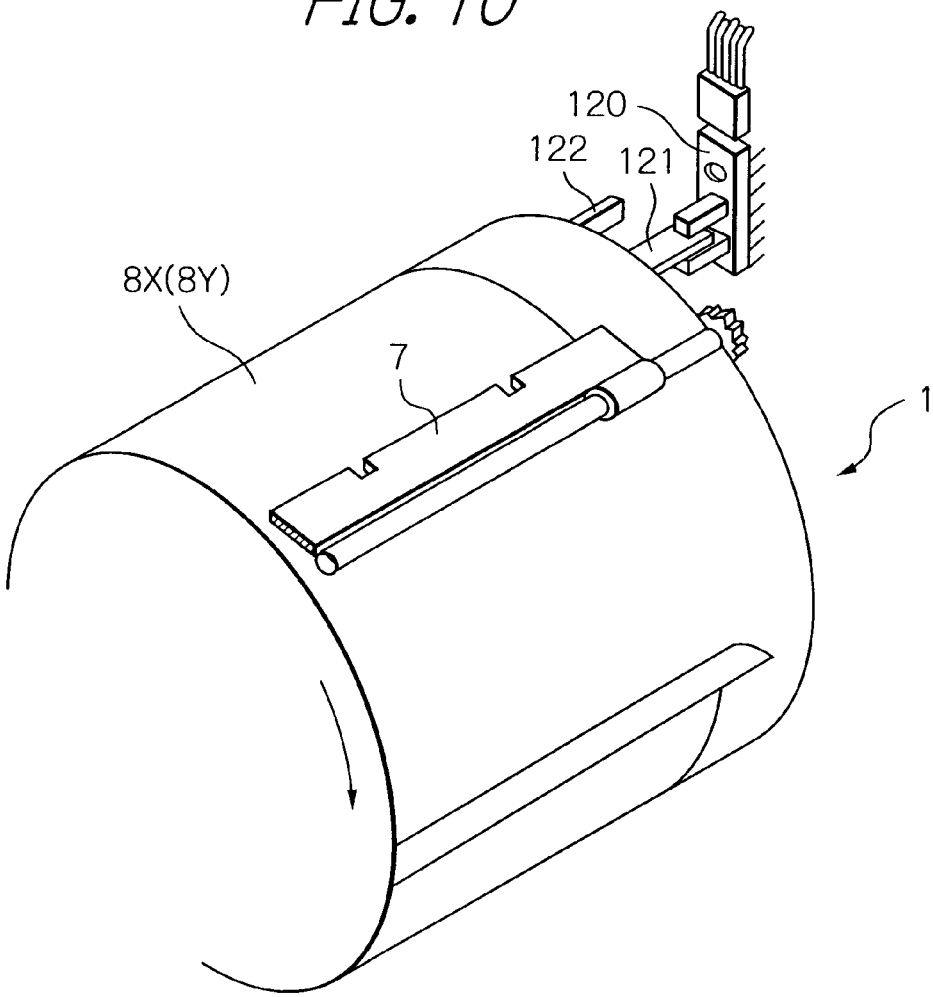
FIG. 10 is an isometric view showing an example of the layout of the sheet supply start light shield plate and the resist start light shield plate on the end plate of the plate cylinder used in the double-sided stencil printing apparatus of FIG. 1.
Figure 11:
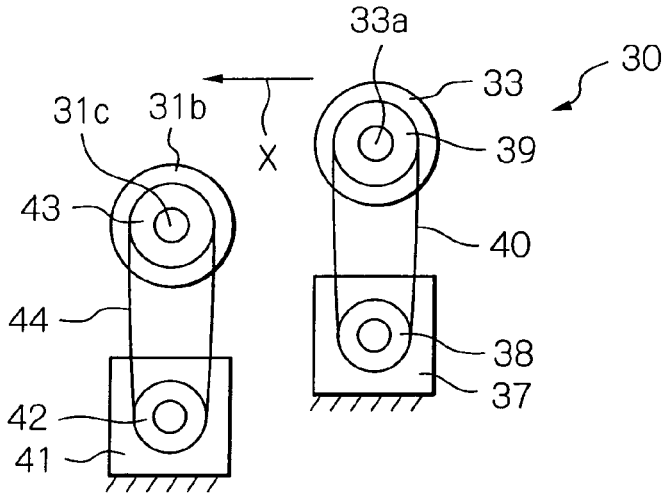
FIG. 11 is a front view of showing the main parts of the drive mechanism of the sheet supply roller of the sheet supply unit and the resist roller in the double-sided stencil printing apparatus of FIG. 1.

Elements that provide start up and trigger information to a sheet supply motor 37 and a resist motor 41 in the sheet supply unit 30 by detecting the rotation position of the plate cylinder 1, as shown in FIGS. 1 and 11, are disposed on the end plate flange of the plate cylinder 1 on the far side relative to the plane of the paper in FIG. 1 and on the body frame near this end plate flange, as shown in FIG. 10. In other words, a sheet supply start light shield plate 121 and a resist start light shield plate 122 are installed on the external wall of the end plate flange on the far side of the plate cylinder 1, on the same circumference and at a predetermined distance apart and in predetermined positions.

On the other hand, a sheet supply resist sensor 120 is installed on the side of the main body frame near the light shield plates 121, 122, in opposition to the circumference on the plate cylinder 1 on which the sheet supply start light shield plate 121 and the resist start light shield plate 122 are installed, so as to sandwich the light shield plates 121, 122. The sheet supply resist sensor 120 is a transmission type optical sensor.

In the present embodiment, the home position (initial position) of the plate cylinder 1 is with the clamper 7 in virtually the topmost position. This position is set to be the same position as the plate supply standby position in which sub-divided stenciled masters 8X or stenciled masters 8Y transported from the plate making unit 15 are received and held. A home position light shield plate, which is not shown on the drawings, is installed at a predetermined position on the external wall of the end plate flange on the far side of the plate cylinder 1, in order to detect the home position of the plate cylinder 1. A home position sensor (not shown on the drawings) is installed on the side of the main body frame near the home position light shield plate, in opposition to and sandwiching the home position light shield plate on the plate cylinder 1. The home position sensor is a transmission type optical sensor.

In FIG. 14, the plate cylinder sensor, the sheet supply resist sensor 120, and the home position sensor are given the collective name plate cylinder position detection sensor 29, as plate cylinder position detection means that detects the rotational position of the plate cylinder 1.

Figure 2:
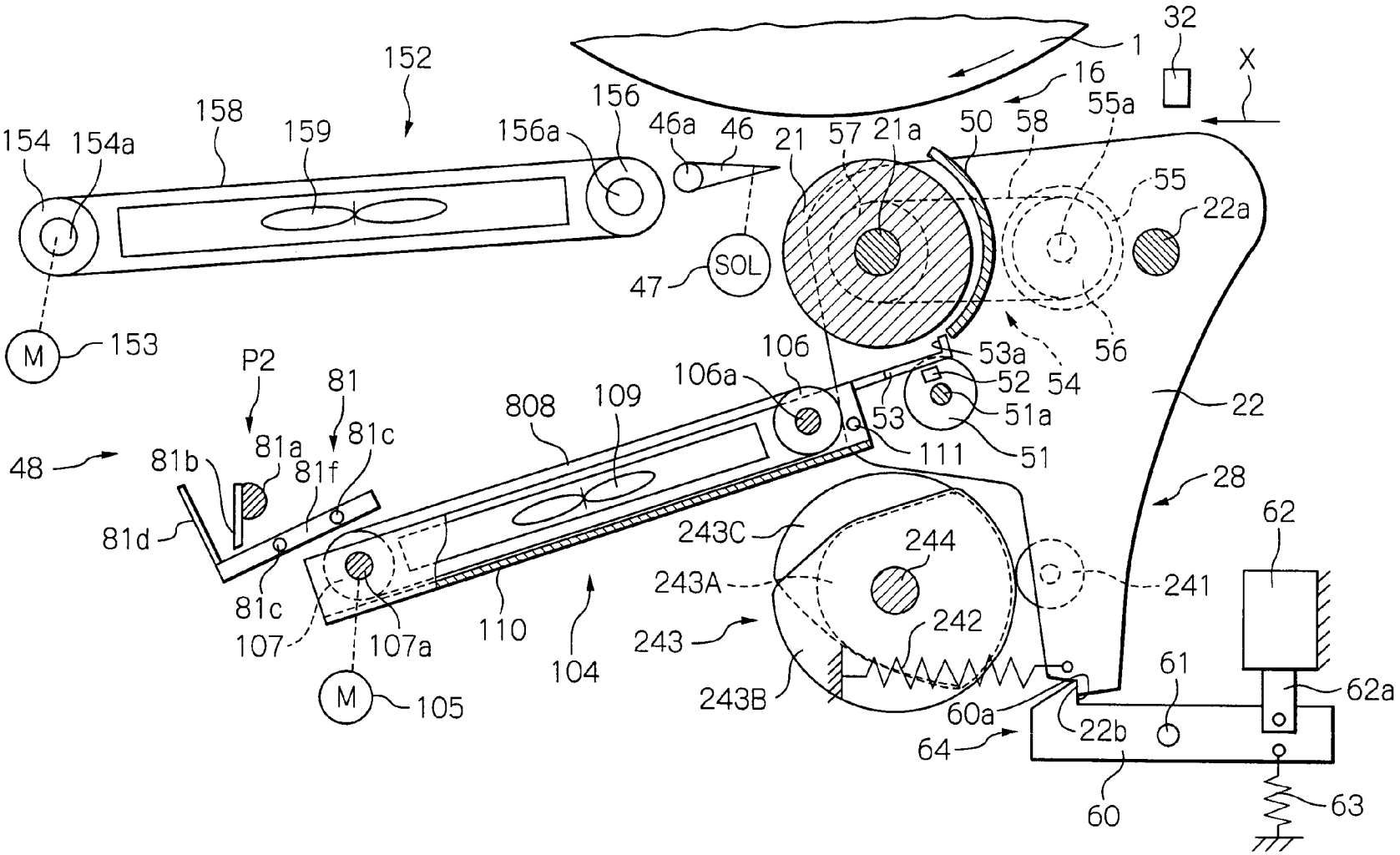
FIG. 2 is a partially sectioned front elevation showing enlarged the configuration and operation around the printing unit, the sheet re-supply unit, and the printing pressure range variation means, in the double-sided stencil printing apparatus of FIG. 1.
Figure 3:
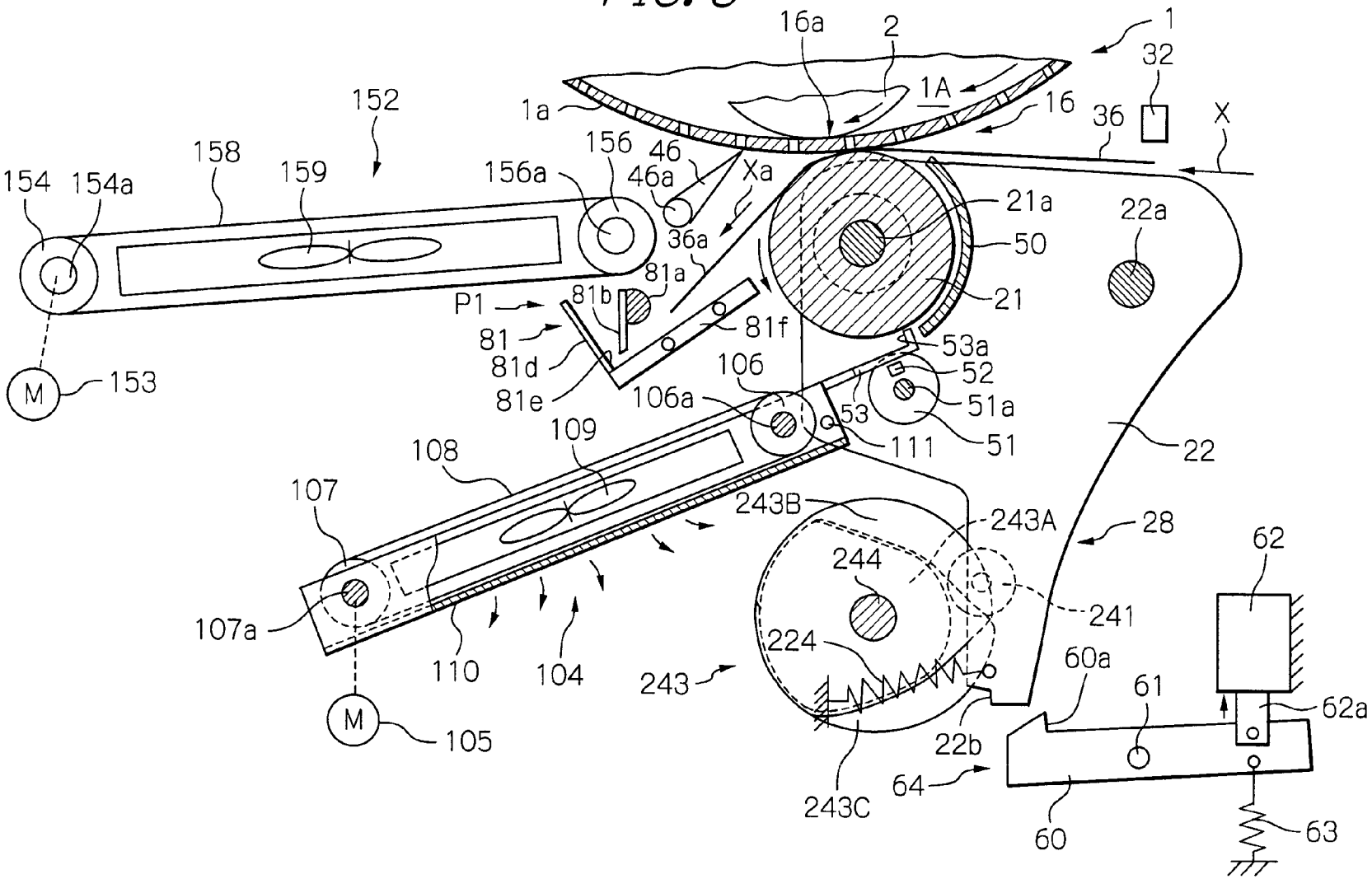
FIG. 3 is a partially sectioned front elevation showing enlarged the configuration and front surface printing operation around the printing unit, the sheet re-supply unit, and the printing pressure range variation means, in the double-sided stencil printing apparatus of FIG. 1.
Figure 4:
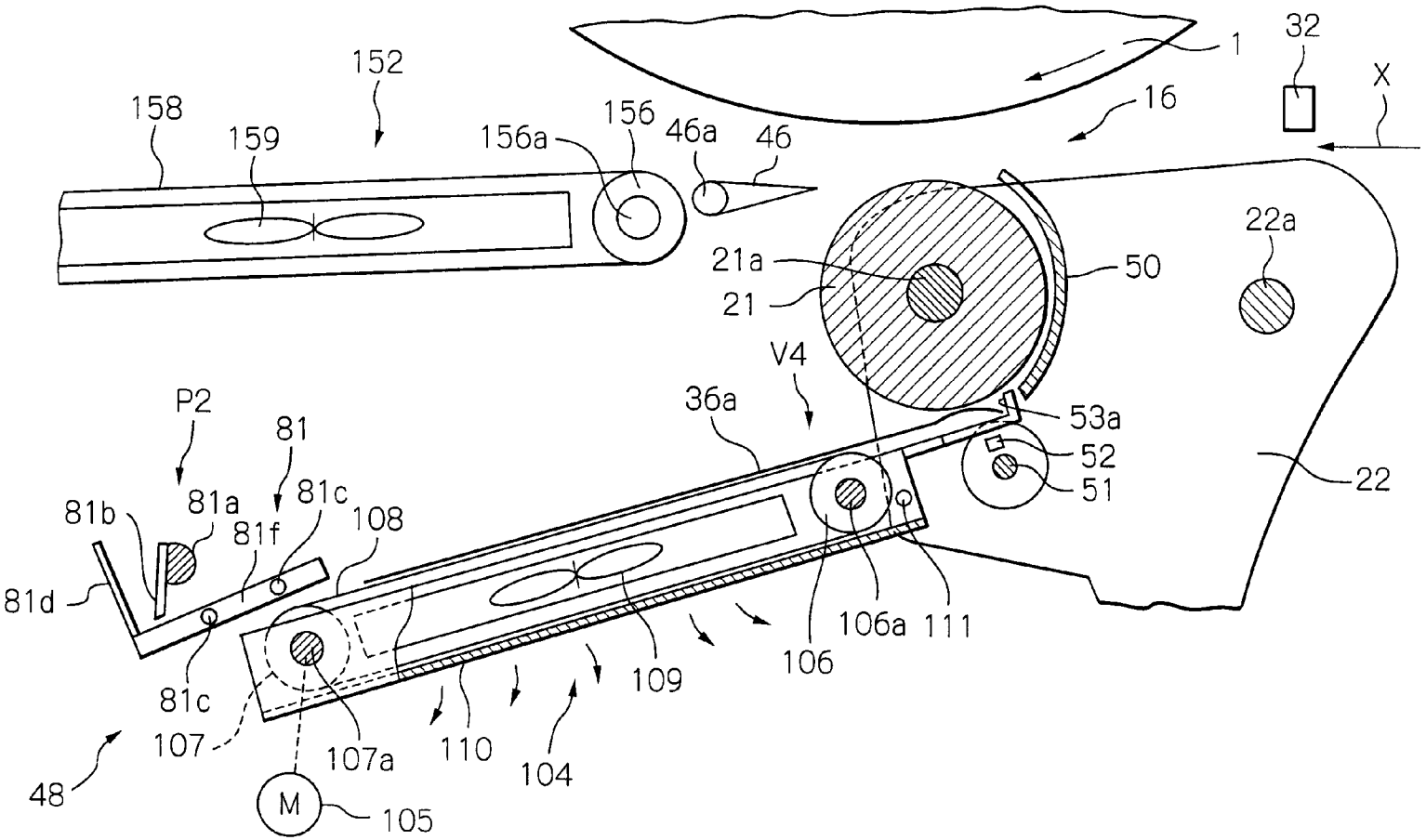
FIG. 4 is a partially sectioned front elevation showing enlarged the configuration around the printing unit and the sheet re-supply unit, and showing the status of the operation in which the leading edge of a sheet printed on the front side contacts the stopper member, in the double-sided stencil printing apparatus of FIG. 1.

The single press roller 21 is disposed in opposition to the ink roller 2 near the bottom of the outer peripheral surface of the plate cylinder 1. The press roller 21 includes an elastic body integrally fixed to a press roller shaft 21*a*, and is provided extending in the axial direction of the plate cylinder 1. The press roller 21 is formed to have virtually the same transverse width as the transverse width of the plate cylinder 1. As shown in FIGS. 2 through 4, the press roller 21 is rotatably supported by a pair of printing pressure arms 22 via the two ends of the press roller shaft 21*a*. The pair of printing pressure arms 22 as printing pressure means support members is disposed in the near side and the far side relative to the plane of the paper (the printing pressure arm 22 on the near side of the plane of the paper is omitted in the drawings).

The size of the plate cylinder 1 is shown in the drawings as exaggeratedly large compared with the press roller 21. For the embodiment, as disclosed for example in Prior Art 7, in order make it easier for the circumferential speed of the press roller 21 to be the same as that of the plate cylinder 1, it is preferable that the ratio of the diameter of the press roller 21 to the diameter of the plate cylinder 1 be 1:2 or 1:3. Naturally, if this advantage is not necessary, a press roller 21 with a length in the circumferential direction that is longer than the length in the circumferential direction of the front side area 1A or the reverse side area 1B on the outer peripheral surface of the plate cylinder 1 may be used.

Each printing pressure arm 22 on the near side and the far side relative to the plane of the paper has virtually the same shape and the same phase. Each of the printing pressure arms 22 is made integral by an arm shaft 22*a* installed and fixed in a position near a bend in the printing pressure arms 22, and a connection reinforcing member, which is not shown in the drawings. At the bottom end of the printing pressure arm 22 shown in the drawings, a notch 22*b* is formed that selectively latches with a latching claw 60*a* in a latching member 60 that is described later. The arm shaft 22*a* is supported so that it can freely rotate through a predetermined angle between a pair of body side plates, which are not shown in the drawings, provided in the sides of the main body frame (see the pair of body side plates 130*a*, 130*b* in FIG. 7) via bearings (not shown in the drawings).

The press roller 21 is formed from an elastic material having resistance to oil, for example nitrile rubber (NBR). The outer peripheral surface of the rubber at least is uniformly covered with glass beads as a film that has been surface processed to give fine irregularities, similar to the glass fine particles used in offset printing machines, in order to prevent dirt on the printed matter. However, this film is not limited to glass particles, ceramic particles may also be used. In this way, when there is contact with the outer peripheral surface of the plate cylinder 1 or the sub-divided stenciled master 8X or the stenciled master 8Y on the plate cylinder 1, or when there is contact with the ink on the printed image side of a sheet 36*a* that has been printed on the front side as described later with reference to FIG. 4, swelling and contamination with ink can be kept to a minimum.

Figure 5:
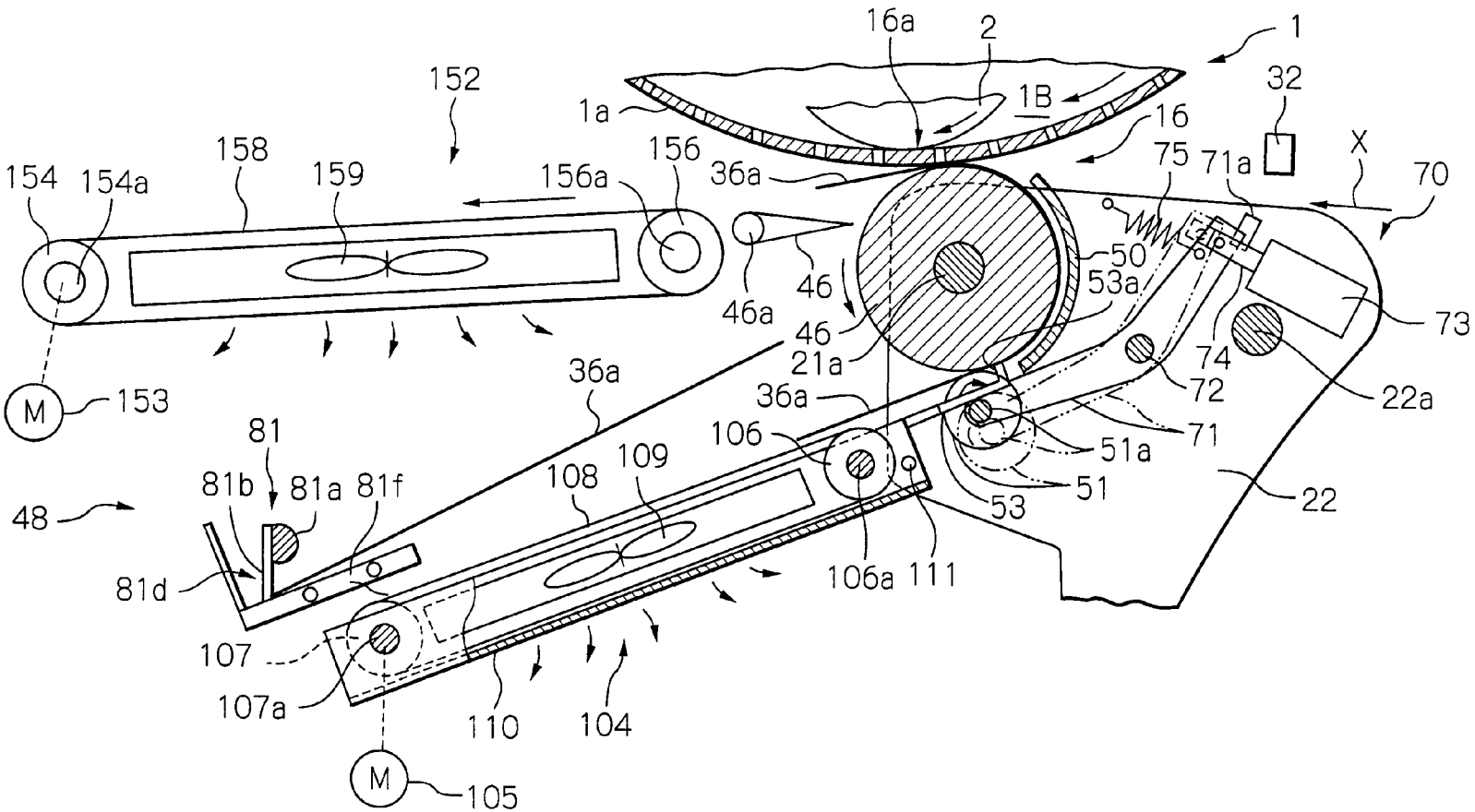
FIG. 5 is a partially sectioned front elevation showing enlarged the configuration around the printing unit and the sheet re-supply unit, and showing the operation of transporting a sheet printed on the front side in parallel with the double-sided printing operation, in the double-sided stencil printing apparatus of FIG. 1.
Figure 6:
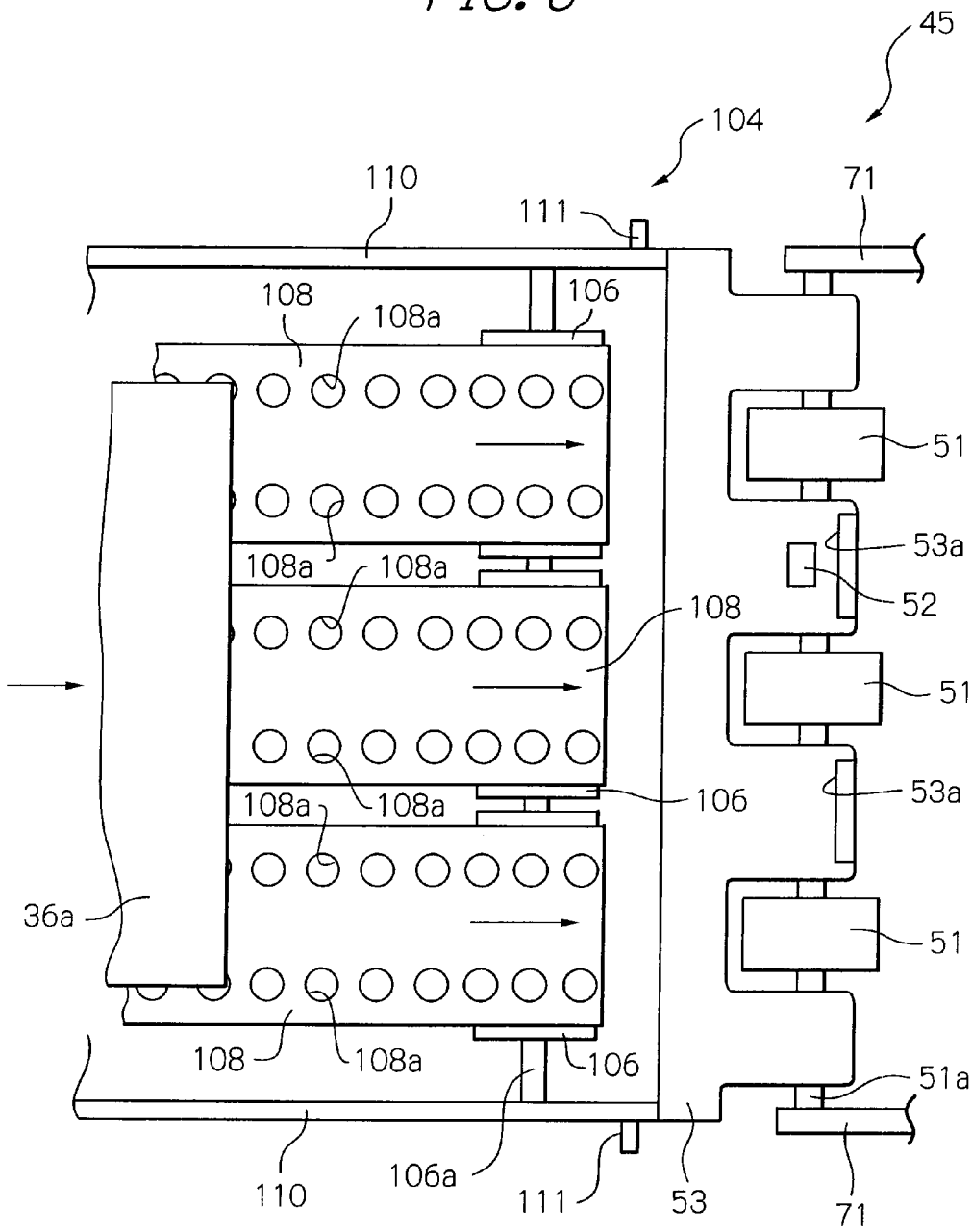
FIG. 6 is a top surface view of the sheet re-supply means (sheet re-supply transport device, stopper member, sheet re-supply resist roller) in FIG. 4, viewed from the V4 direction.

The press roller 21 can be freely displaced via printing pressure range variation means 28, latching means 64, and each printing pressure arm 22, as shown in FIGS. 2 to 4, between a printing position and a non-printing position. The printing position is the position in which unprinted sheets 36 or sheets 36*a* that have been printed on the front side are pressed against the sub-divided stenciled master 8X or the stenciled master 8Y on the plate cylinder 1, as shown in FIGS. 3 and 5. The non-printing position is the position separated from the printing position shown in FIGS. 1 and 2, and includes the initial position. As stated previously, the pair of printing pressure arms 22 rotatably support the press roller 21 as pressing means. Also, the press roller 21 is constituted so as to be capable of contacting and being separated from the plate cylinder 1. The printing pressure range variation means 28 is also referred to as the press roller contact and separation mechanism as pressing means contact and separation means.

In FIG. 2, reference numeral 54 indicates a press roller rotation drive means as pressing means drive means that drives the rotation of the press roller 21. The press roller rotation drive means 54 mainly includes a press roller drive motor 55 and drive power transmission means. The press roller drive motor 55 as drive means drives the press roller 21 to rotate at virtually the same circumferential speed of the plate cylinder and in the opposite direction (in the counter-clockwise direction) to the rotation direction of the plate cylinder 1. The drive power transmission means transmits the rotational drive power of the press roller drive motor 55 to the press roller 21. The press roller drive motor 55 is installed and fixed to the outside wall of the printing pressure arm 22 on the far side relative to the plane of the paper in FIG. 2.

As shown in FIG. 2, the drive power transmission means includes a drive pulley 56, a driven pulley 57, and an endless belt 58. The drive pulley 56 has teeth and is fixed to the output shaft 55*a* of the press roller drive motor 55. The driven pulley 57 has teeth and is fixed to the press roller shaft 21*a* projected further than the printing pressure arm 22 to the far side relative to the plane of the paper. The endless belt 58 has teeth and is wound between the drive pulley 56 and the driven pulley 57.

The press roller 21 is rotated by the press roller drive motor 55 at appropriate timing to press unprinted sheets 36, sheets 36*a* that have been printed on the front side, or sheets 36*c* that have been printed on one side against a sub-divided stenciled master 8X, or a stenciled master 8Y on the plate cylinder 1. The operation of the press roller 55 is controlled by a control device 100 shown in FIG. 14. The rotational speed of the press roller drive motor 55 is controlled so that via the drive power transmission means the circumferential speed of the press roller 21 is virtually the same as the circumferential speed of the plate cylinder 1, as stated above. According to the example of the present embodiment, the press roller 21 is rotated by the press roller drive motor 55 at a circumferential speed that is virtually the same as the circumferential speed of the plate cylinder 1. Therefore, it is possible to obtain good printed matter with no deviation in printed image position.

As shown in FIGS. 1 through 6, besides the press roller 21, members which form part of the sheet re-supply means 45 include a sheet re-supply transport device 104, sheet re-supply resist contact and separation means 70 which is only shown in FIG. 5, a stopper member 53, a roller guide plate 50, and so on, which are disposed between the printing pressure arms 22.

The sheet re-supply means 45 mainly includes the sheet re-supply transport device 104, the stopper member 53, a sheet re-supply resist roller 51, the sheet re-supply resist contact and separation means 70, and the roller guide plate 50. The sheet re-supply transport device 104 as sheet re-supply transport means is capable of stopping and starting at predetermined times, by temporarily holding sheets 36*a* on which a printed image has been formed on the front side in the printing unit 16, and transporting it to the press roller 21 via the stopper member 53. The stopper member 53 as sheet re-supply stopping means temporarily stops the leading edge (the "trailing edge" with respect to the sheet transport direction X. However, this is the "leading edge" or "front edge" with respect to the direction of transport of the sheet 36*a* that has been printed on the front side. Therefore it has been referred to as the "leading edge") of a sheet 36*a* that has been printed on the front side and that has been transported by the sheet re-supply transport device 104 in order to determine the position. The sheet re-supply resist roller 51 as sheet re-supply resist means can freely be displaced between a contact position and a non-contact position that is separated from the contact position. The contact position is the position in which the leading edge of the sheet 36*a* that has been printed on the front side and is temporarily stopped by the stopper member 53 is released at predetermined timing, and the leading edge of the sheet 36*a* that has been printed on the front side is brought into contact the press roller 21. The non-contact position is separated from the contact position. The sheet re-supply resist contact and separation means 70 displaces the sheet re-supply resist roller 51 between the contact position and the non-contact position. The roller guide plate 50 is provided near the outer peripheral surface of the press roller 21 on the right hand side of the press roller 21. The roller guide plate 50 as sheet re-supply guidance means guides sheets 36*a* that have been printed on the front side and that have been brought into contact with the outer peripheral surface of the press roller 21 by the sheet re-supply resist roller 51 towards a nip portion 16*a* formed in the printing unit 16.

The sheet re-supply transport device 104, as shown in FIGS. 1 to 6, is disposed extending below the trajectory of reciprocation of the movable guide 81 and to the left of the sheet re-supply resist roller 51. The sheet re-supply transport device 104 mainly includes a sheet re-supply frame 110, a rear transport roller 107, a front transport roller 106, a plurality of transport belts 108, a belt drive motor 105, and a suction fan 109, as shown in FIGS. 2 through 6. The sheet re-supply frame 110 rotatably supports a drive shaft 107*a* and a driven shaft 106*a*. The rear transport roller 107 is a drive roller integral with the drive shaft 107*a*. The front transport roller 106 is a driven roller integral with the driven shaft 106, disposed near the sheet re-supply resist roller 51 on the upstream side of the sheet transport direction X relative to the drive shaft 107*a*. The plurality of transport belts 108 is a plurality of endless belts wound around and tensioned between the rear transport roller 107 and the front transport roller 106, and contains a plurality of holes 108*a* for air suction. The plurality of transport belts 108 holds and transports sheets 36*a* that have been printed on the front side that have been received from the movable guide 81. The belt drive motor 105 as belt drive means is connected to the drive shaft 107*a* via drive power transmission means such as a gear or the like, and drives the rotation of the transport belts 108 by driving the rear transport roller 107. The suction fan 109 attracts and holds sheets 36*a* that have been printed on the front side received from the movable guide 81 onto the top surface of the transport belts 81 by drawing air through the plurality of holes 108*a*. For convenience of drawing, the distance between the sheet re-supply resist roller 51 and the front transport roller 106 has been shown as reasonably separated. However, it should be noted that they are disposed close to each other.

The sheet re-supply frame 110 is open on its top surface, and its width is formed slightly smaller than the distance between the two printing pressure arms 22. The side cross-section is formed in a channel shape. A plurality of holes or slits is formed in the bottom surface wall of the sheet re-supply frame 110 to permit the downward flow of air due to the suction fan 109. The sheet re-supply frame 110 has bearings which are not shown on the drawings at both side surfaces in the upstream and downstream sides of the direction of transport of sheets. These bearings rotatably support the drive shaft 107*a* and the driven shaft 106*a*. The drive shaft 107*a* penetrates both side surfaces of the sheet re-supply frame 110 at the two end portions of the drive shaft 107*a*, and the two ends of the drive shaft 107*a* are rotatably supported by bearing members that are not shown in the drawings.

A drive gear that is not shown in the drawings is installed on one end of the drive shaft 107*a* (the far side of the plane of the paper in FIGS. 2 through 5). The drive shaft 107*a* is driven by the belt drive motor 105 via the drive gear. The transport belts 108 are driven to rotate intermittently at special timing in accordance with the type of sheet as explained later, by the belt drive motor 105 based on command signals from the control device 100 shown in FIG. 14. The belt drive motor 105 is for example a stepping motor, and is provided fixed to the side of the main body frame. The driven shaft 106*a* does not penetrate the two side surfaces of the sheet re-supply frame 110 at the two ends of the driven shaft 106*a*.

Pins 111 are fixed projecting to the outside from the two side walls of the sheet re-supply frame 110 at the upstream end in the direction of transport of sheets X. Each pin 111 is loosely fitted into holes, which are not shown on the drawings, formed in each printing pressure arm 22. In this way, when the press roller 21 is brought into contact with and separated from the plate cylinder 1 by the printing pressure range variation means 28 which is described later, the sheet re-supply frame 110 of the sheet re-supply device 104 can swivel at the end where the pins 111 are disposed about the drive shaft 107*a* as center, to accompany the swiveling motion of the printing pressure arms 22.

The rear transport roller 107 and the front transport roller 106 are formed from sub-divided rollers formed like on skewers and provided with teeth, for example, and made from high friction material. Incidentally, preferably the rear transport roller 107 and the front transport roller 106 are formed from high friction material such as nitrile rubber (NBR) or a suitable resin, or the like, having resistance to oil (resistant to ink corrosion). The transport belt 108 is for example formed from a plurality of belts with teeth, that are separate from each other and wound around and tensioned between the rear transport roller 107 and the front transport roller 106. Incidentally, preferably the transport belt 108 is formed from an elastic material with resistance to oil (resistant to ink corrosion) such as for example nitrile rubber (NBR).

The suction fan 109 includes a fan drive motor as fan drive means to rotate the suction fan 109 so that sheets 36*a* that are printed on the front side received from the movable guide 81 are held on the top surface of the transport belts 108 by drawing in air from the plurality of holes 108*a* in the transport belts 108. In the following the suction fan drive motor is simply referred to as the "suction fan 109".

The stopper member 53 has the function of temporarily stopping the leading edge of sheets 36*a* that have been printed on the front side at a position where they can be passed over to the press roller 21, and determining the position of the leading edge of the sheets 36*a* that have been printed on the front side and correcting skew, and so on. The stopper member 53 is made from sheet metal or a suitable resin, for example, with a cross-section formed in an L-shape. The stopper member 53 includes a stopper surface 53*a* to which the leading edges of sheets 36*a* that have been printed on the front side butt, to determine the position. The stopper member 53 is formed with a plurality of notched openings so that when the sheet re-supply resist roller 51, which is made from a plurality of roller-shaped members, is displaced to contact the press roller 21, the stopper member 53 does not contact the sheet re-supply resist roller 51. The stopper member 53 is fixed to the sheet re-supply frame 110 at the left hand end in FIG. 2. In this way, the stopper member 53 swivels together with both the sheet re-supply transport device 104 and the press roller 21. The stopper member 53 can also be provided separate from the sheet re-supply transport device 104.

The sheet re-supply transport means and the sheet re-supply stopping means are not limited to the sheet re-supply transport device 104 and the stopper member 53 according to the present embodiment. For example, as disclosed in FIGS. 1 through 4 and elsewhere in Prior Art 8 and Prior Art 9, a sheet re-supply position determination member (24) in which a sheet re-supply transport unit (25) and an auxiliary tray (8) are integrally installed may be used.

As shown in FIGS. 2 through 4 and FIG. 6, a sheet re-supply sensor 52 is disposed at the upstream end in the direction of transport of sheets X in the stopper member 53. The sheet re-supply sensor 52 is sheet printed on the front side detection means which detects when a sheet 36*a* that has been printed on the front side is in contact with the stopper member 53. The sheet re-supply sensor 52 is a reflection type optical sensor that has the function of detecting the leading edge (the right hand edge in FIG. 4 of the sheet 36*a* that has been printed on the front side) and the trailing edge (the left hand edge in FIG. 4 of the sheet 36*a* that has been printed on the front side) of sheets 36*a* that have been printed on the front side.

As shown in FIG. 5, the sheet re-supply resist contact and separation means 70 mainly includes a support shaft 72, a pair of swivel arms 71, a solenoid 73, and a tension spring 75, and functions as stopper release means. The sheet re-supply resist roller 51 is an elastic body formed in a roller shape, made from a high friction material having oil resistance (resistant to ink corrosion), for example a nitrile rubber (NBR), sub-divided and integral with a shaft 51*a*, like on a skewer. The sheet re-supply resist roller 51 is rotatably installed at both ends of the shaft 51*a* on a first end of each swivel arm 71, which is formed in an approximate "A" shape. The sheet re-supply resist roller 51 normally occupies a non-contacting position below the press roller 21 and the stopper member 53. Each swivel arm 71 is fixed at its bend portion to the support shaft 72 which is rotatably supported between the printing pressure arms 22. In this way, when the sheet re-supply resist roller 51 occupies the contact position, contact between the sheet 36*a* and the stopper member 53 is released. The rotation power of the press roller 21 acts on the sheet re-supply resist roller 51 so that the sheet re-supply resist roller 51 follows by rotating in the opposite direction (the clockwise direction) to the direction of rotation of the press roller 21 (the counterclockwise direction).

A second end of the swivel arm 71 on the far side relative to the plane of the paper in the drawing is connected to a plunger 74 of the solenoid 73. The solenoid 73 is a pull type solenoid, that is installed and fixed to one printing pressure arm 22 via a fixing member such as a bracket, which is not shown in the drawing. Also, the tension spring 75 is fixed at one end to one printing pressure arm 22 and is fixed at the other end to the second end of the swivel arm 71. The tension spring 75 pulls the swivel arm 71 about the support shaft 72 so that the sheet re-supply resist roller 51 normally occupies the non-contact position. The solenoid 73 has the function as sheet re-supply resist drive means of displacing the sheet re-supply resist roller 51 at predetermined timing so that it occupies the contact position.

According to the configure described above, when the solenoid 73 operates against the resistance of the force of the tension spring 75 (ON operation), the outer peripheral surface of the sheet re-supply resist roller 51 occupies the contact position where it contacts the outer peripheral surface of the press roller 21 at a predetermined pressure. In this way, the sheet 36*a* that has been printed on the front side contacts the outer peripheral surface of the press roller 21 at a predetermined time. Then, under the rotational power of the press roller 21, the sheet re-supply resist roller 51 follows the rotation of the press roller 21 by rotating in the clockwise direction opposite to the direction of rotation of the press roller 21, and assists transport of the sheet 36*a* that has been printed on the front side. When the operation of the solenoid 73 is released (OFF operation) the outer peripheral surface of the sheet re-supply resist roller 51 is separated by the force of the tension spring 75 from the outer peripheral surface of the press roller 21 and occupies the non-contact position.

The roller guide plate 50 has the function of guiding sheets 36*a* that have been printed on the front side that are transported by the rotational power of the press roller 21 towards the plate cylinder 1 while maintaining contact with the outer peripheral surface of the press roller 21. The roller guide plate 50 is formed in a partial cylindrical shape curved about a press roller shaft 21*a* as center. The roller guide plate 50 is fixed between the two printing pressure arms 22, with a predetermined gap with the outer peripheral surface of the press roller 21. In this way the roller guide plate 50 guides the sheets 36*a* that have been printed on the front side along the outer peripheral surface of the press roller 21. The surface of the side of the roller guide plate 50 that guides the sheets 36*a* that have been printed on the front side is smoothly coated with a film that has a low coefficient of friction with respect to the sheets 36*a* that have been printed on the front side, and that is resistant to ink and oil, such as a poly-tetrafluoroethylene resin or similar.

In FIG. 14, the drive means subject to control of the sheet re-supply means 45 includes the press roller drive motor 55, the solenoid 73, the belt drive motor 105, the suction fan 109, and so on. The sheet re-supply means 45 includes the sheet re-supply sensor 52 and so on, as means for detecting several parameters.

Next, the configuration around the printing pressure range variation means 28 that determines the printing pressure range of the press roller 21 is simply explained. As shown in FIGS. 1 and 9, in the present embodiment it is possible to selectively switch to one of at least three printing pressure range patterns: printing pressure range pattern I, printing pressure range pattern II, and printing pressure range pattern III. The printing pressure range pattern I is the first printing pressure range pattern, in which printing pressure is applied only to the front side area 1A which corresponds to the front side stenciled image 8A on the sub-divided stenciled master 8X on the plate cylinder 1. The printing pressure range pattern II is the second printing pressure range pattern, in which printing pressure is applied only to the reverse side area 1B which corresponds to the reverse side stenciled image 8B on the sub-divided stenciled master 8X on the plate cylinder 1. The printing pressure range pattern III is the third printing pressure range pattern, in which printing pressure is applied from the front side stenciled image 8A to the reverse side area 1B which corresponds to the single-sided stenciled image 8YA on the stenciled master 8Y on the plate cylinder 1. A part of the structure of the printing pressure range variation means 28 that selectively switches to one among these three printing pressure range patterns is shown in FIGS. 2 and 3. The printing pressure range variation means 28 has the configuration and function to displace the press roller 21 between the printing position and the non-printing position.

The printing pressure range variation means 28 has a similar configuration to the press roller contact and separation mechanism (55) shown in FIGS. 2 through 4 of Prior Art 7, which includes a stepping motor (52) that drives the rotation of a multi-stage cam (43) and a step cam (49), and so on. Incidentally, a part of the printing pressure range variation means 28 is shown in FIGS. 2 and 3 with reference numerals obtained by adding "200" to the reference numerals of the constituent elements of the press roller contact and separation mechanism (55), such as the multi-stage cam (43), the step cam (49), the stepping motor (52). The printing pressure range variation means 28 includes the arm shaft 22*a*, the pair of printing pressure arms 22, a pair of cam followers 241, a pair of printing pressure springs 242, a printing pressure cam shaft 244, a pair of multi-stage cams 243, and so on. A stepping motor 252 is only shown in the printing pressure range variation means 28 shown in FIGS. 14 and 15.

As shown in FIGS. 2 and 3, each of the constituent elements of the printing pressure range variation means 28 are disposed in both the near side and the far side of the press roller 21 relative to the plane of the paper shown in FIG. 1 (the elements on the near side of the plane of the paper are omitted). This is so that a uniform pressure force is applied from the press roller 21 to the outer peripheral surface of the plate cylinder 1. Therefore, the explanation of the constituent elements on the far side is taken to be representative, and the explanation for the elements on the near side is omitted. If the advantage referred to above is not required in the printing pressure range variation means 28, then the constituent elements constituting the printing pressure range variation means 28 may be provided, for example, only on the far side as shown in FIGS. 1 through 4.

As shown in FIGS. 2 and 3, the cam follower 241 is rotatably supported on a shaft on the outside of the far side wall in the center of the printing pressure arm 22 that opposes on the inner side of the printing pressure arm 22 that supports the press roller 21. The cam follower 241 is a rolling bearing capable of contacting the multi-stage cam 243 with low frictional resistance.

One end of a printing pressure spring 242 (tension spring) that impels the press roller 21 to press against the outer peripheral surface of the plate cylinder 1 is connected to the second end of the printing pressure arm 22. The other end of the printing pressure spring 242 is connected to the side plate of the main body frame. The printing pressure spring 242 impels the second end of the printing pressure arm 22 to swivel in the clockwise direction about the arm shaft 22*a* as center, in the direction so that the press roller 21 will contact the outer peripheral surface of the plate cylinder 1. The notch 22*b* is integrally formed in the second end of the printing pressure arm 22 and is capable of latching with the latching claw 60*a* of the latching member 60, and capable of being unlatched from the latching member 60.

On the other hand, a printing pressure cam shaft 244 to which the pair of multi-step cams 243 is fixed and that rotates in synchronization with the rotation of the plate cylinder 1 is rotatably supported by the side plates of the main body frame near each cam follower 241. The multi-stage cam 243 is for example a plate cam formed with a small diameter portion (depressed portion) and a large diameter portion (projecting portion).

The printing pressure cam shaft 244 is fixed to a belt pulley or gear or the like, which is not shown in the drawings, and connected to the main motor 20 via drive transmission means such as a belt pulley or a gear. In this way, the multi-stage cam 243 rotates in synchronization with the rotation of the plate cylinder 1. The cam follower 241 is pressed to be always in contact with the multi-stage cam 243 by the printing pressure spring 242. Therefore, the cam drive means that drives the rotation of the multi-stage cam 243 is mainly constituted by the main motor 20.

The multi-stage cam 243 has three cam plates, 243A, 243B, and 243C, fixed at appropriate spacing on the printing pressure cam shaft 244. The printing pressure cam shaft 244 is capable of moving the three cam plates, 243A, 243B, and 243C by predetermined amounts in the axial direction. When necessary a specific cam is selected and moved to a position in opposition to the cam follower 241. Each cam plate 243A, 243B, 243C is set in the order cam plate 243B, cam plate 243A, and cam plate 243C from the near side relative to the plane of the paper in FIGS. 2 and 3. Each cam plate 243A, 243B, 243C has a small diameter portion (depression portion or base portion) which is a circular plate concentric with the cam shaft 244, and a large diameter portion (projection portion) that projects by the same amount. The cam shaft 244 of the multi-stage cam 243 is driven to rotate in the clockwise direction in FIG. 2 by rotational power transmitted from the main motor 20. In other words, the plate cylinder drive means (121) drives the cam shaft (44) via the drive gear (45) mounted on the cam shaft (44) and the transmission gear (47) mounted on the support shaft (46) rotatably supported on the main body frame, as shown in FIG. 4 of Prior Art 7.

When the large diameter portion of any of the cam plates 243A, 243B, 243C is in contact with the cam follower 241, the surface of the press roller 21 separates from the outer peripheral surface of the plate cylinder 1 and occupies the non-printing position as shown in FIGS. 2 and 4. When contact between the large diameter portion and the cam follower 241 is released, the surface of the press roller 21 contacts the outer peripheral surface of the plate cylinder 1 as a result of the force of the printing pressure spring 242, and occupies the printing position as shown in FIGS. 3 and 5. Each cam plate 243A, 243B, 243C is configured so that when the press roller 21 is in the printing position, the small diameter portion (base portion) does not contact the cam follower 241.

The shape of the large diameter portion of the cam plate 243A, 243B and 243C is formed so that the range of contact between the press roller 21 and the plate cylinder 1 is the total of the front surface area 1A, the intermediate area 1C, and the reverse area 1B shown in FIG. 1 (see printing pressure range pattern III in FIG. 9). The shape of the large diameter portion of the cam plate 243B is formed so that the range of contact between the press roller 21 and the plate cylinder 1 is the same as the front surface area 1A (see printing pressure range pattern I in FIG. 9). The shape of the large diameter portion of the cam plate 243C is formed so that the range of contact between the press roller 21 and the plate cylinder 1 is the same as the rear surface area 1B (see printing pressure range pattern II in FIG. 9).

As shown in FIGS. 2 and 3, the latching means 64 maintains the press roller 21 in the non-printing position shown in FIGS. 1 and 2 except when sheets are being passed through. The latching means 64 mainly includes the latching member 60, a support shaft 61, a solenoid 62, and a tension spring 63. The latching means 64 is disposed in the far side relative to the plane of the paper.

The latching member 60 is supported so that it can freely swivel about the support shaft 61 which is mounted on the side plate of the main body frame on the far side relative to the plane of the paper. The latching claw 60*a*, which can be selectively latched onto the notch 22*b* of the printing pressure arm 22, is formed in a first end of the latching member 60. On a second end of the latching member 60 one end of the tension spring 63 is connected so that the tension spring 63 impels the latching member 60 in the direction that the latching claw 60*a* is normally latched to the notch 22*b* of the printing pressure arm 22. The other end of the tension spring 63 is connected to the side plate of the main body frame on the far side relative to the plane of the paper. The solenoid 62 is fixed via a fixing member such as a bracket which is not shown in the drawings to the side plate of the main body frame on the far side relative to the plane of the paper. Also, a plunger 62*a* of the solenoid 62 is connected via a pin to the side of the second end of the latching member 60 in opposition to the portion where the tension spring 63 is disposed. The solenoid 62 is a pull-type solenoid.

According to the configuration described above, when the solenoid 62 is electrified and turned on, the printing pressure range variation means 28 is operated, and the press roller 21 occupies the printing position as a result of the operation which is described later. In this way, the press roller 21 continuously presses sheets 36 against sub-divided stenciled masters 8X or stenciled masters 8Y on the plate cylinder 1 while rotating. When the electricity to the solenoid 62 is stopped and the solenoid 62 is turned off, the printing pressure range variation means 28 stops operating, and the press roller 21 separates from the printing position and occupies the non-printing position (initial position) shown in FIGS. 1 and 2 as a result of the operation which is described later.

The solenoid 62 is controlled to turn on or off by the control device 100 which is described later. By controlling the switching on and off of the solenoid 62 by the control device 100, it is possible to selectively switch between a state in which the printing pressure arm 22 is held and a state in which the printing pressure arm 22 is released. As stated later, the solenoid 62 is turned on when the cam follower 241 contacts the large diameter portion of the multi-stage cam 243 (see FIG. 2).

FIG. 9 shows the printing pressure ranges of the press roller 21 developed for ease of understanding. In FIG. 9, the sub-divided stenciled master 8X wound around the porous portion 1*a* of the plate cylinder 1, which is not shown on FIG. 9, is provided with a front stenciled image 8A area, a reverse stenciled image 8B area, and an unstenciled blank intermediate unstenciled area 8C. Here, the leading edge of the sub-divided stenciled master 8X, which is also referred to as the leading edge blank portion, which is held by the clamper 7 of the plate cylinder 1, which is not shown in FIG. 9, is on the left hand side.

During normal printing including single-sided printing, the printing pressure range pattern is pattern III. In other words, in printing pressure range pattern III printing pressure is applied continuously from the front side stenciled image 8A area, through the intermediate unstenciled area 8C, to the reverse side stenciled area 8B. To continuously print the single-sided stenciled image 8YA of the stenciled master 8Y onto sheets 36, the printing pressure range variation means 28 is operated by a command from the control device 100 shown in FIG. 14 to select the cam plate 243A, which is driven to rotate so that the small diameter portion of the cam plate 243A is in opposition with the cam follower 241.

When printing on the front side, the printing pressure range pattern is pattern I. To print corresponding to the front side stenciled image 8A area, the printing pressure range variation means 28 is operated by a command from the control device 100 to select the cam plate 243B. Then the cam plate 243B is driven to rotate so that the small diameter portion of the cam plate 243B is brought into opposition with the cam follower 241, and then the printing pressure is released at the intermediate unstenciled area 8C.

When printing on the reverse side, the printing pressure range pattern is pattern II. The printing pressure range variation means 28 is operated by a command from the control device 100 to select the cam plate 243C. The large diameter portion of the cam plate 243C is brought into opposition with the cam follower 241 so that on the initial front side stenciled image 8A area the printing pressure is released. Next the small diameter portion of the cam plate 243C is rotated to be brought into opposition with the cam follower 241.

According to the present embodiment, the printing pressure range variation means 28 is provided, so it is possible to appropriately set the range over which the printing pressure is on. Therefore it is possible to prevent problems such as contamination with ink when a print image is transferred to the outer peripheral surface of the press roller 21 when the printing is on but there is no sheet.

The printing pressure range variation means 28 is not limited to a configuration that includes the multi-stage cam (43), the stepped cam (49), and the press roller contact and separation mechanism (55) as shown in FIGS. 2 and 4 and elsewhere in Prior Art 7. For example, an emergency pressing release means (79) as shown in FIGS. 1 through 4 of Japanese Patent Application Laid-open No. 2003-237030 may be applied.

As shown in FIG. 1, the sheet discharge unit 19 is provided close to the outer peripheral surface of the plate cylinder 1. The sheet discharge unit 19 mainly includes a separation claw 170, a separation fan 171, a sheet discharge transport device 152, and the sheet discharge tray 172. The separation claw 170 separates single-side printed sheets 36*c* from stenciled masters 8Y on the plate cylinder 1. The separation fan 171 blows air between the leading edge of the single-side printed sheet 36*c* that has been separated by the separation claw 170 and the plate cylinder 1 to assist the separation operation by the separation claw 170. The sheet discharge transport device 152 sucks in and transports single-side printed sheet 36*c* or double-sided printed sheets 36*b* separated by the separation claw 170 and the separation fan 171.

The separation claw 170 is provided near the downstream portion of the nip portion 16*a* formed by the contact of the press roller 21 against the outer peripheral surface of the plate cylinder 1. The separation claw 170 can be freely displaced between a separation position and a non-separation position by separation claw displacement means (not shown in the drawings), such as a cam and spring, or the like, that can be rotated in synchronization with the rotation of the plate cylinder 1. The separation position is a position close to the outer peripheral surface of the plate cylinder 1 where a single-side printed sheet 36*c* can be forcibly separated from the stenciled master 8Y on the plate cylinder 1. The non-separation position is a position separated from the separation position that avoids contact with the clamper 7 that projects from the outer peripheral surface of the plate cylinder 1. The separation fan 171 includes a fan drive motor that drives the rotation of the separation fan.

As shown in FIGS. 1 through 5, the sheet discharge transport device 152 is disposed below the separation claw 170 and to the left of the switching guide 46. The sheet discharge transport device 152 includes a rear sheet discharge roller 154 as the drive roller, a front sheet discharge roller 156 as the driven roller, a sheet discharge belt 158 which is an endless belt, a suction fan 159, and so on. The rear sheet discharge roller 154 is formed in a roller shape, with a plurality of rollers fitted at predetermined intervals to a drive shaft 154*a* rotatably supported on the side plates of the main body frame. The front sheet discharge roller 156 is also provided with a plurality of rollers at the same intervals as the rear sheet discharge roller 154, on a drive shaft 156*a* rotatably supported on the side plates of the main body frame. The sheet discharge belt 158 is wound around and tensioned by the rear sheet discharge roller 154 and the front sheet discharge roller 156. A drive gear or drive pulley, which is not shown on the drawings, is installed on the drive shaft 154*a* (for example, on the far side relative to the plane of the paper in FIGS. 1 through 5). The drive shaft 154*a* is connected to a sheet discharge belt drive motor 153 via drive power transmission means, which is not shown on the drawings, such as a motor gear meshing with the drive gear, or a belt provided between the drive pulley and a pulley, which are not shown on the drawings. In this way, the sheet discharge belt 158 is driven to rotate in the direction of the arrow shown in FIG. 1 (the counterclockwise direction) by the sheet discharge belt drive motor 153.

The suction fan 159 is disposed below the sheet discharge belt 158. The suction fan 159 includes a fan drive motor that drives the rotation of the suction fan. As a result of the suction force of the suction fan 159, the sheet discharge transport device 152 draws single-side printed sheets 36*c* or double-side printed sheets 36*b* onto the sheet discharge belt 158, and transports them in the direction of the arrow shown in FIG. 1 by the rotation of each rear sheet discharge roller 154.

In FIG. 14, the fan drive motor of the separation fan 171, the sheet discharge belt drive motor 153, and the fan drive motor of the suction fan 159 are collectively referred to as sheet discharge drive means 127 of the sheet discharge unit 19.

The switching guide 46 is disposed on the sheet transport path between the nip portion 16*a* and the sheet discharge transport device 152, as shown in FIGS. 1 through 5. The nip portion 16*a* is the printed image formation portion in the printing unit 16 formed by the press roller 21 pressing against the plate cylinder 1. The switching guide 46 is a plate member having a width that is virtually the same as that of the plate cylinder 1 and the press roller 21. The base end portion (the downstream end portion in the direction of transport of sheets X) of the switching guide 46 is fixed to a shaft 46*a* that is supported by the side plates of the main body frame so that it can rotate through a predetermined angle. The free end portion (the upstream end portion in the direction of transport of sheets X) can freely swivel about the shaft 46*a* as center. The outer peripheral surface of the switching guide 46 is preferably coated with a film that is ink resistant and oil resistant, such as for example a poly-tetrafluoroethylene resin or the like.

The switching guide 46 can be selectively positioned in a first displacement position or a second displacement position by the action of a solenoid 47 as switching drive means shown in FIGS. 2 and 14 operating against the resistance force of a tension spring as impelling means, which is not shown in the drawings. The first displacement position is the position in which the free end portion which is formed with an acute angled cross-section is positioned as shown by the solid lines in FIG. 1. The second displacement position is shown by the double-dashed lines in FIG. 1. The switching guide 46 is given the tendency to swivel into the first displacement position, which is also the initial position shown in FIG. 1, by the impelling force of the tension spring. When the switching guide 46 is in the first displacement position, the tip of the switching guide 46 is near the outer peripheral surface of the press roller 21, and in a position that will not interfere with the clamper 7. When the switching guide 46 is in the second displacement position, the tip is positioned close to the peripheral surface of the plate cylinder 1. When the switching guide 46 is in the first displacement position, double-side printed sheets 36*b* or single-side printed sheets 36*c* that pass between the plate cylinder 1 and the press roller 21 are guided to the sheet discharge unit 172. When the switching guide 46 is in the second displacement position, sheets 36*a* printed on the front side are guided by the switching guide 46 to the movable guide 81. The switching drive means that displaces the switching guide 46 between the first displacement position and the second displacement position is not limited to a combination of the solenoid 47 and the tension spring. For example, the switching guide 46 may be driven by a stepping motor or a rotary solenoid, or the like.

As shown in FIGS. 1 through 5, the movable guide 81 is disposed below the sheet discharge transport device 152 and the switching guide 46, and above the sheet re-supply transport device 104. As shown in FIGS. 3, 7, and 8, the movable guide 81 has the function and constitution as sheet holding means to take hold of the leading edge portion, which includes the leading edge, of sheets 36*a* printed on the front side that are ejected from the nip portion 16*a*, at the moving position P1, and release the leading edge of sheets 36*a* printed on the front side at an initial position P2. The moving position P1 is the first position near the printing unit 16. The initial position P2 is the second position which is lower than the moving position P1 and which is near the upstream side of the sheet re-supply device 45, as shown in FIGS. 7 and 8.

The movable guide 81 mainly includes a holding platform 81*f*, an end fence 81*d*, projections 81*c*, a clamping claw 81*b*, a clamping shaft 81*a*, a pair of bearing brackets 81*g*, a coil spring which is not shown on the drawings, and a pair of release levers upper 82, and release levers lower 83. The holding platform 81*f* is for holding and loading the leading edge portion of sheets 36*a* that have been printed on the front side. The end fence 81*d* is formed integrally with the holding platform 81*f* on the downstream side in the direction of movement Xa of sheets 36*a* that have been printed on the front side that have been ejected from the nip portion 16*a*. The end fence 81*d* includes a sheet contact surface 81*e* against which the leading edges of sheets 36*a* that have been printed on the front side contact. The projections 81*c* are projections formed integrally as guides at four positions in pairs in the direction of reciprocation on the holding platform 81*f* at both the near side and the far side relative to the plane of the paper. The clamping claw 81*b* is a holding member that is capable of opening and closing with respect to the holding platform 81*f*, and that releases and holds the leading edge portion of sheets 36*a* that have been printed on the front side. The clamping shaft 81*a* is a member on which the base end of the clamping claw 81*b* is installed and fixed, and that is capable of swiveling (rotating freely about a predetermined angle). A pair of the bearing brackets 81*g* are integrally installed on the two side ends of the holding platform 81*f* to support the clamping shaft 81*a* so that the clamping shaft 81*a* can freely rotate through the predetermined angle. The bearing brackets 81*g* are shown on FIG. 7 only. The coil spring, which is not shown on the drawings, is impelling means that presses the free end of the clamping claw 81*b* in the direction of the arrow shown in FIG. 4 against the top surface of the holding platform 81*f*. The pair of release levers upper 82, and release levers lower 83 is shown in FIG. 8, and is installed and fixed to the clamping shaft 81*a* in the far side relative to the plane of the paper.

The movable guide 81 is formed in an L-shaped cross-section by the holding platform 81*f* and the end fence 81*d*. The four projections 81*c* fit loosely into guide grooves 88 formed in the pair of side plates 130*a*, 130*b* of the main body frame, as shown in FIG. 7. The clamping claw 81*b* is slanted at an angle that forms an acute angle with the direction of movement Xa (transport direction) of sheets 36*a* that have been printed on the front side ejected from the nip portion 16*a*. The base end of the clamping claw 81*b* is installed on and fixed to the clamping shaft 81*a*, and the free end is formed in an acute angle shape. In addition, the clamping claw 81*b* is made from a metal or resin thin plate member that is fixed to the clamping shaft 81*a* extending in the sheet width direction Y, to hold or release the leading edge of sheets 36*a* printed on the front side ejected from the nip portion 16*a*. An installation portion 84 is provided integrally on the bottom portion of the holding platform 81*f* in the far side relative to the plane of the paper, as shown in FIG. 7. The installation portion 84 is fixed to a timing belt 89 that forms part of movement means 87.

The release lever upper 82 and release lever lower 83 are formed as plate shaped members. The projections 81*c* are not limited to being formed integrally with the holding platform 81*f*, and they may be provided as rollers that can roll with low friction on the internal walls of the guide grooves 88.

According to the movable guide 81 of the present embodiment, the clamping claw 81*b* is provided slanted at an angle that forms an acute angle with the direction of movement Xa (transport direction) of sheets 36*a* that have been printed on the front side ejected from the nip portion 16*a*. Therefore, when a sheet 36*a* that has been printed on the front side is being transported, if a load or the like acts in the direction to pull out the sheet 36*a* that has been printed on the front side, a moment will act on the clamping claw 81*b* in the direction to increase the holding force (pressing force). In other words the moment acts to rotate the clamping claw 81*b* in the counterclockwise direction. Therefore, the holding force (pressing force) increases, and pull out of the sheet 36*a* that has been printed on the front side is prevented. In addition, this has the advantages that it is possible to set the holding force of a torsional coil spring, which is not shown in the drawings, smaller, and there is no necessity to make it stronger so the cost can be reduced.

Preferably the parts of the constituent elements of the movable guide 81 that come into contact with sheets 36*a* that have been printed on the front side are formed from a metal material to prevent static electricity, or are subjected to a vapor deposition process or plating process to prevent static electricity.

The moving means 87 is disposed to the outside of the side plate 130*b* of the main body frame on the far side relative to the plane of the paper, as shown in FIG. 7. The moving means 87 has the function and constitution to reciprocate the movable guide 81 between the moving position P1 and the initial position P2. The moving means 87 mainly includes the guide grooves 88, a drive pulley 90, a driven pulley 91, the timing belt 89, a plurality of tension rollers 95, a drive gear 92, a drive motor 94, and a motor gear 93. The guide grooves 88 are formed in a circular arc shape penetrating the pair of side plates 130*a*, 130*b* of the main frame, and sloping downwards to the left to follow virtually the same transport path as the sheet transport direction Xa of the sheets 36*a* that have been printed on the front side. The drive pulley 90 has teeth and a shaft 90*a*, and is rotatably supported on the side plate 130*b* of the main body frame near the downstream end of the guide groove 88 in the sheet transport direction Xa of the sheets 36*a* that have been printed on the front side. The driven pulley 91 has teeth and a shaft 91*a*, and is rotatably supported on the side plate 130*b* of the main body frame near the upstream end of the guide groove 88 in the sheet transport direction Xa of the sheets 36*a* that have been printed on the front side. The timing belt 89 is wound around and tensioned on the drive pulley 90 and the driven pulley 91. The plurality of tension rollers 95 is disposed to contact and apply tension to the timing belt 89, and is rotatably supported on the side plate 130*b* via shafts that are not shown on the drawings. The drive gear 92 is installed on and fixed to the shaft 90*a* of the drive pulley 90. The drive motor 94 is drive means capable of rotating in the forward and reverse directions, installed on and fixed to the side plate 130*b* of the main body frame near the shaft 90*a* of the drive pulley 90. The motor gear 93 is installed on and fixed to the output shaft 94*a* of the drive motor 94 and meshes with the drive gear 92.

The timing belt 89 is connected to the movable guide 81 via the installation portion 84 integrally formed in the bottom of the holding platform 81*f* of the moving guide 81. The drive motor 94 is for example a stepping motor. As described above, the drive motor 94 constitutes drive means of the moving means 87; the guide grooves 88 constitute guide means of the moving means 87; the timing belt 89, the drive pulley 90, the driven pulley 91, the drive gear 92, and the motor gear 93 constitute drive power transmission means for transmitting the drive power of the drive motor 94 to the moving guide 81.

In accordance with the configuration described above, the moving guide 81 can be reciprocated by the forward or reverse rotation of the drive motor 94 via the drive power transmission means to selectively occupy the moving position P1 (the first position), or the initial position or standby position (the second position). The moving position P1 (the first position) is the position near the printing unit 16 where the leading edge of sheets 36*a* that have been printed on the front side is clasped, and is indicated by a solid lines in FIGS. 3, 7, and 8. The initial position or standby position (the second position) is lower than the moving position P1 near the upstream side of the sheet re-supply means 45 (near the rear of and above the transport roller 107 of the sheet re-supply transport device 104). The initial position or standby position (the second position) is the position where the leading edge of sheets 36*a* that have been printed on the front side is released, and is indicated by solid lines in FIGS. 1 and 2, and by double-dashed lines in FIGS. 7 and 8. A home position sensor 85 is disposed near the drive pulley 90 to detect when the moving guide 81 is in the second position that is the home position P2 (initial position P2).

The release cam 98 and the torsional coil spring have the function of operation time control means. As shown in FIG. 8, when the movable guide 81 occupies the moving position P1 indicated by solid lines, the clamping claw 81*b* is temporarily released by being swiveled in the clockwise direction (rotation through a predetermined angle) via the release lever lower 83 and the clamp shaft 81*a* as a result of the contact between the release lever lower 83 of the movable guide 81 and the release cam 98, against the resistance of the torsional coil spring. Then, when the movable guide 81 starts to move from the moving position P1 towards the initial position P2 indicated by double-dashed lines, the contact between the release cam 98 and the release lever lower 83 is eliminated. As a result, the clamping claw 81*b* swivels in the counterclockwise direction due to the impelling force of the torsional coil spring. Therefore the leading edge portion of the sheet 36*a* that has been printed on the front side is held. As shown in FIG. 8, when the movable guide 81 occupies the initial position P2, the release lever upper 82 of the movable guide 81 contacts the release pin 99. In this way the clamping claw 81*b* is swiveled in the clockwise direction via the release lever upper 82 and the clamp shaft 81*a*, against the resistance of the impelling force of the torsional coil spring, which is not shown in the drawings. Therefore the leading edge of the sheet 36*a* that has been printed on the front side is released.

According to the present embodiment, the release cam 98 is provided, which has the following advantages compared with the case where the release cam 98 is not provided. Consider for example, a configuration without the release cam 98. When the movable guide 81 is occupying the moving position P1, the leading edge of the sheet 36*a* printed on the front side swivels the clamping claw 81*b* in the clockwise direction and is inserted into the release portion (the release portion between the front end of the clamping claw 81*b* and the top surface of the holding platform 81*f*), using the transport force applied by the nip portion 16*a*, against the impelling force of the torsional coil spring which is not shown on the drawings. Even if the impelling force of the torsional coil spring is set to suit weak sheets, it is conceivable that the leading edge of the sheet will get deformed, or that the holding force will not be stable. In contrast to this, according to the present embodiment, when the movable guide 81 is occupying the moving position P1, as a result of the action of the release cam 98 as described, the leading edge of the sheet 36*a* printed on the front side is smoothly inserted into the release portion (the release portion between the front end of the clamping claw 81*b* and the top surface of the holding platform 81*f*), using the transport force applied by the nip portion 16*a*. Therefore it is possible to securely hold and clamp the leading edge of sheets 36*a* printed on the front side between the front end of the clamping claw 81*b* and the top surface of the holding platform 81*f*, regardless of the strength of the sheets. In this way, it is possible to transport the sheets 36*a* printed on the front side in a stable manner without meandering or skewing. In addition, it is possible to prevent inclination of the image or poor resist due to inclination when printing on the reverse side. Also, it is possible to set the release time longer to a certain extent when clasping the leading edge of the sheet 36*a* printed on the front side by design and adjustment of the shape of the release cam 98. Therefore, even for weak sheets it is possible to insert the leading edge of the sheet without resistance, so the leading edge of sheets 36*a* printed on the front side can be held well.

As a result of the action and operation of the release pin 99, when the movable guide 81 is in the initial position P2, the leading edge of the sheet 36*a* printed on the front side that is held between the front end of the clamping claw 81*b* and the top surface of the holding platform 81*f* is released. Then the sheet 36*a* printed on the front side is dropped onto the transport belt 108 of the sheet re-supply transport device 104 from its leading edge. At this time the sheet 36*a* printed on the front side is temporarily held on the top of the transport belt 108 by the suction force of the suction fan 109, and then transported by the rotation of the transport belts 108. Of course the length of the transport belts 108 and the initial position P2 of the movable guide 81 and so on must be set to a suitable length in accordance with the length in the sheet transport direction X of the sheets 36 used in double-sided printing.

The plate discharge unit 17 includes an upper plate discharge member 160, a lower plate discharge member 161, a plate discharge box 162, a compression plate 163, and so on. The upper plate discharge member 160 includes a drive roller 164, a driven roller 165, an endless belt 166, and so on. The drive roller 164 is driven to rotate in the counterclockwise direction in FIG. 1 by plate discharge drive means 126 (see FIG. 14) that includes a plate discharge motor which is not shown in the drawings. In this way the endless belt 166 moves in the direction of the arrow shown in FIG. 1. The lower plate discharge member 161 includes a drive roller 167, a driven roller 168, an endless belt 169, and so on. The drive power of the plate discharge roller that drives the rotation of the drive roller 164 is transmitted to the drive roller 167 by drive power transmission means, such as a gear or a belt, which is not shown in the drawings. Therefore the drive roller 167 is driven to rotate in the clockwise direction in FIG. 1, and the endless belt 169 moves in the direction of the arrow in FIG. 1. Also, the lower plate discharge member 161 can be moved by moving means that is not shown in the drawings that is included in the plate discharge drive means 126. In this way the lower plate discharge member 161 can selectively occupy the position shown in the drawings, and a position in which the endless belt 169 at a position on the outer peripheral surface of the driven roller 168 contacts the outer peripheral surface of the plate cylinder 1.

The plate discharge box 162 stores used masters, and is provided so that it can be freely inserted into and removed from the main body frame 130. The compression plate 163 is supported so that it can be moved vertically with respect to the main body frame 130, so that it can compress used masters transported by the upper plate discharge member 160 and the lower plate discharge member 161 into the plate discharge box 162. The compression plate 163 is moved vertically by vertical moving means which is not shown in the drawings, and which is included in the plate discharge drive means 126.

In FIG. 14, the plate discharge motor of the plate discharge unit 17, the moving means, and the control drive means of the plate discharge unit 17 which includes the vertical moving motor, is collectively referred to as the plate discharge drive means 126.

As shown in FIGS. 1, 10, and 11, the sheet supply unit 30 includes the sheet supply tray 35, a sheet supply roller 33, a separation member 34, a sheet size detection sensor 117, a pair of resist rollers 31*a*, 31*b* (hereafter referred to as the "pair of resist rollers 31"), and so on. The sheet supply tray 35 is capable of moving vertically, and stacks sheets 36 so that they can be dispensed. The sheet supply roller 33 and separation member 34 as sheet supply means contacts the sheets 36 on the sheet supply tray 35, and separates and transports sheets 36 one at a time towards the nip portion of the pair of resist rollers 31*a* and 31*b*. The sheet size detection sensor 117 as sheet size detection means detects the sheet size of the sheets 36. The pair of resist rollers 31 as resist means supplies sheets 36 between the outer peripheral surface of the plate cylinder 1 and the press roller 21, at timing that is explained later.

A sheet thickness sensor 79 as sheet type detection means is disposed in the sheet supply path between the pair of resist rollers 31 and the sheet supply roller 33 and separation member 34, to measure the thickness of sheets 36. The sheet thickness sensor 79 has been explained for convenience in the present embodiment, and although used in modifications described later and so on, the present embodiment is explained for the case that the sheet thickness sensor 79 is not included.

The sheet supply tray 35 is raised and lowered by drive means (not shown in the drawings) that includes a sheet supply raising and lowering motor as raising and lowering means and a wire type raising and lowering mechanism, which are not shown on the drawings, or the like. In this way the top of the stacked sheets 36 contacts the sheet supply roller 33 with a predetermined pressing force (a pressing force at which sheets 36 can be transported). In other words, the sheet supply tray 35 is raised or lowered as the number of sheets decreases or increases, while the sheets 36 maintain contact with the sheet supply roller 33 with a pressing force in the range for which the sheets 36 can be transported. The sheet supply tray 35 has a structure that enables most sheet types and sheet sizes to be used. In addition, the sheet supply tray 35 has a structure to permit 500 or more sheets of for example A3 size (placed sideways: indicates the state viewed by a user standing to the near side relative to the plane of the paper) or A4 size sheets 36 to be stacked, as appropriate for the stencil printing apparatus.

A pair of side fences, which is not shown in the drawings, is disposed in the sheet supply tray 35 to be able to freely move in the sheet width direction perpendicular to the sheet transport direction X, so that the position of both ends of the sheets 36 can be determined in accordance with the sheet size.

Near the bottom of the sheet supply tray 35, sheet length size detection sensors 117*a*, 117*b*, 117*c* (each made from reflection type optical sensors) are disposed to detect the length of the supplied sheets 36. Also, sheet width size sensors (for example, made from transmission type optical sensors coupled to the movement in the sheet width direction of the pair of side fences), which are not shown in the drawings, that detect the sheet width of the supplied sheets 36 are disposed in the near side and the far side relative to the plane of the paper in the drawings. The size of the supplied sheets 36 is detected by the sheet length detection sensors 117*a*, 117*b*, 117*c*, and the sheet width size detection sensors, and hereafter these sensors are collectively referred to as the sheet size detection sensor 117.

The sheet supply roller 33 is formed integrally with a sheet supply roller shaft 33*a*, as shown in FIGS. 1 and 11. One end of the sheet supply roller shaft 33*a* is rotatably supported on a side plate of the main body frame. At least the surface of the sheet supply roller 33 is made from a high frictional resistance material, such as rubber. A toothed sheet supply roller pulley 39 is installed on one end of the sheet supply roller shaft 33*a*. A one way clutch (not shown on the drawings) is disposed between the sheet supply roller shaft 33*a* and the sheet supply roller pulley 39, in order that the sheet supply roller 33 is rotated so that sheets 36 are only transported in the sheet transport direction X. The separation member 34 is formed from a material with a high coefficient of friction with sheets 36, such as rubber or resin, or the like. The separation member 34 includes a member referred to as the separation pad, that is capable of contacting the sheet supply roller 33. The sheet supply roller 33 is pressed by impelling means such as a compression spring, which is not shown in the drawings, against the separation pad.

The sheet supply motor 37 as sheet supply drive means drives the rotation of the sheet supply roller 33, and is disposed below the sheet supply roller pulley 39 and fixed to a side plate of the main frame. The sheet supply motor 37 is for example a stepping motor, on the output shaft of which a toothed sheet supply motor pulley 38 is fixed. A toothed sheet supply motor belt 40 is wound between the sheet supply roller pulley 39 and sheet supply motor pulley 38. In this way, a rotation drive power transmission relationship is formed between the sheet supply roller 33 and the sheet supply motor 37, via the sheet supply motor belt 40 and the one way clutch.

As shown in FIGS. 1 and 11, the upper resist roller 31*a* is formed integrally with a resist roller shaft, and the lower resist roller 31*b* is formed integrally with a resist roller shaft 31*c*. Both ends of each resist roller shaft 31*c* are rotatably supported on the side plates of the main body frame. A toothed resist roller pulley 43 is installed on one end of the lower resist roller shaft 31*c*. The lower resist roller 31*b* is supported by the side plates of the main body frame via the resist roller shaft 31*c* so that the lower resist roller 31*b* can freely rotate but not move. The upper resist roller 31*a* can contact and be separated from the lower resist roller 31*b* at predetermined timings via resist roller contact and separation means, which is not shown in the drawings.

The resist motor 41 as resist drive means is fixed to a side plate of the main body frame, is provided below the lower resist roller 31*b*, and drives the rotation of the pair of resist rollers 31. The resist motor 41 is for example a stepping motor, and a toothed resist motor pulley 42 is fixed to the output shaft. A toothed resist motor belt 44 is fitted between the resist roller pulley 43 and the resist motor pulley 42. In this way, a rotation drive power transmission relationship is formed between the lower resist roller 31*b* and the resist motor 41, via the resist motor belt 44.

In FIG. 1, a sheet detection sensor 32 as sheet detection means is disposed in the sheet transport path XA from between the plate cylinder 1 and the press roller 21, to the nip portion of the pair of resist rollers 31. The sheet detection sensor 32 detects the leading edge and trailing edge of sheets 36 dispensed from the pair of resist rollers 31. The sheet detection sensor 32 has the function of detecting jams of sheets 36 in the sheet transport path XA upstream of the installation position (the position where the leading edge of the sheets 36 can be detected) of the sheet detection sensor 32. The sheet detection sensor 32 is a reflection type optical sensor.

In FIG. 14, the drive means subject to control of the sheet supply unit 30 that includes the sheet supply tray raising and lowering motor of the sheet supply unit 30, the sheet supply motor 37, and the resist motor 41 is collectively referred to as sheet supply drive means 125.

As shown in FIG. 12, the image reading unit 18 includes the document receiving platform 134, the contact glass 135, a pair of document transport rollers 136, a document transport roller 137, guide plates 138, 139, a plurality of document transport belts 140, a document tray 141, a pressure plate 142, reflection mirrors 143, 144, a fluorescent light 145, a lens 146, and an image sensor 147. A plurality of sheets of document 133 is stacked in the document receiving platform 134. The contact glass 135 is a reading unit on which documents 133 are loaded. The pair of document transport rollers 136 and the document transport roller 137 transport the documents 133. The guide plates 138, 139 guide the documents 133 being transported. The plurality of document transport belts 140 transport the documents 133 along the contact glass 135. The document tray 141 stacks documents 133 that have been read. The pressure plate 142 can be opened and closed with respect to and separated from the contact glass 135, and supports each member that has been mentioned, except the contact glass 135. The reflection mirrors 143, 144, and the fluorescent light 145 are used for scanning and reading the documents 133 while the image is lit. The lens 146 focuses the reflected light from the scanned and read image. The image sensor 147 includes a charge coupled device (CCD) that carries out a photoelectric conversion process on the focused reflected light from the image.

In the configuration described above, the document receiving platform 134, the pair of document transport rollers 136, the document transport roller 137, the guide plates 138, 139, the document transport belts 140, and the document tray 141 constitute an automatic document feeding device (hereafter referred to as the "ADF") 148 as automatic document feeding means that transports documents 133 one sheet at a time onto the contact glass 135 (the reading unit). Also, the contact glass 135, the reflection mirrors 143, 144, the fluorescent light 145, the lens 146, and the image sensor 147 constitute a scanner device 132 as document reading means that reads images of the documents 133 on the contact glass 135 (the reading unit). Also, the reflection mirrors 143, 144, the fluorescent light 145, and the lens 146 constitute the document scanning optical system.

The pair of document transport rollers 136, the document transport roller 137, and the document transport belts 140 are driven by a document transport motor, which is not shown in the drawings. The scanner device 132 includes a scanner motor (not shown in the drawings) that drives the scanner device 132. The image signal obtained by photoelectric conversion of the reflected light received by the image sensor 147 is input to an A/D conversion unit.

Document length size detection sensors 149*a*, 149*b*, that detect the length of transported documents 133 or the length in the transport direction in the drawings (left to right direction) of documents 133, which are not shown in the drawings, loaded on the contact glass 135, are disposed below and close to the contact glass 135. Also, document width size detection sensors which are not shown in the drawings, that detect the width of transported documents 133 or the width from the near side to the far side relative to the plane of the paper in the drawings of documents 133, which are not shown in the drawings, loaded on the contact glass 135, are disposed below and close to the contact glass 135. The document length size detection sensors 149*a*, 149*b* and the document width size detection sensors detect the size of transported documents 133 or the size of documents 133 loaded on the contact glass 135, and hereafter are collectively referred to as the document size detection sensor 149.

The document length size detection sensors 149*a*, 149*b* and the document width size detection sensors of the document size detection sensor 149 are reflection type optical sensors. The document size detection sensor 149 detects the outline and size of documents 133 and the presence or absence of documents 133 on the contact glass 135 from differences in the amount of reflection. The signal from the document size detection sensor 149 is input to the control device 100 which is described later. Based on the signal from the document size detection sensor 149, the control device 100 determines and recognizes the document size (the size of the plate image that should be formed on the stenciled master 8 when the magnification factor is one). A document detection sensor 131 is disposed below the document receiving platform 134 to detect documents 133 remaining on the document receiving platform 134. When there are no more documents 133 on the document receiving platform 134, the document detection sensor 131 outputs a signal to the control device 100.

In FIG. 14, the drive means subject to control of the image reading unit 18, which includes the scanner motor and the document transport motor of the image reading unit 18, is collectively referred to as document reading drive means 128.

Figure 13:
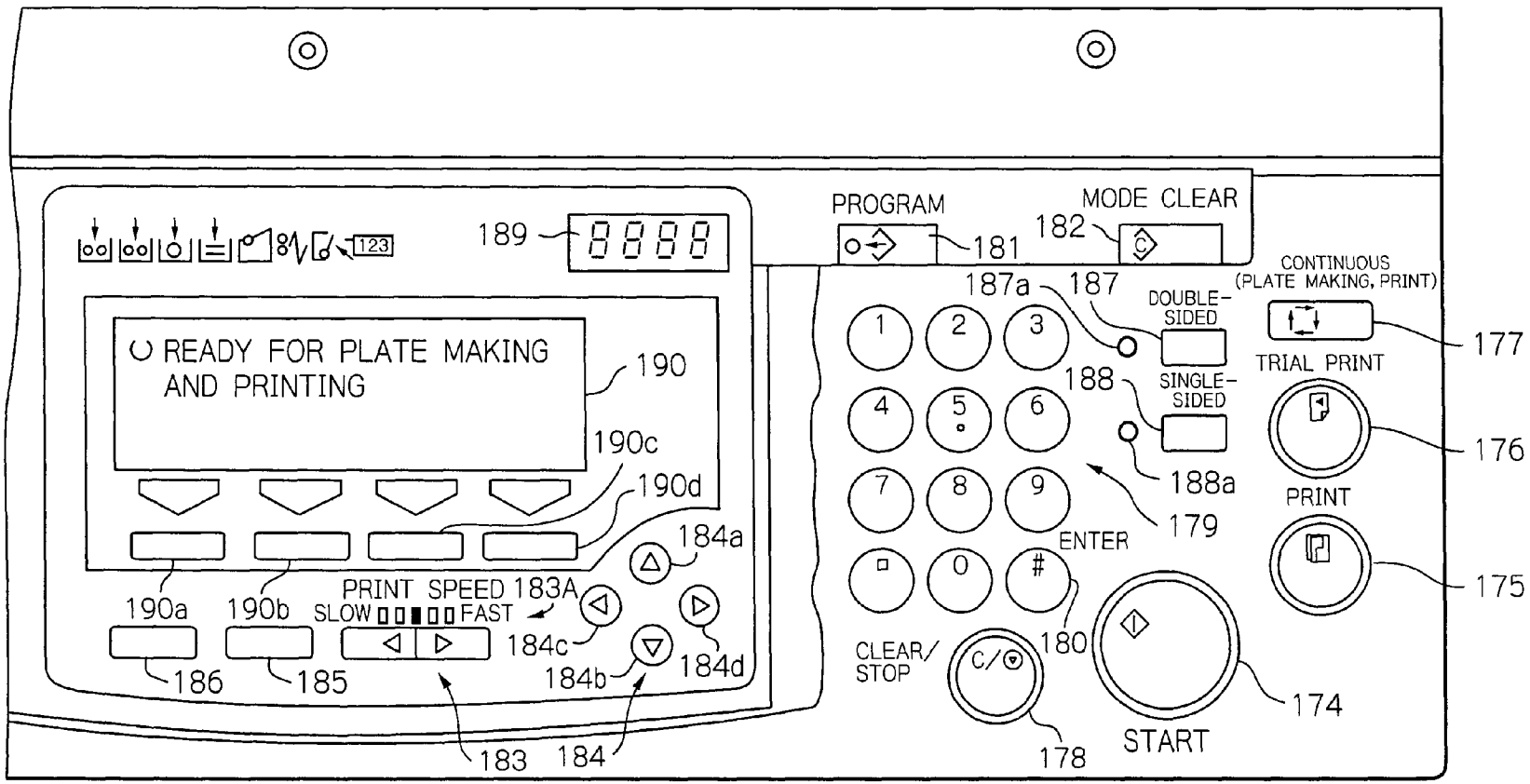
FIG. 13 is a plan view of the main parts of the operation panel of the double-sided stencil printing apparatus of FIG. 1.

The detailed configuration of an operation panel 173 that issues commands and the like for specific operation of the double-sided stencil printing device 300 is explained referring to FIG. 13. The operation panel 173 is disposed near the image reading unit 18 shown in FIG. 12. The operation panel 173 includes on its top surface a plate making start key 174, a printing start key 175, a trial print key 176, a continuous key 177, a clear/stop key 178, a numerical keypad 179, an enter key 180, a program key 181, a mode clear key 182, a print speed setting key 183, a print speed display device 183A made from light emitting diodes (LEDs), four direction keys 184, a sheet size setting key 185, a sheet type setting key 186, a double-sided printing key 187, a single-sided printing key 188, a display device 189 made from a seven segment LED, a display device 190 made from a liquid crystal display (LCD), and so on.

The plate making start key 174 is pressed when the plate making operation is carried out in the double-sided stencil printing device 300. When the plate making start key 174 is pressed, the plate making operation is carried out, after the plate discharge operation and document reading operation are carried out. Then, the plate installation operation is carried out, and the double-sided stencil printing device 300 enters the printing standby state. The printing start key 175 is pressed when the printing operation is carried out in the double-sided stencil printing device 300. After the double-sided stencil printing device 300 enters the printing standby state and the various printing conditions have been set, printing the set number of copies is carried out by pressing the printing start key 175. The trial print key 176 is pressed when the trial print operation is carried out in the double-sided stencil printing device 300. After the various printing conditions have been set, printing a single sheet only is carried out by pressing the trial print key 176.

The clear/stop key 178 is pressed to stop the operation of the double-sided stencil printing device 300, or to clear an entered number. The numerical keypad 179 is used for entering numerical values, and so on. The enter key 180 is pressed when setting a numerical value for the various settings. The program key 181 is pressed to register or to call up frequently used operations. The mode clear key 182 is pressed to clear various modes and to restore the initial condition.

The print speed setting key 183 is pressed when setting the printing speed prior to the printing operation. When a denser image is expected, or when the ambient temperature is low, the printing speed is set slow. When a lighter image is expected, or when the ambient temperature is high, the printing speed is set fast.

The printing speeds of the print speed display device 183A and the "Print speed: speed 3" blacked out in the center portion are standard printing speeds that correspond to the normally used printing speeds. When the print speed setting key 183 is not pressed, the printing speed is automatically set. For example, the leftmost "Print speed: speed 1" displayed as "slow" is the slowest print speed 16 sheets per minute: 16 rpm, adjacent to this to the right the "Print speed: speed 2" is a print speed of 60 sheets per minute: 60 rpm, the "Standard print speed: speed 3" is a print speed of 90 sheets per minute: 90 rpm, to the right of this the "Print speed: speed 4" is a print speed of 105 sheets per minute: 105 rpm, and the rightmost "Print speed: speed 5" displayed as "fast" is the fastest print speed 120 sheets per minute: 120 rpm. The print speed display device 183A sets the print speed by switching the print speed between 1 to 5 in five stages by pressing the print speed setting key 183 (the speed up key and the speed down key on the left and right) once every time, and the print speed is displayed by a light lighting up.

The four direction keys 184 include an up key 184*a*, a down key 184*b*, a left key 184*c*, and a right key 184*d*. These keys are pressed when adjusting the image position during image editing, or when selecting numbers or items for various settings, and so on. The sheet size setting key 185 is pressed when inputting the sheet size. The sheet size input using the sheet size setting key 185 has priority over the sheet size detected by the sheet size detection sensor 117.

The sheet type setting key 186 is pressed when inputting the sheet type prior to double-sided printing. In the present embodiment, sheet types are classified into three types: "normal sheets" which are also referred to as standard sheets, "thin sheets", and "thick sheets". Furthermore, one type is selected from among the sheet types which are classified in detail corresponding to these three types. In other words, in the present embodiment, it is possible for example to select and set the sheet thickness characteristics from among the thickness and strength of the sheet from among the sheet types, by the operation of inputting using the sheet type setting key 186. This is because in general, as the sheet thickness increases the strength tends to increase.

Thin sheets include groundwood paper, and high quality 45 kg paper, and so on; normal paper (standard paper) includes copier paper, medium quality paper, high quality 55 kg paper, recycled paper, stencil high quality paper, and so on. Thick paper includes drawing paper, postcard, envelope, high quality 135 kg paper, high quality 180 kg paper, and so on.

The double-sided printing key 187 is pressed before pressing the plate making start key 174 when carrying out double-sided printing operations in the double-sided stencil printing device 300. When the double-sided printing key 187 is pressed the LED 187*a* disposed close to the double-sided printing key 187 lights up, indicating that the double-sided printing mode has been set. The single-sided printing key 188 is also pressed before pressing the plate making start key 184 when carrying out single-sided printing operations in the double-sided stencil printing device 300, similar to the double-sided printing key 187. When the single-sided printing key 188 is pressed the LED 188*a* disposed close to the single-sided printing key 188 lights up, indicating that the single-sided printing mode has been set. In the double-sided stencil printing device 300, after a power switch which is not shown in the drawings is turned on, the LED 188*a* lights up in the initial condition, indicating that the single-sided printing mode has been set.

The display device 189 mainly displays numbers such as the number of sheets printed, and so on. The display device 190 has a layered display structure. By selecting and pressing selection setting keys 190*a*, 190*b*, 190*c*, 190*d* provided below the display device 190, it is possible to adjust the magnification or image position, and so on, change various modes, and carry out settings in each mode. Also, when the sheet type setting key 186 is pressed, the sheet types that can be selected and set are displayed in the display device 190. Also, the status of the double-sided stencil printing device 300 is displayed in the display device 190, such as "plate making and printing can be carried out" as shown in FIG. 13. In addition warnings regarding plate making or plate making jams, or sheet supply or sheet discharge jams, and so on, and notifications regarding supply of sheets, masters, ink, and other supplies are displayed in the display device 190.

When the sheet type setting key 186 is initially pressed one time, the sheet types that can be selected and set are displayed in the display device 190 as thin sheets: groundwood paper, high quality 45 kg paper, and so on, normal paper: copier paper, medium quality paper, high quality 55 kg paper, recycled paper, stencil high quality paper, and so on, and thick paper: drawing paper, postcard, envelope, high quality 135 kg paper, high quality 180 kg paper, and so on. Therefore, when the sheet is selected and specified using the four direction keys 184, the selected and specified sheet is displayed in the display device 190 with black and white reversed, and when finally the enter key 180 is pressed the setting is confirmed. Therefore, in this example the sheet type setting key 186, the enter key 180, and the four direction keys 184 constitute sheet type setting means for setting the sheet type.

The sheet type setting means is not limited to the above combination of keys. For example, numeric keys may be allocated to the sheet types that can be selected and set, or the function may be allocated to the selection and setting keys 190*a* through 190*d*.

Next, the main control configuration of the double-sided stencil printing device 300 is explained with reference to FIG. 14. In FIG. 14, the control device 100 has the function and constitution as means to control mainly the document reading operation, plate making and plate supply operation, the sheet supply operation, and the printing operation in the double-sided stencil printing device 300. The control device 100 includes a microcomputer that includes a CPU 101 (central processing unit), an I/O (input/output) port which is not shown in the drawings, a ROM 102 (read only memory device), a RAM 103 (random access memory device), and a timer or similar that is backed up by a battery or similar, which are not shown in the drawings, connected together with a signal bus which is not shown in the drawings.

The control device 100 is provided on a control board within the main body frame 130, as shown in FIG. 1. The CPU 101 of the control device 100 (hereafter simply referred to as the "control device 100" to simplify the explanation) controls the operation of the double-sided stencil printing device 300 by controlling the operations of the main motor 20 of the printing unit 16, the stepping motor 252 of the printing pressure range variation means 28, the solenoid 62 of the latching means 64, the plate making unit 15, the sheet supply unit 30, the plate discharge unit 17, the sheet discharge unit 19, each drive means subject to control provided in the image reading unit 18, the press roller drive motor 55 provided in the sheet re-supply means 45, the suction fan 109 of the sheet re-supply transport device 104, the belt drive motor 105, the solenoid 73, the solenoid 47 of the switching guide 46, and the drive motor 94 provided in the moving means 87, based on various signals from the operation panel 173, detection signals from various sensors provided within the main body frame 130, operation programs called up from the ROM 102, and related data. Also, the control device 100 determines the rotational position of the plate cylinder 1 and the printing speed, and so on, based on various plate cylinder positional signals from that which is collectively indicated as the plate cylinder position detection sensor 29 in FIG. 14.

The overall operation program for the double-sided stencil printing device 300 and necessary related data are recorded in advance in the ROM 102. This operation program is called up by the CPU 101 as appropriate. The related data includes related data set for each printing speed for sheet types including thicknesses of sheets 36 and rotation speed (in other words, the transport speed as the linear speed of the transport belts 108) of the belt drive motor 105 of the sheet re-supply transport device 104, related data set for each printing speed for sheet types, and stoppage timing of the belt drive motor 105 after contact of the leading edge of the sheet 36*a* that has been printed on the front side with the stopper surface 53*a*. This related data is for example obtained in advance by testing or the like, and recorded in the ROM 102 in a data table for varying the transport speed of the transport belt 108 for each printing speed and in accordance with the sheet type, or a data table for varying the stop timing of the belt drive motor 105 for each printing speed in accordance with the sheet type similarly obtained in advance by testing or the like.

For example, in the case of weak sheets 36 whose thickness is small, such as groundwood paper, compared with thick paper or similar which is heavier, the sheet mass is lighter and there is little slippage relative to the transport belt 108. Therefore, the transport speed is set taking into account the transport stop timing of the transport belts 108, which is explained later. In other words, when the sheet 36*a* that has been printed on the front side is released from the movable guide 81, and the leading edge of the sheet 36*a* is brought into contact with the stopper surface 53*a* of the stopper member 53 and stops on account of the transport belts 108, the subsequent waiting time until the sheet 36*a* is transported at a predetermined timing by the sheet re-supply resist roller 51 is minimized.

If the sheet 36 is light and thin, the transport stop timing of the transport belt 108 is set on the early side. Conversely, if the sheet 36 is heavy and thick, the transport speed is set higher in anticipation of slippage relative to the transport belt 108, and the transport stop timing is set on the late side.

Besides the ROM 102, it is possible to use a programmable PROM, or the like. In this way, if it becomes necessary due to design changes or similar, the related data can be read in.

The RAM 103 has the function of temporarily storing calculation results of the CPU 101, and the function of storing at any time settings and input data from the various keys of the operation panel 173 and the various sensors, and ON and OFF signals.

The control device 100 determines the rotational speed of the plate cylinder 1 when necessary, based on plate cylinder position signals from the plate cylinder position detection sensor 29. In addition, the control device 100 determines the rotational position (rotation phase position) of the plate cylinder 1 in real time.

The control device 100 varies the transport speed of the transport belts 108 of the sheet re-supply transport device 104, in accordance with the sheet type. In addition, the control device 100 has the function as control means for varying the transport stop timing of the transport belts 108 after contact of the leading edge of the sheet 36*a* that has been printed on the front side with the stopper member 53. The transport operation of the transport belts 108 of the sheet re-supply transport device 104 includes transport until the sheet 36*a* contacts the stopper member 53, and transport when sheet re-supply starts and the sheet is removed from the stopper member. The transport speeds should be set separately for these two transport operations in accordance with the sheet type.

In other words, the control device 100 has the function as control means to control the belt drive motor 105 to vary the transport speed of the transport belts 108 of the sheet re-supply transport device 104, in accordance with the sheet type selected and set using the sheet type setting key 186, the enter key 180, and the four direction keys 184. In addition, the control device 100 has the function to control the belt drive motor 105 to vary the transport stop timing of the transport belts 108 after contact of the leading edge of the sheet 36*a* that has been printed on the front side with the stopper member 53*a*, in accordance with the sheet type selected and set using the sheet type setting key 186, the enter key 180, and the four direction keys 184.

In further detail, based on the sheet type data signal associated with the sheet type selected and set using the sheet type setting key 186, the enter key 180, and the four direction keys 184, the control device 100 has the function as control means to call up from the ROM 102 a data table for varying the transport speed of the transport belts 108 set in accordance with the sheet type for each printing speed, a data table for varying the stop timing of the belt drive motor 105, and a data table for varying the drive start timing of the transport belts 108 when re-supplying sheets. By extracting the rotational speed of the belt drive motor 105 and the stop timing after contact of the sheet 36*a* that has been printed on the front side with the stopper surface 53*a*, in accordance with the sheet type, the belt drive motor 105 is controlled so that the transport speed of the transport belts 108 corresponds with that for the selected and set sheet type, and the transport stop timing of the transport belts 108 corresponds with that for the selected and set sheet type.

Based on the configuration described above, the operation including the operating sequence of the double-sided stencil printing apparatus 300 according to the present embodiment is explained with reference to FIGS. 1 through 14. This operation is carried out under the control of the control device 100. Therefore, when explaining the detailed operation of the various motors, solenoids, actuators, and so on, including start up, operation, and stopping, expressions to the effect that these operations are based on instructions or command signals from the control device 100 have been omitted as much as possible.

OPERATION EXAMPLE 1

First, operation example 1 is explained, in which the single-sided printing mode is set and single-sided printing is carried out. Operation example 1 is virtually the same as the operation of carrying out single-sided printing in a conventional stencil printing apparatus. Also, the operation is substantially the same as carrying out single-sided printing as disclosed in Prior Art 7, so the explanation is simplified. In the single-sided printing operation, printing pressure range pattern III is used, and for normal printing the cam plate 243A from among the constituent elements of the printing pressure range variation means 28 is selected and used. For ease of understanding each operation in operation example 1, the master size is A3 size, and the document and sheet sizes are also A3 size.

The user stacks A3 size sheets 36 as the sheet size to be used for printing, in the sheet supply tray 35. The pressure plate 142 is opened, the A3 size document that is to be printed is loaded on the contact glass 135, and again the pressure plate 142 is closed. Then, after setting the plate making conditions with various keys on the operation panel 173, the single-sided printing key 188 is pressed to set the single-sided printing mode.

After the user confirms that the single-sided printing mode is set from the LED 188*a*, the plate making start key 174 is pressed. When the plate making start key 174 is pressed, the sheet size detection signal from the sheet size detection sensor 117, and the document size detection signal from the document size detection sensor 149 are sent to the control device 100. The control device 100 compares the signals received. In this case, if the sheet size and the document size are the same, the image reading operation is immediately carried out. If the sheet size and the document size are different, the control device 100 displays a warning to this effect on the display device 190, to bring this fact to the attention of the user.

In the single-sided printing mode, the switching guide 46 is maintained static in the home position which is the first displacement position (initial position) shown in FIG. 1 and elsewhere. When the plate making start key 174 is pressed, a start signal is generated, and when this start signal is input to the control device 100 the series of operations from plate discharge to sheet discharge is automatically carried out. Before and after this, the sheet supply tray 35 is raised when the sheet supply tray raising and lowering motor is turned on. When the uppermost sheet 36 contacts the sheet supply roller 33, the control device 100 determines from the ON detection of a sheet supply position detection sensor, which is not shown in the drawings, that the uppermost sheet 36 is in the state that it can be supplied, and the sheet supply device 30 enters the sheet supply standby state.

First, the plate discharge operation, in which the used master is separated from the outer peripheral surface of the plate cylinder 1 is carried out in the plate discharge unit 17. When the start signal is input to the control device 100, the plate cylinder 1 starts to rotate. When the plate cylinder 1 reaches the home position in which the clamper 7 is virtually at the top, operation of the main motor 20 stops, and the plate cylinder 1 stops in the plate discharge position. Next, the plate discharge drive means 126 operates, and each roller 164, 167 are driven to rotate. In addition, the lower plate discharge member 161 is moved towards the plate cylinder 1, and the endless belt 169 positioned on the outer peripheral surface of the driven roller 168 contacts the used master. After the operation of the plate discharge drive motor 126, the main motor 20 starts up, and the used master is separated from the plate cylinder 1 and taken and transported between the lower plate discharge member 161 and the upper plate discharge member 160 by the rotation of the plate cylinder 1 and the movement of the endless belt 169. After the separated used master has been disposed into the plate discharge box 162, the separated used master is compressed by the compression plate 163.

After the used master has been completely separated from the outer peripheral surface of the plate cylinder 1, the plate cylinder 1 continues to rotate, and stops rotating at the plate supply standby position, when the clamper 7 is in virtually the topmost position. Simultaneously the clamper 7 is opened by the operation of an opening device, which is not shown in the drawings, and the double-sided stencil printing apparatus 300 enters the plate supply standby state.

In parallel with the plate discharge operation, the operation of reading the document image is carried out in the document reading unit 18. Reading the document image is carried out by reflecting the reflected light of the fluorescent light 145 by the reflection mirrors 143, 144, and after the reflected light from the read document image is focused by the lens 146, the light is input to the image sensor 147 and photoelectric conversion is carried out. The photoelectric converted electric signal is input to an A/D conversion device, which is not shown on the drawings, within the main body frame 130. Then the signal is transmitted to a thermal head drive circuit, which is not shown on the drawings, via a plate making control device (which may be disposed within the control device 100), which is not shown on the drawings.

The plate making operation is carried out in the plate making unit 15, partially in parallel with the plate discharge operation and the image reading operation. In other words, the digital image signals for heating drive control of the heating elements of the thermal head 11 are transmitted to the thermal head 11 via the plate making control device and the thermal head drive circuit. In this way, the heating elements in the thermal head 11 are selectively heated by electrification with pulses in the main scanning direction. In this way the thermoplastic resin film portion of the master 8 is selectively thermally stenciled in accordance with the image information, while the platen roller 9 and the pair of transport rollers 13 start to rotate as a result of rotational drive from the master drive motor 10, and the master 8 is fed out from the master roll 8*a* and transported in the master transport direction X1.

Then the leading edge of the stenciled master 8Y is guided by the master guide plate 14 and inserted between the clamper 7 which is open relative to the stage 6. When the number of steps of the master transport motor 10 reaches a predetermined value, it is determined that the leading edge of the stenciled master 8Y has arrived between the stage 6 and the clamper 7. Then the clamper 7 is closed by the opening and closing device, and the leading edge of the stenciled master 8Y is fixed and held between the stage 6 and the clamper 7.

After clamping the leading edge of the stenciled master 8Y, the plate cylinder 1 starts to rotate again due to the rotational drive of the main motor 20, with a circumferential speed that is virtually the same as the master transport speed. The stenciled master 8Y is transported by the platen roller 9 and the pair of transport rollers 13 and supplied to be wound around the outer peripheral surface of the plate cylinder 1. When the rotational drive of the master transport motor 10 reaches a predetermined number of steps, it is determined that the plate making on the master 8 and the set amount of transport of the stenciled master 8Y has been completed. Therefore the cutter 12 is operated and the stenciled master 8Y is cut. In addition, rotation of the platen roller 9 and the pair of transport rollers 13 stops as a result of the master transport motor 10 stopping. The trailing edge of the cut stenciled master 8Y is pulled out of the plate making unit 15 by the rotation of the plate cylinder 1. At the stage where the stenciled master 8Y is fully wound around the outer peripheral surface of the plate cylinder 1, winding the stenciled master 8Y around the plate cylinder 1 is complete, so the plate supply operation terminates.

When winding the stenciled master 8Y around the plate cylinder 1 is finished, the plate cylinder 1 again starts to rotate at a predetermined circumferential speed in the direction of the arrow shown in FIG. 1. With this the sheet supply and printing processes for the plate installation operation start. The solenoid 62 of the latching means 64 is maintained off by the control device 100 until the leading edge of the sheet 36 intercepts and passes the sheet detection sensor 32, in other words, until the leading edge of the sheet 36 is detected by the sheet detection sensor 32. Therefore, the printing pressure range variation means 28 is in the non-operational state, and as a result the press roller 21 is maintained in the non-printing position, in other words, the initial position separated from the outer peripheral surface of the plate cylinder 1.

The plate cylinder 1 rotates at low speed in the direction of the arrow. First, the sheet supply start light shield plate 121 engages with the sheet supply resist sensor 120, as shown in FIG. 10, the sheet supply resist sensor 120 turns on, and generates a sheet supply start signal. Using this signal as a trigger, the sheet supply motor 37 starts up (starts to drive and rotate). As a result of the rotation of the sheet supply motor 37 in the clockwise direction of FIG. 11, the sheet supply roller shaft 33*a* and the sheet supply roller 33 rotate in the clockwise direction via the operation of the mechanism shown in FIG. 11. The uppermost sheet 36 in the sheet supply tray 35 in contact with the sheet supply roller 33 is transported and separated as a single sheet by the cooperative action with the separating member 34, and transported towards the nip portion of the pair of resist rollers 31 downstream in the sheet transport direction X.

Next, the plate cylinder 1 rotates further in the direction of the arrow in FIG. 1. When the resist start light shield plate 122 engages with the sheet supply resist sensor 120, the sheet supply resist sensor 120 turns on and generates a resist start signal. Using this signal as a trigger, the resist motor 41 starts up. The timing of the start up of the resist motor 41, in other words the timing of driving the rotation of the lower resist roller 31*b*, is set so that it is the specific timing that the leading edge of the image area of the single-sided stencil image 8YA of the stenciled master 8Y in the direction of rotation of the plate cylinder 1 reaches the position corresponding to the press roller 21.

The resist motor 41 is driven to rotate in the counterclockwise direction in FIG. 11, and rotate the lower resist shaft 31*c* and the lower resist roller 31*b* in the counterclockwise direction via the operation of the mechanism shown in FIG. 11. The leading edge of the sheet 36 that contacts and is on standby at the nip portion of the pair of resist rollers 31 is transported while being pressed against by the upper resist roller 31*a*, and is transported between the plate cylinder 1 and the press roller 21.

Next, when the leading edge of the sheet 36 propelled forward by the pair of resist rollers 31 has normally penetrated, in other words, when the leading edge of the sheet 36 has been detected by the sheet detection sensor 32 within a predetermined time measured by the timer (or within a predetermined number of pulses provided by the resist motor 41), this signal is input to the control device 100. Based on the detection signal of the leading edge of the sheet 36 from the sheet detection sensor 32 and rotational position information of the plate cylinder 1 from the plate cylinder position detection sensor 29, the control device 100 outputs a command signal to electrify the solenoid 62 of the latching means 64. As a result the solenoid 62 is turned on, and the cam plate 243A of the printing pressure range variation means 28 is operated.

As a result of turning the solenoid 62 on, the plunger 62*a* is pulled in, and the latching member 60 is swiveled in the counterclockwise direction about the support shaft 61, against the resistance of the impelling force of the tension spring 63. When the latch is released, the second end of the printing pressure arm 22 which is latched to the latching claw 60*a* by the notch 22*b* swivels in the clockwise direction about the arm shaft 22*a* by the impelling power of the printing pressure spring 242. As a result of the second end of the printing pressure arm 22 swiveling, the outer peripheral surface of the cam follower 241 comes into opposition with but without contacting the peripheral surface of the small diameter portion of the cam plate 243A which rotates in synchronization with the rotation of the plate cylinder 1. The pair of printing pressure arms 22 swivel in the clockwise direction about the arm shaft 22*a* and rise up as a result of the impelling force of the printing pressure spring 242 at the rotation position (for example, the rotation position shown in FIG. 3) of the cam plate 243A.

In this way, as shown in FIG. 9, the outer peripheral surface of the press roller 21 displaces to the printing position and applies printing pressure to the sheet 36 to press against the leading edge blank portion slightly to the left of the single-sided stencil image 8YA of the stenciled master 8Y wound around the front side area 1A through to the reverse side area 1B of the plate cylinder 1 as shown in FIG. 1, to form the nip portion 16*a* (see for example FIG. 3). At the same time, the press roller drive motor 55 rotates the press roller 21 with a circumferential speed that is virtually the same as the circumferential speed of the plate cylinder 1. The press roller 21 continuously presses the sheet 36 against the stenciled master 8Y on the plate cylinder 1 while rotating in the opposite direction to the direction of rotation of the plate cylinder 1. The stenciled master 8Y is closely wound around the outer peripheral surface of the plate cylinder 1, so ink fills the stenciled master 8Y, or so-called installation of the master is carried out. In this process, ink penetrates from the porous portion 1*a* of the plate cylinder 1 to the perforated portions of the stenciled master 8Y, and is transferred onto the surface of the sheet 36 so that stencil printing is carried out.

At this time, the ink roller 2 rotates in the same direction as the direction of rotation of the plate cylinder 1. The ink in the ink pool 4 adheres to the surface of the ink roller 2 due to the rotation of the ink roller 2, and is regulated when it passes through the gap between the ink roller 2 and the doctor roller 3, and supplied to the inner peripheral surface of the plate cylinder 1. On the other hand, the sheet re-supply transport device 104, coupled with the rising and lowering action of the press roller 21, swivels about the drive shaft 107*a* via the sheet re-supply frame 110. In the single-sided printing mode, the belt drive motor 105 and the suction fan 109 of the sheet re-supply transport device 104 do not operate. In addition, the drive motor 94 of the moving means 87 does not operate, and the movable guide 81 occupies the initial position P2.

In this way, printing of the single-sided stencil image 8YA of the stenciled master 8Y on the plate cylinder 1 is carried out. The plate cylinder 1 rotates further, and at the trailing edge blank portion slightly to the right of the trailing edge of the single-sided stencil image 8YA, the large diameter portion of the cam plate 243A which rotates in synchronization with the plate cylinder 1 contacts the outer peripheral surface of the cam follower 241. In this way, the pair of printing pressure arms 22 swivel about the arm shaft 22*a* in the counterclockwise direction against the resistance of the impelling force of the printing pressure spring 242. In addition, the press roller 21 is displaced downwards to occupy the non-printing position, and the state of applying printing pressure by the press roller 21 is eliminated.

As the plate cylinder 1 rotates in the direction of the arrow in FIG. 1, when the clamper 7 approaches the position where the press roller 21 is in contact with the plate cylinder 1, the cam plate 243A which rotates in synchronization with the rotation of the plate cylinder 1 rotates to the position where the peripheral surface of the large diameter portion of the cam plate 243A contacts the cam follower 241. Therefore, the press roller 21 separates from the clamper 7 which projects from the outer peripheral surface of the plate cylinder 1, and interference between the press roller 21 and the clamper 7 is avoided.

The single-sided printed sheet 36*c* is further transported by the rotation of the plate cylinder 1 in the direction of the arrow in FIG. 1, while being pressed by the press roller 21. The leading edge of the single-sided printed sheet 36*c* is positively separated from the stenciled master 8Y on the plate cylinder 1 by the separation claw 170 which is close to the outer peripheral surface of the plate cylinder 1 and by the air blown from the separation fan 171. The separated single-sided printed sheet 36*c* drops downwards and is transported by the sheet discharge belt 158 of the sheet discharge transport device 152. The single-sided printed sheet 36*c* is held by the suction force of the suction fan 159 on the top surface of the sheet discharge belt 158 which rotates in the direction of the arrow in FIG. 1 (the counterclockwise direction) and is transported downstream in the sheet transport direction X. The single-sided printed sheet 36*c* is then discharged into the sheet discharge tray 172 while being arranged on both sides by a pair of sheet discharge end fences 172*a*, 172*b*.

On the other hand, when the plate cylinder 1 has rotated through about ¾ of a revolution from the time of contact of the press roller 21 with the plate cylinder 1, when the large diameter portion of the peripheral surface of the cam plate 243A contacts the cam follower 241, in other words at the time when the latching claw 60*a* and the notch 22*b* of the printing pressure arm 22 can be latched together, electrical power to the solenoid 62 is turned off by a command from the control device 100. Then the latching member 60 swivels in the clockwise direction about the support shaft 61 due to the impelling force of the tension spring 63, and the latching claw 60*a* is latched onto the notch 22*b* of the printing pressure arm 22. In this way, the press roller 21 is restored to and maintained at the non-printing position where it is separated from the outer peripheral surface of the plate cylinder 1. In addition, the plate cylinder 1 rotates again to the home position, and stops. After completion of the printing operation, the double-sided stencil printing apparatus 300 enters the printing standby status.

Also, during the sheet supply and installation of the master operations, the platen roller 9 and the pair of transport rollers 13 start to rotate again, and transport the leading edge of the cut master 8 is transported towards the nip portion of the pair of transport rollers 13. When it is determined from the number of pulses of the master transport motor 10 that the leading edge of the cut master 8 has arrived at and is held in the nip portion of the pair of transport rollers 13, rotation of the platen roller 9 and the pair of transport rollers 13 is stopped, the plate making standby state in preparation for the next plate making operation is established.

After the double-sided stencil printing apparatus 300 enters the printing standby state, the printing conditions are set with the printing speed setting key 183 and various other keys on the operation panel 173. Then the trial print key 176 is pressed to carry out a trial print. When the trial print key is pressed, the plate cylinder 1 is driven to rotate at the set printing speed, and one sheet 36 is supplied from the sheet supply unit 30. After the supplied sheet 36 is temporarily stopped at the pair of resist rollers 31, the sheet 36 is supplied at the same timing as for the installation of the master operation, and pressed against the stenciled master 8Y on the outer peripheral surface of the plate cylinder 1 by the press roller 21. The single-sided printed sheet 36*c* on which the printed image is formed is positively separated from the stenciled master 8Y on the plate cylinder 1 by the separation claw 170 and the separation fan 171, the same as described above. The separated single-sided printed sheet 36*c* is transported by the sheet discharge transport device 152 with the same operation as described above, and discharged into the sheet discharge tray 172.

With the setting of the printing speed, the speed or timing of drive means subject to control such as the drive motors or solenoids in the printing pressure range variation means 28, the sheet supply unit 30, the sheet discharge transport device 152, and so on, are controlled to be compatible with the printing speed. Using the trial print, the image position, the density, and so on, are checked. Then the number of sheets to be printed is input using the numerical keypad 179, and the print start key 175 is pressed. Then sheets 36 are continuously fed from the sheet supply unit 30, and the printing operation is carried out the same as the trial print operation. Then, when the set number of printed sheets is used, the plate cylinder 1 stops at the home position, and the double-sided stencil printing apparatus 300 again enters the printing standby state. In normal printing operations, the main differences compared with the printing operation when installing the master are only that the number of sheets 36 used in printing when installing the master are not counted as normal printed sheets, and each operation such as sheet supply and printing is carried out at a speed corresponding to the printing speed set by the user.

Sheet detection means equivalent to the sheet detection sensor 32 described above may be disposed on the transport path to detect the leading edge and the trailing edge of the sheets 36*c* that have been printed on the front side and being held on the outer peripheral surface of the press roller 21 and being transported through the nip portion 16*a*. Besides the operation described above, the reading operation in the image reading unit 18 may also use the ADF 148. In this case the point of difference from operation example 1 is only the following point. The user sets the A3 size document 133 in the document receiving platform 134 of the ADF 148. Then in parallel with the plate discharge operation the ADF 148 of the image reading unit 18 transports one sheet of the document 133 to the contact glass 135 which is the reading unit. Thereafter the image of the document 133 is read as optical information by the operation of the scanner device 132, as described above.

OPERATIONS EXAMPLE 2

Next, operation example 2 in which the double-sided printing mode is set and double-sided printing is carried out is explained. Operation example 2 uses all the printing pressure ranges I, II, III shown in FIG. 9. For this purpose all the cam plates 243A, 243B, 243C of the multi-stage cam 243 that forms one element of the printing pressure range variation means 28 are used. In operation example 2, for ease of understanding each operation, the master size is A3 size, but the document size and the sheet size is A4. Hereinafter, explanation mainly on features different from those of the operation example 1 is provided. The user stacks A4 size sheets 36 in the sheet supply tray 35, for use in printing. The pressure plate 142 is opened, the first A4 size document to be printed on the front side is placed on the contact glass 135, and the pressure plate 142 is closed again. Then, the user presses the sheet type setting key 186 of the operation panel 173, and all the sheet types that are used in the double-sided stencil printing apparatus 300 are displayed in the operation panel 173. Then using the four direction keys 184, for example "groundwood paper" which is classified as a thin paper is selected as the sheet type to be used in double-sided printing, and is displayed with black and white reversed. Finally the enter key 180 is used to confirm the selection. Further, after setting the plate making and printing conditions using various keys on the operation panel 173, the double-sided printing key 187 is pressed to set the double-sided printing mode. Then, the user confirms that the double-sided printing mode has been set from the LED 187*a*. Next, the plate making start key 174 is pressed, and a start signal is generated and input to the control device 100, the same as for single-sided printing.

As in operation example 1, the sheet size detection signal from the sheet size detection sensor 117, and the document size detection signal from the document size detection sensor 149 are transmitted to the control device 100. The control device 100 compares the two signals received. In the present embodiment, the maximum sheet size that can be printed with the plate cylinder 1 during single-sided printing is A3 size in landscape format. Therefore, in double-sided printing up to A4 size sheets can be used in portrait format.

If the result of the comparison is that the document size and the sheet size are both the same, the image reading operation is immediately carried out. If the two sizes are different, the control device 100 displays a warning to this effect on the display device 190, to bring this fact to the attention of the user. In cases where the sheet size is larger than the A4 size in portrait format, the control device 100 prohibits double-sided printing and induces the display device 190 to display to the effect that single-sided printing is required.

When the plate making start key 174 is pressed, the series of operations from plate discharge to sheet discharge is carried out, similar to operation example 1. As in operation example 1, when the control device 100 determines that the topmost sheet 36 in the sheet supply tray 35 is in the state where it can be supplied, the sheet supply unit 30 enters the sheet supply standby state. After completion of the plate discharge operation similar to operation example 1, the plate cylinder 1 from which the used master has been removed stops in the plate supply standby position, and the clamper 7 is opened by the opening and closing device which is not shown in the drawings, the same as for operation example 1.

The operation of reading the document image of the first sheet for printing on the front side is carried out in the image reading unit 18, partially in parallel with the plate discharge operation, as in operation example 1. The image data signal is transmitted to the thermal head drive circuit via the plate making control device or similar. The plate making operation is carried out in the plate making unit 15 by the thermal head 11 as in operation example 1, partially in parallel with the image reading operation. The master 8 is drawn out from the master roll 8*a* by the rotation of the platen roller 9 and the pair of transport rollers 13, and transported in the master transport direction X1. At the same time the thermoplastic resin film portion of the master 8 is selectively stenciled by heating in accordance with the image information, and the front side stenciled image 8A for printing on the front side is formed on the front half portion of the master 8 (see the sub-divided stenciled master 8X shown in FIG. 9).

Then, the leading edge portion of the sub-divided stenciled master 8X is guided by the master guide plate 14, and inserted between the clamper 7 which is open with respect to the stage 6. When the number of steps of the master transport motor 10 reaches a predetermined value, it is determined that the leading edge portion of the sub-divided stenciled master 8X has arrived between the stage 6 and the clamper 7. Then the clamper 7 is closed by the opening and closing device, and the leading edge portion of the sub-divided stenciled master 8X is fixed and held between the stage 6 and the clamper 7.

After the leading edge portion of the sub-divided stenciled master 8X is clamped, the main motor 20 starts up and the plate cylinder 1 again starts to rotate at a circumferential speed that is virtually the same as the master transport speed. The sub-divided stenciled master 8X is transported by the platen roller 9 and the pair of transport rollers 13 and supplied to be wound around the outer peripheral surface of the plate cylinder 1. When the control device 100 determines that stenciling the front surface stenciled image 8A of the sub-divided stenciled master 8X as shown in FIG. 9 is complete from the number of steps of the master transport roller 10, rotation of the platen roller 9, the pair of transport rollers 13, and the plate cylinder 1 is stopped. Then the plate making standby state is established in which the reverse side stenciled image 8B, for printing on the reverse side, is stenciled on the next sub-divided stenciled master 8X.

Next, the user again opens the pressure plate 142, and loads the second A4 size sheet that is to be printed on the reverse side on the contact glass 135, and closes the pressure plate 142 again. Then, the plate making start key 174 is pressed again, and a start signal is generated and input to the control device 100. At this time, similar to the case for the first sheet of the document, the document size and the sheet size are compared by the control device 100, and the same operation is carried out as described above. In the image reading unit 18, the reading operation for the document image for the second document image for printing on the reverse side is carried out the same as for the first sheet of the document. The image data signal is transmitted to the thermal head drive circuit via the plate making control device, which are not shown in the drawings. Plate making is carried out in the plate making unit 15 by the thermal head 11, same as for the first sheet of the document. The master transport motor 10 starts to rotate again, and rotate the platen roller 9 and the pair of transport rollers 13, which draws the master 8 out of the master roll 8*a* and transports it in the master transport direction X1. The thermoplastic resin film portion of the master 8 is selectively stenciled by heating in accordance with the image information, and the reverse side stencil image 8B for printing on the reverse side is formed on the rear half of the master 8 (see FIG. 9).

At this time, the plate cylinder 1 starts to rotate again at virtually the same circumferential speed as the master transport speed, drawing the rear half of the sub-divided stenciled master 8X from within the plate making unit 15 to be wound around the outer peripheral surface of the plate cylinder 1. Also, when it is determined by the control device 100 from the number of steps of the master transport motor 10 that stenciling of the final reverse side stencil image 8B of the sub-divided stenciled master 8X has been completed, the cutter 12 is operated, and the trailing edge portion of the sub-divided stenciled master 8X is cut. In addition, rotation of the platen roller 9 and the pair of transport rollers 13 is stopped, and the trailing edge of the sub-divided stenciled master 8X which has been cut to provide one plate master is completely pulled out from the plate making unit 15 by the rotation of the plate cylinder 1, and the operation of winding and providing the sub-divided stenciled master 8X onto the plate cylinder 1 is completed.

The operations of reading the document image and inputting the image data are not limited to the example described above. For example, the document 133 can be automatically fed to the contact glass 135 by the ADF 148, or image data can be input from an external device which is not shown on the drawings.

In the present embodiment, when stenciling of the front side stenciled image 8A of the sub-divided stenciled master 8X is completed, rotation of the platen roller 9 and the pair of transport rollers 13 in the plate making unit 15 and the plate cylinder 1 is temporarily stopped, and the plate making standby state is entered for stenciling the reverse side stenciled image 8B in the sub-divided stenciled master 8X for printing on the reverse side. However, the following is preferable. In addition to an operation to automatically transport the document 133 by the ADF 148, the second sheet of the document is scanned in advance, and image memory such as bit map memory or the like, which is not shown on the drawings, is provided to record and store the image data of the document image that was read. The image data for the first and second sheets of document is recorded and stored in the image memory. Plate making is then continuously carried out while calling up the image data in sequence from the image memory. This is preferable because the plate making time is shortened, which shortens the first print time (FPT).

After the plate supply operation, the operation of installation of the master is carried out. When the plate cylinder 1 stops at the home position, the control device 100 operates the printing pressure range variation means 28. In the following, when carrying out installation of the master corresponding to the front side stenciled image 8A of the sub-divided stenciled master 8X on the plate cylinder, or carrying out the first front side printing in the formal double-sided printing operation, the printing pressure range variation means 28 is controlled by instructions from the control device 100 to select the printing pressure ON timing by the press roller 21 of the printing pressure range pattern I of FIG. 9. In other words, a stepping motor 252 that is only shown in FIG. 14 is rotated, and via a commonly known detailed operation via the rotation of the stepped cam (49), the cam plate 243B is selected, and the outer peripheral surface of the cam plate 243B is brought into contact with the cam follower 241.

When winding of the sub-divided stenciled master 8X onto the plate cylinder 1 is completed, the plate cylinder 1 starts to rotate in the direction of the arrow shown in FIG. 3 at a predetermined circumferential speed (normally, a low speed for installation of the master). As in operation example 1, the solenoid 62 of the latching means 64 is controlled to be off until the leading edge of the sheet 36 is detected by the sheet detection sensor 32. Therefore, the printing pressure range variation means 28 is not operational, and the press roller 21 is maintained in the non-printing position.

The plate cylinder 1 rotates in the direction of the arrow, the same as in operation example 1. First, the sheet supply start light shield plate 121 engages with the sheet supply resist sensor 120 as shown in FIG. 10, and the sheet supply motor 37 starts up. The topmost sheet 36 in the sheet supply tray 35 in contact with the sheet supply roller 33 is transported, and one sheet is dispensed towards the nip portion of the pair of resist rollers 31 by the cooperative action of the separation member 34.

After the leading edge of the sheet 36 dispensed in this way contacts the nip portion of the pair of resist rollers 31, the leading edge portion of the sheet 36 is maintained in a predetermined curved state. Next, the plate cylinder 1 rotates further in the direction of the arrow in FIG. 1. When the resist start light shield plate 122 engages with the sheet supply resist sensor 120, the resist motor 41 starts up, as in operation example 1. Then the leading edge of the sheet 36 that was on standby in contact with the nip portion of the pair of resist rollers 31 is transported between the plate cylinder 1 and the press roller 21 by the rotation of the pair of resist rollers 31 at a predetermined timing. At this time, as in operation example 1, the normal advance of the leading edge of the sheet 36 by the pair of resist rollers 31 is detected by the sheet detection sensor 32.

Next, based on the detection signal of the leading edge of the sheet 36 from the sheet detection sensor 32 and the rotational position information for the plate cylinder 1 from the plate cylinder position detection sensor 29, the control device 100 turns the solenoid 62 on, as in operation example 1, and the printing pressure range variation means 28 operates the cam plate 243B. By turning the solenoid 62 on, the detailed operation of the latching means 64 is carried out, as in operation example 1. The outer peripheral surface of the cam plate 243B is brought into contact with the outer peripheral surface of the cam follower 241. Then when the rotational position of the cam plate 243B is such that the outer peripheral surface of the cam follower 241 is in opposition with the small diameter peripheral surface of the cam plate 243B but in a non-contacting state, the pair of printing pressure arms 22 swivel in the clockwise direction about the arm shaft 22*a* and rise due to the impelling force of the printing pressure spring 242.

In this way, as shown in FIG. 9, the outer peripheral surface of the press roller 21 displaces to the printing position and applies printing pressure to the sheet 36 to press against the leading edge blank portion slightly to the left of the front side stencil image 8A of the sub-divided stenciled master 8X wound around the front side area 1A of the plate cylinder 1 as shown in FIG. 1, to form the nip portion 16*a* (see the printing pressure ON timing of the press roller 21 in the printing pressure range pattern I shown in FIG. 9). At the same time, the press roller drive motor 55 rotates the press roller 21 with a circumferential speed that is virtually the same as the circumferential speed of the plate cylinder 1. The press roller 21 continuously presses sheets 36 against the front side stenciled image 8A portion of the sub-divided stenciled master 8X on the plate cylinder 1 while rotating in the opposite direction to the direction of rotation of the plate cylinder 1. The front side stenciled image 8A of the sub-divided stenciled master 8X is closely wound around the outer peripheral surface of the plate cylinder 1, so ink fills the sub-divided stenciled master 8X, or so-called installation of the master occurs. In this process, ink penetrates from the porous portion 1*a* of the plate cylinder 1 to the perforated portions of the sub-divided stenciled master 8X, and is transferred onto the surface of the sheet 36 so that stencil printing is carried out.

At this time, the ink roller 2 rotates in the same direction as the rotation direction of the plate cylinder 1, as in operation example 1. Therefore ink in the ink pool 4 is supplied to the inner peripheral surface of the plate cylinder 1. In this way installation of the master printing is carried out corresponding to the front side stenciled image 8A of the sub-divided stenciled master 8X on the plate cylinder 1. When the plate cylinder 1 rotates further and reaches the rotational position in which the portion near the trailing edge of the front side stenciled image 8A is in the nip portion 16*a*, the large diameter peripheral surface of the cam plate 243B contacts the cam follower 241, and the printing pressure arms 22 rotate in the counterclockwise direction about the arm shaft 22*a*, and the press roller 21 is maintained in the state of occupying the non-printing position. At this time, the solenoid 62 of the latching means 64 is already turned off by a command from the control device 100, so the press roller 21 is restored to and maintains the initial position which is the non-printing position.

In parallel with the installation of the master operation described above, after the clamper 7 of the plate cylinder 1 has passed the press roller 21 in the non-printing position, the solenoid 47 is turned on, and the switching guide 46 swivels in the counterclockwise direction about the shaft 47*a* and stops in the second displacement position, as shown in FIG. 3. At the same time, the drive motor 94 of the moving means 87 starts up (for example, starts to drive with positive rotation). The movable guide 81 moves upwards to the right from the initial position P2 (the standby position) to the moving position P1, guided by the four projections 81*c* in the guide grooves 88. In this way the movable guide 81 can clamp the leading edge of the sheet 36*a* that has been printed on the front side, as shown in FIG. 3. When the number of steps of the drive motor 94 reaches a predetermined number, the movable guide 81 reaches the moving position P1. As shown by the solid lines in FIG. 8, the release lever lower 83 contacts and rises up on the outer peripheral surface of the release cam 98. Therefore, the clamping claw 81*b* is swiveled in the clockwise direction, contact with the top surface of the holding platform 81*f* is eliminated, and the movable guide stops in the standby position.

When the movable guide 81 has stopped in the moving position P1, as shown in FIG. 3, the leading edge portion of the sheet 36*a* that has been printed on the front side is positively separated from the sub-divided stenciled master 8X (see FIG. 9) on the plate cylinder 1 by the action of the switching guide 46 which is stopped occupying the second displacement position and the separation fan 171 (see FIG. 1). The leading edge portion of the sheet 36*a* that has been printed on the front side is guided by the slanting surface of the clamping claw 81*b* provided on the movable guide 81 and inserted into the gap between the top surface of the holding platform 81*f* and the free end of the open clamping claw 81*b*. Next, the leading edge portion of the sheet 36*a* that has been printed on the front side butts up against and contacts the sheet contact surface 81*e* of the end fence 81*d*. When the leading edge portion of the sheet 36*a* that has been printed on the front side is inserted into the gap between the top surface of the holding platform 81*f* and the free end of the open clamping claw 81*b*, the drive motor 94 starts up (for example, starts to drive with reverse rotation) with virtually the same speed as the transport speed (virtually the same as the circumferential speed due to rotation of the plate cylinder 1 and the press roller 21) of the sheet 36*a* that has been printed on the front side. Hence the movable guide 81 starts to move downwards to the left towards the initial position P2.

At this time, in FIG. 8, the release lever lower 83 separates from the outer peripheral surface of the release cam 98, so the clamping claw 81*b* swivels in the counterclockwise direction due to the impelling force of the torsional coil spring. Therefore, the leading edge portion of the sheet 36*a* that has been printed on the front side is held and clamped between the free end of the clamping claw 81*b* and the top surface of the holding platform 81*f*. The movable guide 81 moves downwards to the left towards the initial position P2 with a speed of movement virtually the same as the transport speed of the sheet 36*a* that has been printed on the front side, with the leading edge portion of the sheet 36*a* that has been printed on the front side fixed and held as described above, and with the leading edge of the sheet 36*a* that has been printed on the front side butting against the sheet contact surface 81*e*.

As stated above, after the installation of the master printing corresponding to the front side stenciled image 8A on the sub-divided stenciled master 8X on the plate cylinder 1 is completed, the press roller 21 is restored to and maintained in the initial position which is the non-printing position, in the sheet supply standby state for the supply of the next sheet.

On the other hand, using FIG. 4 for explanation, the sheet 36*a* that has been printed on the front side, held and clamped between the free end of the clamping claw 81*b* and the top surface of the holding platform 81*f* of the movable guide 81, is transported towards the initial position P2 by the moving means 87. When the movable guide 81 reaches the initial position P2 and stops, this time the release lever upper 82 shown by double-dashed lines in FIG. 8 contacts the release pin 99, the clamping claw 81*b* is swiveled in the clockwise direction, and the leading edge portion of the sheet 36*a* that has been printed on the front side is released from being in the held and fixed state.

The rear portion of the sheet 36*a* that has been printed on the front side is drawn to and held by the action of the sheet re-supply transport device 104. At this time it is desirable that the leading edge of the sheet 36*a* that has been printed on the front side be released from between the free end of the clamper 81*b* and the top surface of the holding platform 81*f*, so that there be little disturbance to the sheet 36*a* that has been printed on the front side so that the positional accuracy of the sheet 36*a* is improved, and subsequent deviation from the printing position is maintained at a minimum.

When the trailing edge of the sheet 36*a* that has been printed on the front side has passed the switching guide 46, the solenoid 47 is turned off. As a result the switching guide 46 is swiveled by the impelling force of the tension spring about the shaft 46*a* in the clockwise direction and restored to the first displacement position (initial position), as shown by the solid lines in FIG. 1, and stops.

In accordance with a command from the control device 100, first the suction fan 109 of the sheet re-supply transport device 104 is driven. As a result the reverse side with no printed image of the sheet 36*a* that has been printed on the front side is drawn to the top surface of the transport belts 108 and temporarily held there. Next, as shown in FIG. 4, the belt drive motor 105 is driven to rotate with a particular rotational speed corresponding to the sheet type in the opposite direction to the direction up till this point in time. Then immediately afterwards, the belt drive motor 105 is temporarily stopped at a particular timing corresponding to the sheet type. In other words, the rear transport roller 107 rotates in the clockwise direction so that the transport belts 108 transport the leading edge in the new direction of movement of the sheet 36*a* that has been printed on the front side at a transport speed that corresponds with the sheet type (for example, in the present operation example, groundwood paper) to contact the stopper surface 53*a*. Immediately after the leading edge of the sheet 36*a* that has been printed on the front side contacts the stopper surface 53*a*, transport is stopped at a timing that corresponds to the sheet type. The belt transport motor 105 is controlled so that the occurrence of bending of the leading edge portion of the sheet 36*a* that has been printed on the front side, due to the energy with which the sheet 36*a* that has been printed on the front side contacts the stopper surface 53*a*, is made as small as possible.

Next, when it is determined by the control device 100 based on rotational position information of the plate cylinder 1 from the plate cylinder position detection sensor 29 that the plate cylinder 1 is in a predetermined position, the solenoid 73 is turned on. The predetermined position is that rotational position of the plate cylinder 1 at which the reverse side of the sheet 36*a* that has been printed on the front side can be printed, corresponding to the reverse side stenciled image 8B of the sub-divided stenciled master 8X on the plate cylinder 1. As a result the sheet re-supply resist roller 51 is raised towards the outer peripheral surface of the press roller 21. The contact of the leading edge portion of the sheet 36*a* that has been printed on the front side with the stopper surface 53*a* is eliminated, and the leading edge portion of the sheet 36*a* that has been printed on the front side is pressed against and makes contact with the outer peripheral surface of the press roller 21. Also, at the same time the press roller drive motor 55 is driven to rotate, as shown in FIG. 2, and the press roller 21 is rotated in the counterclockwise direction. The sheet 36*a* that has been printed on the front side is pressed between the press roller 21 which rotates in the counterclockwise direction and the sheet re-supply resist roller 51 which is driven by the press roller 21 to rotate in the clockwise direction. As a result of the rotational power of the press roller 21, the sheet 36*a* that has been printed on the front side is transported at virtually the same circumferential speed as the circumferential speed of the plate cylinder 1, and guided along the outer peripheral surface of the press roller 21 by the roller guide plate 50. The sheet 36*a* that has been printed on the front side is then transported towards the nip portion 16*a* formed by the contact of the plate cylinder 1 and the press roller 21 with front and reverse sides reversed.

The sheet 36*a* that has been printed on the front side is drawn to the transport belts 108 with a comparatively weak force by the action of the suction fan 109. Therefore, when the transport belt 108 stops, and when the sheet 36*a* that has been printed on the front side which is held between the sheet re-supply resist roller 51 and the press roller 21 starts to move, frictional resistance is generated between the trailing edge portion of the sheet 36*a* that has been printed on the front side and the transport belts 108, and slippage occurs between the sheet 36*a* and the press roller 21. Therefore, it is necessary to start driving the transport belts 108 at appropriate timing.

Basically, it is preferable that the sheet 36*a* that has been printed on the front side starts to move after the time that the contact between the leading edge portion of the sheet 36*a* that has been printed on the front side and the stopper surface 53*a* has been eliminated. This timing is a predetermined period of time after the operation command signal of the sheet re-supply resist roller 51, which is characteristic of the device, and which can be determined from tests. Alternatively, detection means may be disposed to detect the contact of the press roller 21 and the sheet re-supply resist roller 51 via the sheet 36*a*, and the detection means may be used to start driving the transport belts 108. Detection means for detecting contact could be a sensor that detects the position of the sheet re-supply resist roller 51. For example, an optical sensor indicated by the reference numeral 71*a* in FIG. 5 can be made to detect a part of the swivel arm 71, and adjusted so that the sensor provides an output when the sheet re-supply resist roller 51 arrives at the position where it contacts the press roller 21.

As a general rule, the transport belts 108 are driven at the same speed as the circumferential speed of the plate cylinder 1, however there is no particular problem if the speed is slightly faster. If the speed is too fast, too much bending occurs between the transport belts 108 and the sheet re-supply resist roller 51, which causes creases, so about +20% is the limit. Conversely, if the transport belts 108 are driven slower than the circumferential speed of the plate cylinder 1, the frictional resistance will be small provided that difference is small, so about −20% is permissible.

If the belt drive motor 105 is a stepping motor, if the printing speed is low it is possible to reach the standard speed in a comparatively short period of time. However, if the printing speed is fast, a certain amount of time is required to reach the standard time.

Figure 16:
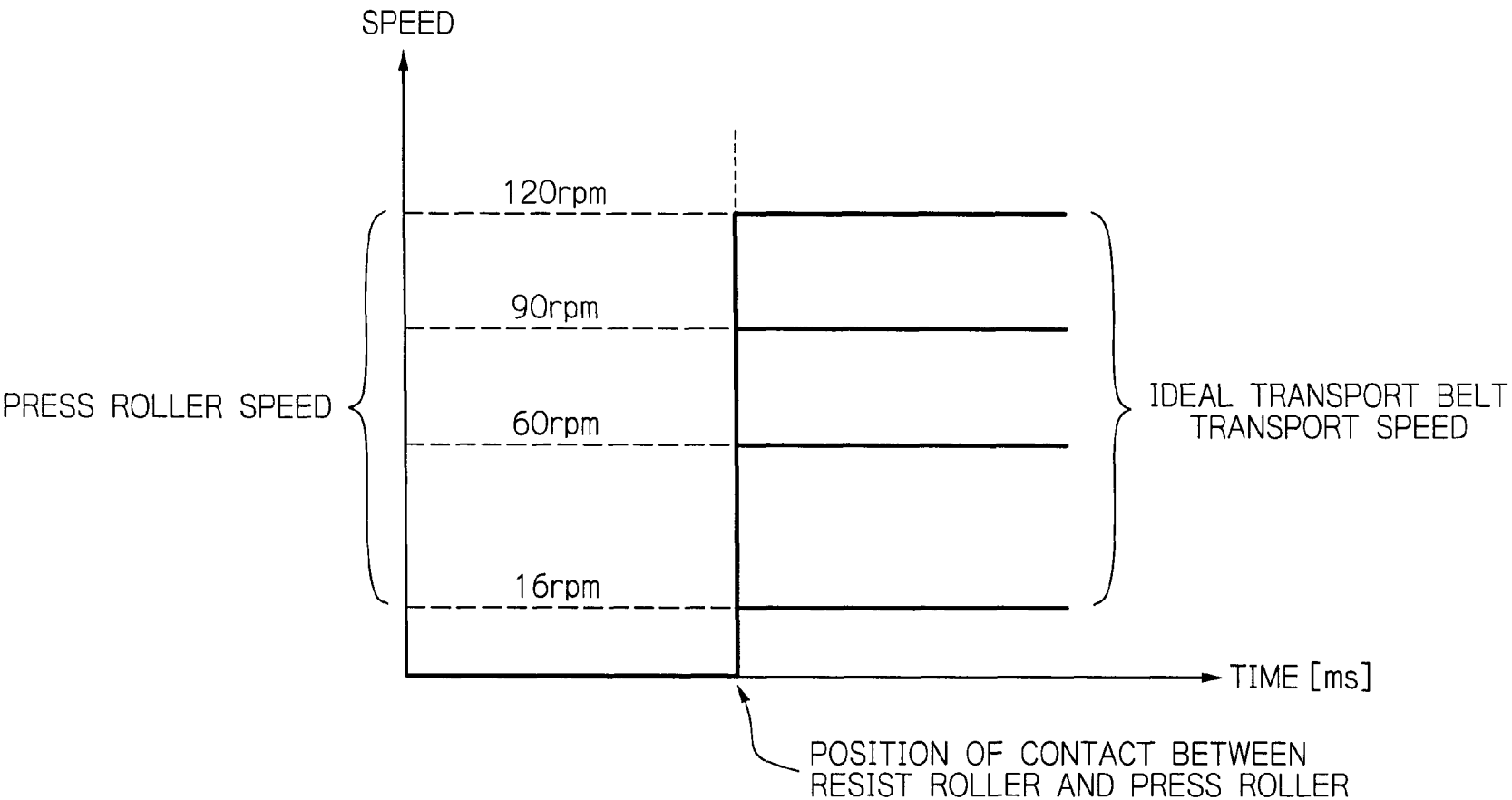
FIG. 16 is a schematic diagram showing the start up speed of the transport belt showing the ideal state.
Figure 17:
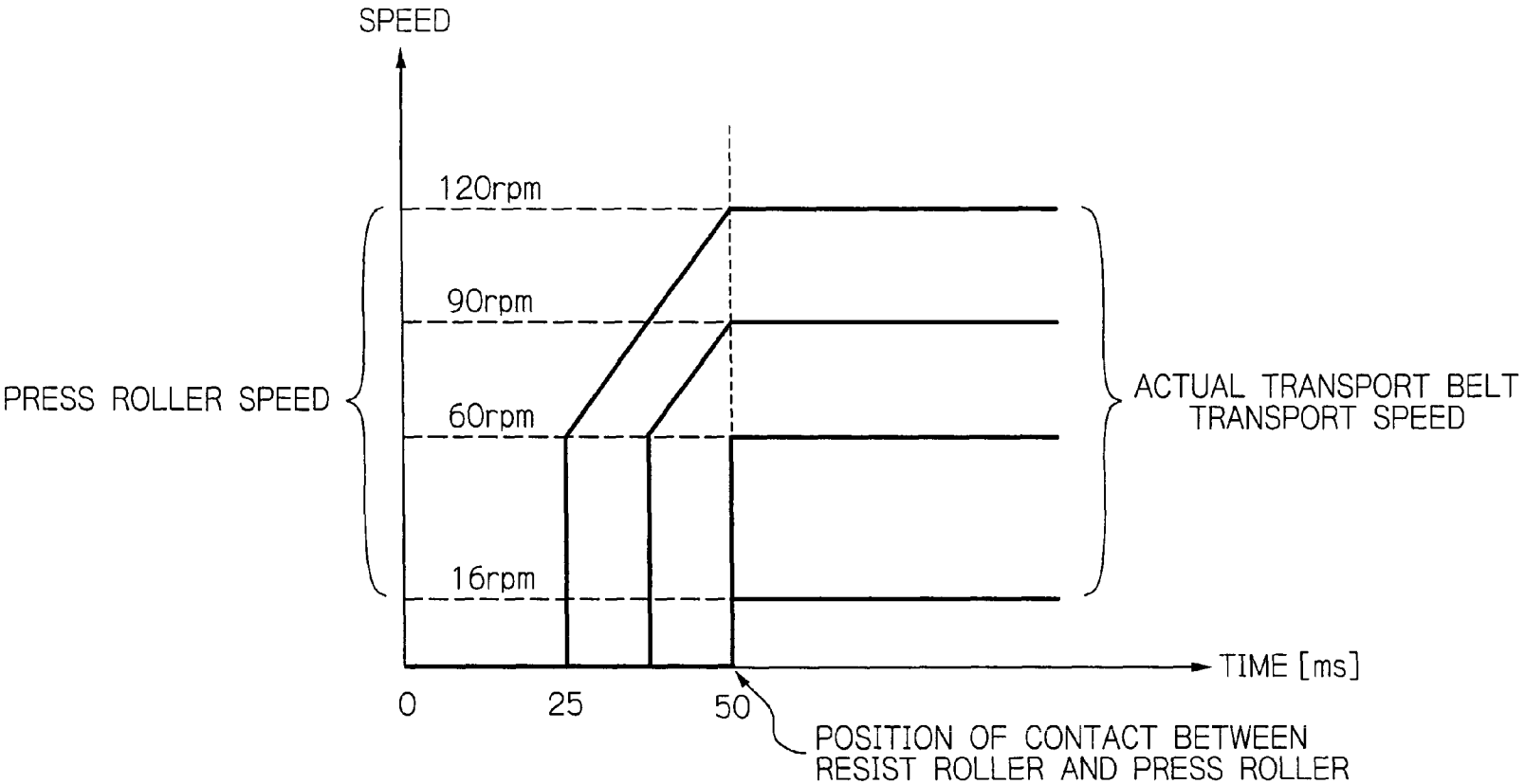
FIG. 17 is a schematic diagram showing the actual speed at start up of the transport belt.

FIGS. 16 and 17 are line diagrams showing the drive start up speed of the transport belts 108. FIG. 16 is a schematic diagram showing the ideal situation, while FIG. 17 is a schematic diagram showing the actually occurring speeds. In both figures the belt speed is conceptually indicated by thick lines.

In the case of the low printing speeds at 16 rpm and 60 rpm, the standard speed is reached without a delay being indicated on the graph.

In the case of the high printing speeds at 90 rpm and 120 rpm, although at 60 rpm the rise in speed is almost instantaneous, thereafter the speed increases at a virtually constant rate of acceleration until the standard speed is reached. Therefore, when the printing speed is high, if the transport belts 108 start to be driven at the instant that the sheet re-supply resist roller 51 contacts the press roller 21, the movement speed of the sheet 36*a* will not be able to catch up. Therefore, the motor is started up early by the characteristic predetermined period of time, so that at the instant that the sheet re-supply resist roller 51 contacts the press roller 21, the transport belt will have just attained the standard speed.

If the printing speed is low, then the output of the detection means for detecting contact between the sheet re-supply resist roller 51 and the press roller 21 may be used to drive the transport belts 108. However, if the printing speed is high, the rate of increase of the speed of the transport belts 108 will be insufficient.

In the present embodiment, it is known that the delay time from applying the operation command signal to the solenoid 73 for contact between the sheet re-supply resist roller 51 and the press roller 21 until actual contact occurs is about 50 ms, although there is a certain amount of variation. Therefore, in the case of high speed printing, the application of the operation command signal to the solenoid 73 may be used as a criterion. If the printing speed is 120 rpm, when the operation command signal is applied to the solenoid 73, the transport belts 108 are driven after a delay of 25 ms from this criterion. In other words, the transport belts 108 are driven after a time lag of 25 ms. If the printing speed is 90 rpm, the transport belts 108 are driven after a time lag of about 38 ms after the operation command signal is applied to the solenoid 73. In this way, at the instant that the sheet 36*a* starts to move, the transport belt 108 is moving at virtually the same speed as the circumferential speed of the plate cylinder 1. Even if the transport belt 108 is driven early, the sheet 36*a* is stopped by the stopper 53, so movement does not start.

The same method may also be used if the printing speed is low. In other words, if the printing speed is 16 rpm or 60 rpm, using the operation command signal to the solenoid 73 as a criterion, the transport belts 108 may be driven after a time lag of 50 ms.

The amount of variation in the operation delay time 50 ms of the solenoid 73 is sufficiently smaller than +20%, so there is no problem with adopting this method.

In the above explanation, an example was explained where the range over which the delay time in starting to drive the transport belts 108 could be ignored was 60 rpm or less. However, this range will vary depending on the type of stepping motor actually used, the constitution of the belt drive mechanism, and soon. Therefore, it is possible to start driving when contact between the sheet re-supply resist roller 51 and the press roller 21 is detected in cases where the printing speed is such that the delay time in starting to drive the transport belts 108 can be ignored.

Also, the time lag after applying the operation command signal to the solenoid 73 until driving the transport belts 108 varies depending on the configuration, so values measured on the actual configuration are used.

Figure 15:
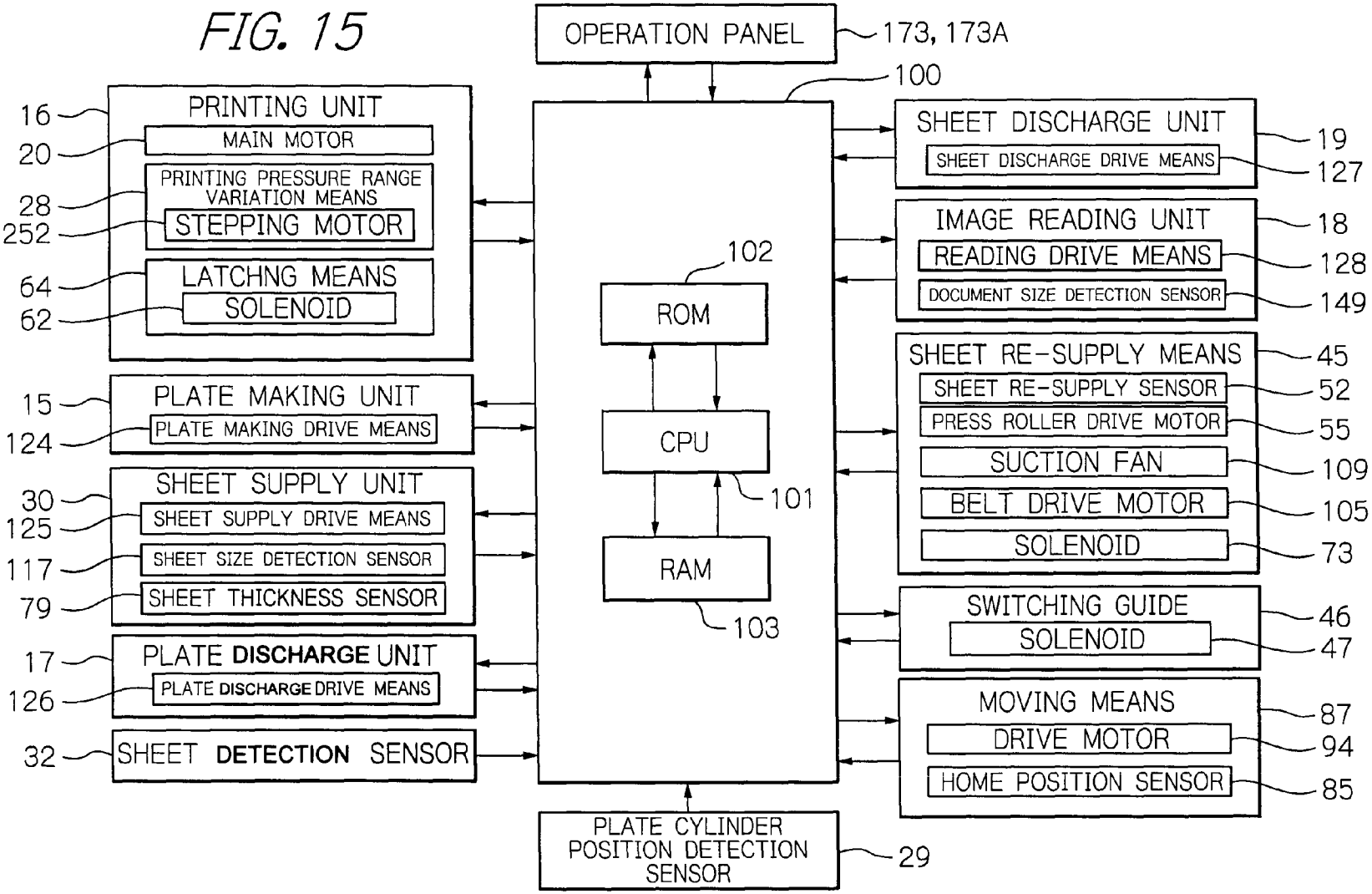
FIG. 15 is a block diagram showing the main parts of the control configuration of the double-sided stencil printing apparatus for modification 1 and modification 2.

When carrying out installation of the master operation corresponding to the reverse side stenciled image 8B of the sub-divided stenciled master 8X on the plate cylinder 1, or when carrying out the reverse side printing of the subsequent formal double-sided printing operation, the printing pressure range variation means 28 is controlled by the control device 100 so that printing pressure ON timing by the press roller 21 is selected in accordance with printing pressure range II shown in FIG. 9. In other words, the stepping motor 252 shown in FIGS. 14 and 15 is rotated and via a commonly known detailed operation via the rotation of the stepped cam (49), the cam plate 243C is selected, and the outer peripheral surface of the cam plate 243C is brought into contact with the cam follower 241.

In parallel with this transport, at a predetermined rotational position of the plate cylinder 1, that is a predetermined rotational position when the leading edge portion of the reverse side stenciled image 8B of the sub-divided stenciled master 8X on the plate cylinder 1 reaches a rotational position corresponding to the nip portion 16*a*, when the small diameter portion of the cam plate 243C which rotates in synchronization with the rotation of the plate cylinder 1 is in opposition with the cam follower 241 and in the non-contacting state, the press roller 21 applies printing pressure to press the reverse side (the top surface in FIG. 4) of the sheet 36*a* that has been printed on the front side slightly to the left of the reverse side stenciled image 8B of the sub-divided stenciled master 8X wound around the reverse side area 1B of the plate cylinder 1, as shown in FIG. 9. As a result of the impelling force of the printing pressure spring 242 the nip portion 16*a* is formed, and double-sided printing for installation of the master is carried out (see the ON timing of the press roller 21 in accordance with the printing pressure range pattern II shown in FIG. 9).

In this way, ink fills the reverse side stenciled image 8B of the sub-divided stenciled master 8X on the plate cylinder 1, and the reverse side printed image is formed on the reverse side of the sheet 36*a* that has been printed on the front side.

After the double-sided printing has been carried out, the leading edge portion of the double-sided printed sheet 36*b* for installation of the master is positively separated from the sub-divided stenciled master 8X on the plate cylinder 1 by the separation claw 170 near the outer peripheral surface of the plate cylinder 1 and the air blown from the separation fan 171, the same as for the single-sided printed sheet 36*c*. The separated double-sided printed sheet 36*b* drops downwards onto the sheet discharge transport device 152, is drawn to and held by the suction force of the suction fan 159, and is transported downstream, to the sheet discharge tray 172, in the sheet transport direction X on the top surface of the sheet discharge belt 158 which rotates in the counterclockwise direction as shown in FIG. 4.

On the other hand, when the plate cylinder 1 has rotated about ¾ of a revolution from the time that the press roller 21 has contacted the outer peripheral surface of the plate cylinder 1, when the large diameter peripheral surface of the cam plate 243C contacts the cam follower 241, the press roller 21 is restored to and maintained at the non-printing position separated from the outer peripheral surface of the plate cylinder 1, via the same detailed operation as for operation example 1. In addition, the plate cylinder 1 rotates to the home position again and stops, thereby completing the installation of the master operation, and the double-sided stencil printing apparatus 300 enters the standby state for the formal double-sided printing operation.

After the double-sided stencil printing apparatus 300 enters the printing standby state, the printing conditions are entered using the printing speed setting key 183 and various keys on the operation panel 173. Then, the image positions or the densities or the like are checked with a trial print. After the number of printed sheets has been entered using the numerical keypad 179, the printing start key 175 is pressed. Then sheets 36 are continuously supplied from the sheet supply unit 30, and the double-sided printing operation is carried out for the set number of sheets as set using the numerical keypad 179.

The points of difference of the formal double-sided printing operation for the set number of sheets differs basically from the installation of the master operation described above are summarized below. The other details of the operation can be easily understood and implemented by a person skilled in the art to which this patent application pertains from the installation of the master operation described above, the double-sided printing operation disclosed in Prior Art 7 through 9, and so on, so their explanation is omitted.

The first point is that each unit and device constituting the double-sided stencil printing apparatus 300 directly associated with operations such as sheet supply, sheet re-supply, front side printing, reverse side printing, sheet discharge, and so on, is driven with a speed corresponding to the printing speed set by the printing speed setting key 183 or the automatically set standard printing speed.

The second point is the belt drive motor 105 is controlled to rotate by a command from the control device 100 at the characteristic rotation speed set for each printing speed that depends on the sheet type, and then temporarily stops at the characteristic timing set for each printing speed that depends on the sheet type. In other words, the leading edge of the sheet 36*a* that has been printed on the front side is transported at the transport speed set for each printing speed that depends on the sheet type by the transport belts 108 via the clockwise rotation of the rear transport roller 107, to contact the stopper surface 53*a*. Immediately after the leading edge of the sheet 36*a* contacts the stopper surface 53*a*, transport is stopped at the timing set for each printing speed that depends on the sheet type. In this way bending of the leading edge of the sheet 36*a* that has been printed on the front side due to the energy of the contact between the sheet 36*a* that has been printed on the front side and the stopper surface 53*a* is minimized.

The third point is when printing the second sheet corresponding to the front side stenciled image 8A of the sub-divided stenciled master 8X on the plate cylinder 1, in FIGS. 4 and 9, and subsequently when printing the first sheet 36*a* that has been printed on the front side that has been reversed and transported in the sheet re-supply device 45 corresponding to the reverse side stenciled image 8B of the sub-divided stenciled master 8X on the plate cylinder 1, the printing pressure range variation means 28 is controlled to select the printing pressure ON timing by the press roller 21 in accordance with the printing pressure range pattern III as shown in FIG. 9, the same as for the normal single-sided printing mode (see operation example 1). At this time, the detailed operation of the printing pressure range variation means 28 is carried out the same as for operation example 1 described above. As shown in FIG. 4, the second sheet is pressed against the front side stenciled image 8A of the sub-divided stenciled master 8X on the plate cylinder 1 by the press roller 21. Then as a continuation, the first sheet 36*a* that has been printed on the front side and that has been reversed and transported in the sheet re-supply device 45 is pressed against the reverse side stenciled image 8B of the sub-divided stenciled master 8X on the plate cylinder 1 by the press roller 21, with the press roller 21 remaining in the printing position.

In the following, the printing operation has been repeated for (N−1) sheets out of the N sheets set using the numerical keys 179. When carrying out the double-sided printing on the reverse side of the $N^{th}$ (the final sheet) sheet 36*a* that has been printed on the front side that is temporarily held in the sheet re-supply transport device 104, immediately prior to completing the printing operation, the printing pressure range variation means 28 is controlled to select the printing pressure ON timing by the press roller 21 in accordance with the printing pressure range pattern II, as shown in FIG. 9. In other words, the reverse side of the $N^{th}$ sheet 36*a* that has been printed on the front side is pressed by the press roller 21 against only the reverse side stenciled image 8B of the double-sided stenciled master 8X on the plate cylinder 1. Then, after the sheet discharge operation as described above, the double-sided printing operation of the set $N^{th}$ sheet is completed, and the double-sided stencil printing apparatus 300 enters the printing standby state.

In this way, in normal double-sided printing, double-sided printing of the set number of sheets is carried out one per revolution of the plate cylinder 1. In roughly the first half revolution of the plate cylinder 1, the front side is printed corresponding to the front side stenciled image 8A of the double-sided stenciled master 8X. Then in the remaining half revolution of the plate cylinder 1 the reverse side is printed corresponding to the reverse side stenciled image 8B of the double-sided stenciled master 8X.

The fourth point is that compared with the double-sided printing operation for installation of the master, in the formal double-sided printing operation the number of sheets 36 used in the installation of the master printing operation is not counted as part of the normal number of sheets in the formal printing operation.

According to the present embodiment, it is possible to prevent poor resist caused by deformation of the leading edge portion of sheets due to bending when comparatively light thin sheet types contact the stopper surface 53*a* of the sheet re-supply means 45. Therefore, when the sheets 36 are thin and light, the transport speed (linear transport speed) of the transport belts 108 is reduced compared with the case where the sheets are thicker and heavier. In addition, the timing of stopping the transport belts 108 after contact of the sheet 36*a* that has been printed on the front side with the stopper surface 53*a* is earlier. Therefore bending of the sheet 36*a* that has been printed on the front side after contact with the stopper surface 53*a* is minimized. Also, the belt drive motor 105 is controlled so that bending of the sheet 36*a* that has been printed on the front side after contact with the stopper surface 53*a* due to excessive transport of the sheet 36*a* is minimized. Therefore deformation of the leading edge portion of the sheet 36*a* that has been printed on the front side is minimized, so it is possible to obtain double-sided printed matter in which deviation of the image position and poor resist is minimized.

Also, according to the present embodiment, the above advantages and effects are obtained, and in addition it is possible to carry out single-sided printing without wastefully using masters, as in the double-sided printing apparatus (1) according to Prior Art 7 and 9, referred to above. In addition, it is possible to obtain printed matter with no unevenness in the printed image or differences in printed image density when carrying out double-sided printing easily and at low cost. Further, it is possible to provide a new 1 step double-sided printing apparatus using the 1 plate cylinder 1 pressing means double sided printing format that is capable of minimizing the increase in installation space.

Modification 1 of the First Embodiment

FIG. 15 shows modification 1 of the first embodiment shown in FIGS. 1 through 14.

The main points of difference of modification 1 are that modification 1 has an operation panel 173A from which the sheet type setting key 186, that is included in the sheet type setting means disposed in the operation panel, 173 is eliminated. Then instead of the sheet type setting means (sheet type setting key 186, the enter key 180, and the four direction keys 184) the sheet thickness sensor 79 is disposed as the sheet type detection means as shown in FIG. 15, at the predetermined location shown in FIG. 1.

In other words, the control device 100 of modification 1 has the function as control means of controlling the belt drive motor 105 to change the transport speed of the transport belts 108 until the leading edge of the sheet 36*a* that has been printed on the front side contacts the stopper surface 53*a* in accordance with the sheet type pertaining to the thickness or similar of the sheet 36 detected by the sheet thickness sensor 79 or similar. In addition, the control device 100 of modification 1 has the function as control means of controlling the belt drive motor 105 to change the transport stop timing of the transport belts 108 when the leading edge of the sheet 36*a* that has been printed on the front side contacts the stopper surface 53*a*. Further, the control device 100 has the function as control means of controlling the belt drive motor 105 so that during sheet re-supply also, the transport speed of the transport belts 108 is the transport speed corresponding to the detected sheet type.

The sheet thickness sensor 79 may for example be a type that measures the thickness of the sheet 36 from the transmission ratio of light passing through the sheet 36, or a type that measures the thickness of the sheet 36 by measuring the reflected wave from the sheet 36 using an ultrasonic wave, or a type that measures the thickness of the sheet 36 by measuring the distance to the surface of the sheet 36 using laser light, and so on. Of these methods, the method of using the transmission ratio of light has been commercialized and is in actual use.

The operation of modification 1 can be easily implemented by one skilled in the art to which the present invention pertains, from the configuration of the modification 1 as described above and from the operation of the first embodiment described above, and so on. Therefore, the explanation of the operation of modification 1 has been omitted.

According to modification 1, it is possible to eliminate the effort in manually setting the type of the sheet 36 every time, and the other advantages and effects are basically the same as for the first embodiment.

Modification 2 of the First Embodiment

FIG. 15 shows modification 2 of the first embodiment shown in FIGS. 1 through 14.

The main point of difference of modification 2 is that besides the sheet type setting means (sheet type setting key 186, the enter key 180, and the four direction keys 184) disposed in the operation panel 173, in addition the sheet thickness sensor 79 is disposed as sheet type detection means as shown in FIG. 15.

In other words, the control device 100 of modification 1 has the function as control means of controlling the belt drive motor 105 to change the transport speed of the transport belts 108 of the sheet re-supply transport device 104, in accordance with the sheet type pertaining to the thickness or similar of the sheet 36 detected by the sheet thickness sensor 79 or similar. In addition, the control device 100 of modification 2 has the function as control means of controlling the belt drive motor 105 to change the transport stop timing of the transport belts 108 when the leading edge of the sheet 36*a* that has been printed on the front side contacts the stopper surface 53*a*.

In modification 2, it is possible for example to configure the control device 100 with the control function so that the data signal for the thickness of the sheet 36 selected and set using the sheet type selection means (sheet type setting key 186, the enter key 180, and the four direction keys 184) has priority over the data signal for the sheet thickness 36 transmitted and input to the control device 100 from the sheet thickness sensor 79.

The operation of modification 2 can be easily implemented by one skilled in the art to which the present invention pertains, from the configuration of the modification 2 as described above and from the operation of the first embodiment described above, and so on. Therefore, the explanation of the operation of modification 1 has been omitted. Modification 2 has the same basic advantages and effects as the first embodiment.

Second Embodiment

If the particular advantages and effects of the first embodiment are not necessary, then compared with the first embodiment shown in FIGS. 1 through 14, in the second embodiment the function of the control device 100 of the first embodiment the function of changing the transport stop timing of the transport belts 108 when the leading edge of the sheet 36*a* that has been printed on the front side contacts the stopper member 53 in accordance with the sheet type is omitted from the control device 100 of the first embodiment. The control device, which is not shown in the drawings, is configured to have only the function of changing the transport speed of the transport belts 108 until the leading edge of the sheet 36*a* that has been printed on the front side contacts the stopper member 53, and the function of changing the transport speed of the transport belt 108 during sheet re-supply, in accordance with the sheet type.

In this case, two types of data table, in which the sheet type and the rotational speed of the belt drive motor 105 are set for each printing speed, are recorded in advance in the ROM of the control device which is not shown in the drawings.

The operation of the second embodiment can be easily implemented by one skilled in the art to which the present invention pertains, from the configuration of the first embodiment described above, and soon. Therefore, the explanation of the operation of the second embodiment has been omitted. Also, the application of modification 1 and modification 2 to the second embodiment can also be easily implemented by one skilled in the art to which the present invention pertains, so its explanation has been omitted.

Third Embodiment

If the particular advantages and effects of the first embodiment are not necessary, then compared with the first embodiment shown in FIGS. 1 through 14, in the third embodiment the function of changing the transport speed of the transport belts 108 until the leading edge of the sheet 36*a* that has been printed on the front side contacts the stopper member 53 in accordance with the sheet type is omitted from the control device 100 of the first embodiment. The control device, which is not shown in the drawings, is configured to have only the function of changing the transport stop timing of the transport belts 108 when the leading edge of the sheet 36*a* that has been printed on the front side contacts the stopper member 53, and the function of changing the transport speed of the transport belts 108 during sheet re-supply, in accordance with the sheet type.

In this case, a data table in which the sheet type and the stop timing of the belt drive motor 105 after contact of the sheet 36*a* that has been printed on the front side with the stopper member 53 are set for each printing speed, and a data table in which the sheet type and the rotational speed of the belt drive motor 105 are set for each printing speed are recorded in advance in the ROM of the control device which is not shown in the drawings.

The operation of the third embodiment can be easily implemented by one skilled in the art to which the present invention pertains, from the configuration of the first embodiment described above, and so on. Therefore, the explanation of the operation of the third embodiment has been omitted. Also, the application of modification 1 and modification 2 to the third embodiment can also be easily implemented by one skilled in the art to which the present invention pertains, so its explanation has been omitted.

If the advantages described above are not necessary, the configuration of the press roller rotation drive means 54 shown in FIG. 2 is not essential, and for example a configuration in which the press roller 21 is driven to rotate by contact with the plate cylinder 1, as disclosed in Prior Art 7 and 8, may be used.

According to the present invention, printed matter with little deviation of the image position with respect to the sheet position and with good resist can be obtained, by eliminating delay in the sheets due to slippage between roller and press roller by operating the transport belt on the upstream side, and so on, and by eliminating resistance when transporting due to contact with the guide member provided along the circumferential surface of the press roller, when pressing sheets against the press roller with a roller or the like, and transporting the sheets along the guide member or the like provided along the peripheral surface of the press roller.

Various modifications will become possible for those skilled in the art after receiving the teachings of the present disclosure without departing from the scope thereof.

What is claimed is:

1. A double-sided stencil printing apparatus, comprising:

plate making means that forms masters divided into front and rear surfaces along a direction of transport of a stencil blank sheet;

transport means that transports a sheet and includes a transport belt, a suction fan, and a stopper, said stopper receiving, contacting, and holding the sheet printed on a front side thereof, when printing on both sides of the sheet by interchanging the front and rear sides thereof;

a stopper release mechanism that releases the contact between the sheet and the stopper to print on the rear side of the sheet;

a press roller that presses against the interchanged front and rear sides of the sheet that is to be printed; and a resist roller that brings the sheet into contact with the press roller when printing the rear side, wherein the transport means re-supplies the sheet to a printing position of the apparatus with the front and rear sides of the sheet being reversed to print on the rear side of the sheet, and wherein the transport belt is operated after the contact between the stopper and the sheet is released using an operation command signal of the resist roller as a reference.

2. The double-sided stencil printing apparatus as claimed in claim 1, wherein a transport speed of the transport means is substantially the same as a circumferential speed of a plate cylinder.

3. The double-sided stencil printing apparatus as claimed in claim 2, wherein the transport means accelerates at a predetermined acceleration corresponding to the plate cylinder circumferential speed, until the transport speed is substantially the same as the circumferential speed of the plate cylinder.

4. The double-sided stencil printing apparatus as claimed in claim 2, wherein a timing for the start of feeding by the transport means using the operation command signal of the resist roller as a reference is set to a predetermined time lag corresponding to a circumferential speed of the plate cylinder.

5. The double-sided stencil printing apparatus as claimed in claim 1, wherein when a printing speed for which a delay time in starting to drive the transport means can be ignored, the start of feeding by the transport means is commenced after a detection of contact between the resist roller and the press roller.

6. The double-sided stencil printing apparatus as claimed in claim 1, wherein the transport belt includes a plurality of holes to allow air from the suction fan to attract and hold the sheet that has been printed on the front side on the transport belt.

7. The double-sided stencil printing apparatus as claimed in claim 1, wherein when a leading edge of the sheet printed on the front side thereof contacts the stopper, the transport belt stops transporting the sheet, and the transport belt resumes the transporting of the sheet after the press roller is rotated.

* * * * *

UNITED STATES PATENT AND TRADEMARK OFFICE

CERTIFICATE OF CORRECTION

PATENT NO. : 7,849,793 B2
APPLICATION NO. : 11/848852
DATED : December 14, 2010
INVENTOR(S) : Takayuki Takahashi It is certified that error appears in the above-identified patent and that said Letters Patent is hereby corrected as shown below:

Column 15, line 62, change “A” to “^”

Column 54, line 43, change “the” to “a”

Signed and Sealed this
Twenty-ninth Day of March, 2011

David J. Kappos

David J. Kappos
*Director of the United States Patent and Trademark Office*